US011517799B2

(12) United States Patent
Jertson et al.

(10) Patent No.: US 11,517,799 B2
(45) Date of Patent: Dec. 6, 2022

(54) MULTI-COMPONENT GOLF CLUB HEAD

(71) Applicant: KARSTEN MANUFACTURING CORPORATION, Phoenix, AZ (US)

(72) Inventors: Martin R. Jertson, Phoenix, AZ (US); Erik M. Henrikson, Phoenix, AZ (US); Samuel J. Pendred, Denford (GB); Jeremy S. Pope, Kansas City, MO (US); Clayson C. Spackman, Scottsdale, AZ (US); Cory S. Bacon, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/105,459

(22) Filed: Nov. 25, 2020

(65) Prior Publication Data

US 2021/0093935 A1 Apr. 1, 2021

Related U.S. Application Data

(63) Continuation-in-part of application No. PCT/US2020/043483, filed on Jul. 24, 2020, which is (Continued)

(51) Int. Cl.
*A63B 53/08* (2015.01)
*A63B 53/06* (2015.01)

(Continued)

(52) U.S. Cl.
CPC ..... *A63B 53/08* (2013.01); *A63B 1/00* (2013.01); *A63B 53/06* (2013.01); *A63B 53/045* (2020.08);

(Continued)

(58) Field of Classification Search
CPC ..... A63B 53/08; A63B 53/06; A63B 1/00; A63B 2053/0491; A63B 60/54;

(Continued)

(56) References Cited

U.S. PATENT DOCUMENTS 5,624,331 A 4/1997 Lo et al.
5,997,415 A 12/1999 Wood (Continued)

FOREIGN PATENT DOCUMENTS

CN 1654100 A 8/2005
JP 2004024734 A 1/2004

(Continued)

OTHER PUBLICATIONS

Jason Bruno, TaylorMade ('17) M1 Driver Review, accessed Sep. 14, 2017.

(Continued)

*Primary Examiner* — Sebastiano Passaniti

(57) ABSTRACT

Embodiments of a golf club head comprising a first component and a second component that are coupled together to enclose a hollow interior are disclosed herein. The first component comprises at least a striking face, a striking face return, and a rear extension. In some embodiments, the first component also comprises a weight channel at a rear end and one or more braces that attach to the striking face return and the rear extension. The second component comprises a crown portion, a sole toe portion, and a sole heel portion. The density of the second component is less than the density of the first component. In some embodiments, the first component mass is 85% to 96% of a mass of the golf club head.

18 Claims, 55 Drawing Sheets

Related U.S. Application Data a continuation-in-part of application No. 16/789,261, filed on Feb. 12, 2020, now Pat. No. 10,953,294, which is a continuation of application No. 16/215,474, filed on Dec. 10, 2018, now Pat. No. 10,596,427, application No. 17/105,459, filed on Nov. 25, 2020, which is a continuation-in-part of application No. PCT/US2020/047702, filed on Aug. 24, 2020.

(60) Provisional application No. 62/596,677, filed on Dec. 8, 2017, provisional application No. 62/878,263, filed on Jul. 24, 2019, provisional application No. 62/940,799, filed on Nov. 26, 2019, provisional application No. 62/976,229, filed on Feb. 13, 2020, provisional application No. 63/015,398, filed on Apr. 24, 2020, provisional application No. 62/891,158, filed on Aug. 23, 2019.

(51) Int. Cl.

| | |
|---|---|
| ***A63B 53/04*** | (2015.01) |
| ***A63B 60/54*** | (2015.01) |
| ***A63B 1/00*** | (2006.01) |
| *A63B 102/32* | (2015.01) |

(52) U.S. Cl.

CPC ..... *A63B 53/0412* (2020.08); *A63B 53/0433* (2020.08); *A63B 53/0466* (2013.01); *A63B 60/54* (2015.10); *A63B 2053/0491* (2013.01); *A63B 2102/32* (2015.10); *A63B 2209/023* (2013.01)

(58) Field of Classification Search

CPC ..... A63B 53/0433; A63B 2209/023; A63B 2102/32; A63B 53/045; A63B 53/0412; A63B 53/0466

USPC ..... 473/324–350, 287–292

See application file for complete search history.

(56) References Cited

U.S. PATENT DOCUMENTS

| | | | | |
|---|---|---|---|---|
| 6,471,604 | B2 | 10/2002 | Hocknell | |
| 6,558,271 | B1 | 5/2003 | Beach et al. | |
| 6,575,845 | B2 | 6/2003 | Galloway | |
| 6,663,504 | B2 | 12/2003 | Hocknell et al. | |
| 6,739,983 | B2 | 5/2004 | Helmstetter | |
| 6,872,152 | B2 | 3/2005 | Beach | |
| 6,929,565 | B2 | 8/2005 | Nakahara et al. | |
| 6,955,612 | B2 | 10/2005 | Lu | |
| 7,025,692 | B2 | 4/2006 | Erickson et al. | |
| 7,074,136 | B2 | 7/2006 | Noguchi | |
| 7,121,957 | B2 | 10/2006 | Hocknell et al. | |
| 7,128,664 | B2 | 10/2006 | Onoda et al. | |
| 7,147,576 | B2 | 12/2006 | Imamoto et al. | |
| 7,258,625 | B2 | 8/2007 | Kawaguchi | |
| 7,261,645 | B2 | 8/2007 | Oyama | |
| 7,285,060 | B2 | 10/2007 | Williams | |
| 7,338,390 | B2 | 3/2008 | Lindsay | |
| 7,387,577 | B2 | 6/2008 | Murphy et al. | |
| 7,445,564 | B2 | 11/2008 | Kusumoto | |
| 7,455,600 | B2 | 11/2008 | Imamoto | |
| 7,468,005 | B2 | 12/2008 | Kouno et al. | |
| 7,497,789 | B2 | 3/2009 | Bumett et al. | |
| 7,530,901 | B2 | 5/2009 | Imamoto et al. | |
| 7,530,903 | B2 | 5/2009 | Imamoto et al. | |
| 7,601,078 | B2 | 10/2009 | Mergy et al. | |
| 7,632,193 | B2 * | 12/2009 | Thielen | A63B 53/0466 473/345 |
| 7,632,195 | B2 | 12/2009 | Jorgensen | |
| 7,758,454 | B2 | 7/2010 | Bumett et al. | |
| 7,785,212 | B2 | 8/2010 | Lukasiewicz et al. | |
| 7,806,782 | B2 | 10/2010 | Stites et al. | |
| 7,931,546 | B2 | 4/2011 | Bennett et al. | |
| 7,959,522 | B2 | 6/2011 | North | |
| 8,025,591 | B2 | 9/2011 | Cruz et al. | |
| 8,100,781 | B2 | 1/2012 | Bumett et al. | |
| 8,506,421 | B2 | 8/2013 | Stites et al. | |
| 8,540,588 | B2 | 9/2013 | Rice et al. | |
| 8,585,514 | B2 | 11/2013 | Boyd | |
| 8,795,101 | B2 | 8/2014 | Nishio | |
| 8,814,723 | B2 | 8/2014 | Tavares | |
| 8,870,683 | B2 | 10/2014 | Hettinger et al. | |
| 8,926,450 | B2 | 1/2015 | Takahashi et al. | |
| 9,079,368 | B2 | 7/2015 | Tavares et al. | |
| 9,168,435 | B1 | 10/2015 | Boggs et al. | |
| 9,211,449 | B2 | 12/2015 | Demille et al. | |
| 9,220,955 | B2 | 12/2015 | Hayase et al. | |
| 9,302,161 | B2 * | 4/2016 | de la Cruz | A63B 60/02 |
| 9,352,198 | B2 | 5/2016 | Roach et al. | |
| 9,452,325 | B2 | 9/2016 | DeShiell et al. | |
| 9,457,245 | B2 | 10/2016 | Lee | |
| 9,468,820 | B2 | 10/2016 | Sugimoto | |
| 9,802,372 | B2 | 10/2017 | Stites et al. | |
| 9,861,865 | B1 | 1/2018 | Harbert et al. | |
| 9,901,794 | B2 | 2/2018 | Beno et al. | |
| 10,046,212 | B2 | 8/2018 | Sargent et al. | |
| 10,065,084 | B2 | 9/2018 | Myrhum et al. | |
| 10,232,230 | B2 | 3/2019 | Takehara et al. | |
| 10,245,479 | B2 | 4/2019 | Murphy et al. | |
| 10,518,141 | B2 | 12/2019 | Goudarzi et al. | |
| 10,596,427 | B2 | 3/2020 | Jertson et al. | |
| 10,828,543 | B2 | 11/2020 | Morales et al. | |
| 10,953,294 | B2 * | 3/2021 | Jertson | A63B 53/06 |
| 2004/0005936 | A1 | 1/2004 | Imamoto | |
| 2004/0116207 | A1 | 6/2004 | Shiell et al. | |
| 2005/0239576 | A1 | 5/2005 | Stites et al. | |
| 2005/0159243 | A1 | 7/2005 | Chuang | |
| 2006/0084525 | A1 | 4/2006 | Imamoto | |
| 2007/0155533 | A1 | 7/2007 | Solheim et al. | |
| 2008/0139339 | A1 | 6/2008 | Cheng | |
| 2008/0293512 | A1 | 11/2008 | Chen | |
| 2009/0227393 | A1 | 9/2009 | Kenji et al. | |
| 2010/0139079 | A1 | 6/2010 | Dawson et al. | |
| 2017/0072275 | A1 | 3/2017 | Mitzel et al. | |
| 2019/0176001 | A1 | 6/2019 | Jertson et al. | |
| 2019/0282865 | A1 | 9/2019 | Nakamura | |
| 2019/0344136 | A1 | 11/2019 | Lee | |
| 2020/0038721 | A1 | 2/2020 | Greensmith et al. | |

FOREIGN PATENT DOCUMENTS

| | | | |
|---|---|---|---|
| JP | 3103394 | U | 8/2004 |
| JP | 2005177092 | A | 7/2005 |
| JP | 2005230332 | A | 9/2005 |
| JP | 2011072661 | A | 4/2011 |
| JP | 2014008141 | A | 1/2014 |

OTHER PUBLICATIONS

Russley Golf Club; A new level of distance and forgiveness, The new TaylorMade M2 Driver, accessed Sep. 14, 2017.

New E9 Face Technology With Dual Roll Gives You Even Longer and More Forgiving Drives, Fairway Golf USA, accessed Jun. 7, 2016.

Women's Great Big Bertha Driver, Callaway Certified Pre-Owned, accessed Mar. 18, 2019.

Int'l Search Report and Written Opinion for Int'l Appl. No. PCT/US2020/043483, filed Jul. 24, 2020.

Int'l Search Report and Written Opinion for corresponding Int'l Appl. No. PCT/US2020/062434, filed Nov. 25, 2020.

* cited by examiner

MULTI-COMPONENT GOLF CLUB HEAD

CROSS REFERENCE TO RELATED APPLICATIONS

This is a continuation-in-part of U.S. patent application Ser. No. 16/789,261, filed on Feb. 2, 2020, which is a continuation of U.S. patent application Ser. No. 16/215,474, filed Dec. 10, 2018, now U.S. Pat. No. 10,596,427, which claims the benefit of U.S. Provisional Patent Application No. 62/596,677, filed Dec. 8, 2017, the contents all of which are fully incorporated herein by reference. This is further a continuation-in-part of International Patent Application No. PCT/US2020/043483, filed on Jul. 24, 2020, which claims the benefit of U.S. Provisional Patent Application No. 62/878,263, filed Jul. 24, 2019, the contents all of which are fully incorporated herein by reference. This is further a continuation-in-part of International Patent Application No. PCT/US2020/047702, filed Aug. 24, 2020, which claims the benefit of U.S. Provisional Patent Application No. 62/891,158, filed on Aug. 23, 2019, the contents all of which are fully incorporated herein by reference. This further claims the benefit of U.S. Provisional Patent Application No. 62/940,799, filed Nov. 26, 2019, and U.S. Provisional Patent Application No. 62/976,229, filed Feb. 13, 2020, and U.S. Provisional Patent Application No. 63/015,398, filed Apr. 24, 2020, the contents all of which are fully incorporated herein by reference.

FIELD

The disclosure relates generally to golf equipment, and more particularly, to multi-component golf club heads and methods to manufacture multi-component golf club heads.

BACKGROUND

In general, the club head mass is the total amount of structural mass and the amount of discretionary mass. In an ideal club design, having a constant total swing weight, structural mass would be minimized (without sacrificing resiliency) to provide a designer with sufficient discretionary mass for optional placement to customize and maximize club performance. Structural mass generally refers to the mass of the materials required to provide the club head with the structural resilience to withstand repeated impacts. Structural mass is highly design-dependent, and provides a designer with a relatively low amount of control over specific mass distribution. Conversely, discretionary mass is any additional mass (beyond the minimum structural requirements) that may be added to the club head design solely to customize the performance and/or forgiveness of the club. There is a need in the art for alternative designs to all metal golf club heads to provide a means for maximizing discretionary weight to maximize club head moment of inertia (MOI) and lower/back center of gravity (CG), and provide options for golf ball flight manipulation.

BRIEF DESCRIPTION OF THE DRAWINGS

FIG. 1D including a loft plane, a ground plane, and a Z axis.

DETAILED DESCRIPTION

Figure 1A:
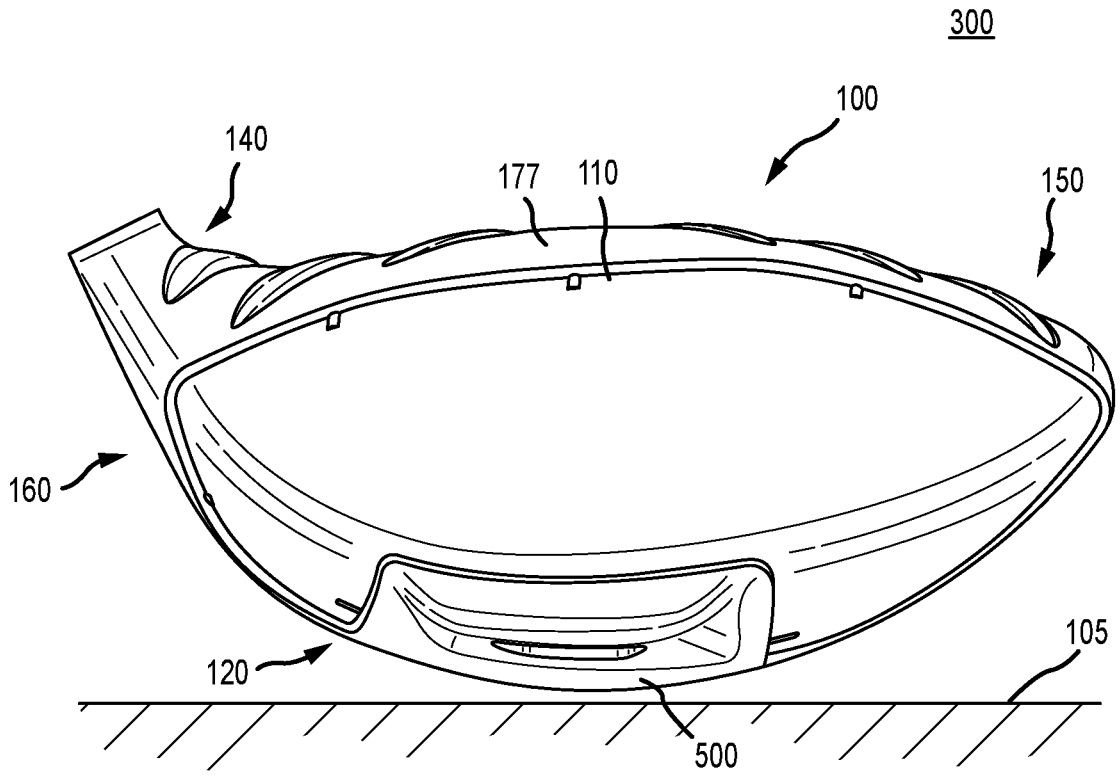
FIG. 1A illustrates a back view of an assembled golf club head.
Figure 1B:
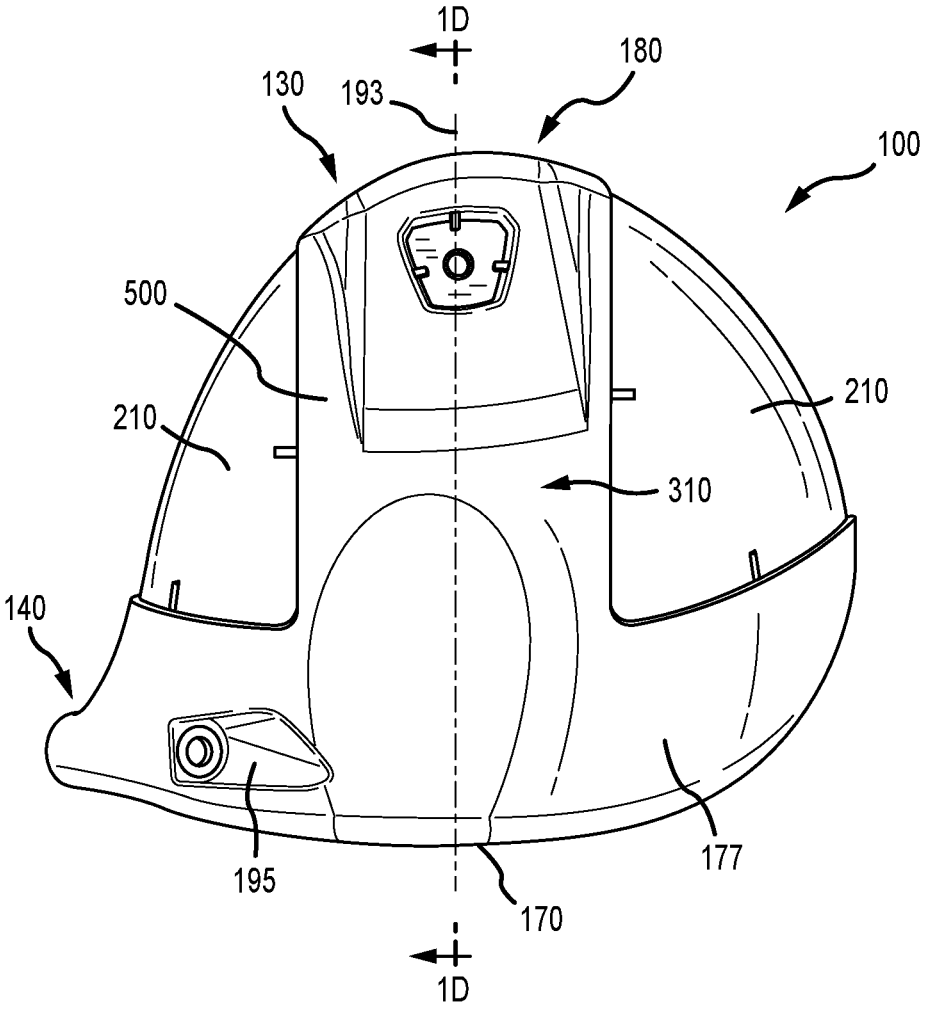
FIG. 1B illustrates a bottom view of an assembled golf club head.
Figure 1C:
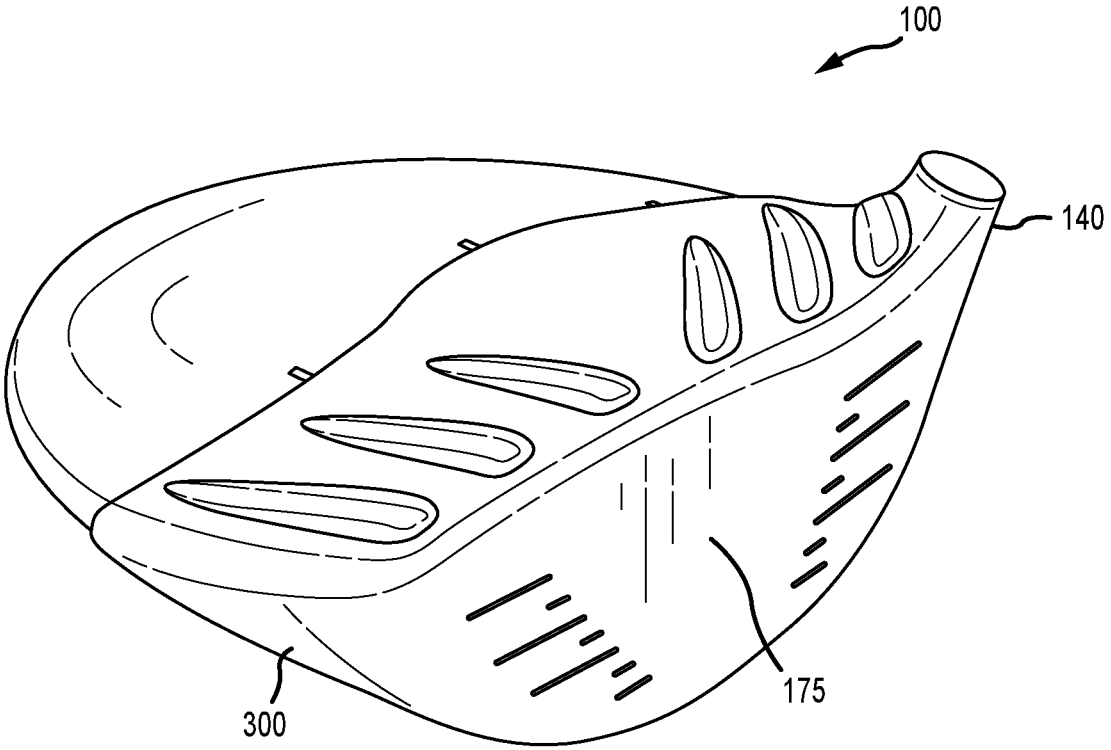
FIG. 1C illustrates a front perspective view of an assembled golf club head.

Described herein is a hollow golf club head comprising two major components. The first component is metallic. The second component is non-metallic. The second component may comprise a single portion or a plurality of portions. The metallic, first component comprises the striking portion and a sole extension. The non-metallic, second component comprises the rear portion of the crown, and wraps around to also comprise a portion of the sole. The first component comprises the load bearing, or structural area of the golf club head, and also comprises most of the mass of the golf club head. The first component comprises a rearwardly extending sole portion with a significant portion of the golf club mass at the most rearward portion of the extension, causing the first part to form a "T" shape when viewed from above. The first component may further comprise a bridge or crown brace extending to the rear portion of the golf club head. This arrangement provides discretionary mass available to be redistributed to improve the center of gravity (CG) location and moment of inertia (MOI). The improved CG and MOI provide for a more precise ball flight compared to traditional, all metallic golf club heads. The golf club head discussed herein may comprise a driver-type golf club head, a fairway-type golf club head, or a hybrid-type golf club head.

The more dense "T" shaped sole of the first component, coupled to the less dense crown wrapped around second component can optimize mass properties by reducing the crown mass, and shifting the golf club head center of gravity (CG) lower. The saved weight from the second component can be redistributed to other locations of the golf club head to further optimize the CG and increase the MOI. The CG of the golf club head can move lower and toward the rear of the golf club head comprising the first component and the second component, wherein the second component comprises a second material with a second density that is lower than the first material density, compared to an alternate golf club head comprising only the first material with a constant density.

In one or more embodiments, the club head may be a hollow, wood-style golf club head that is formed by coupling a first component with a second component to form a closed internal volume therebetween. The first component may include both the strikeface and a portion of the sole, and may be formed from a metal or metal alloy. The second and third components may form at least a portion of the crown and may wrap around to further form both a heel portion and a toe portion of the sole. In this design, the metallic first component extends between the polymeric heel portion of the sole and the polymeric toe portion of the sole.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "first," "second," "third," "fourth," "fifth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein. In the interest of consistency and clarity, all directional references used herein assume that the referenced golf club head is resting on a horizontally flat ground plane such that predefined loft and lie angles for the head are achieved. The "front" or "forward portion" of the golf club head generally refers to the side of the golf club head (when viewed normal to the ground plane) that includes the golf club strike face. Conversely, the rear portion of the club head can include anything behind the strikeface and/or portions of the club that are trailing the strike face at impact.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

I) First Embodiment of Golf Club Head

Described herein is an embodiment of a golf club head (100) comprising two components, a first component (300) and a second component (200). As shown in FIGS. 1A-1E, the golf club head forms a striking face (170), a return portion (177), a hosel (140), a crown (110), a sole (120), a heel end (160), a toe end (150), a trailing edge (130) at a rear-most portion of a rear end (180), a hosel (140), and a sole portion hosel adaptor attachment recess (195).

The golf club head (100) further defines a loft plane (198) tangent to the striking face center (175) of the striking face (170). A face height can be measured parallel to the loft plane between a top end of the striking face perimeter near the crown (110) and a bottom end of the striking face perimeter near the sole (120). In these embodiments, the striking face perimeter can be located along the outer edge of the striking face (170) where the curvature deviates from the bulge and/or roll of the striking face (170).

Figure 1D:
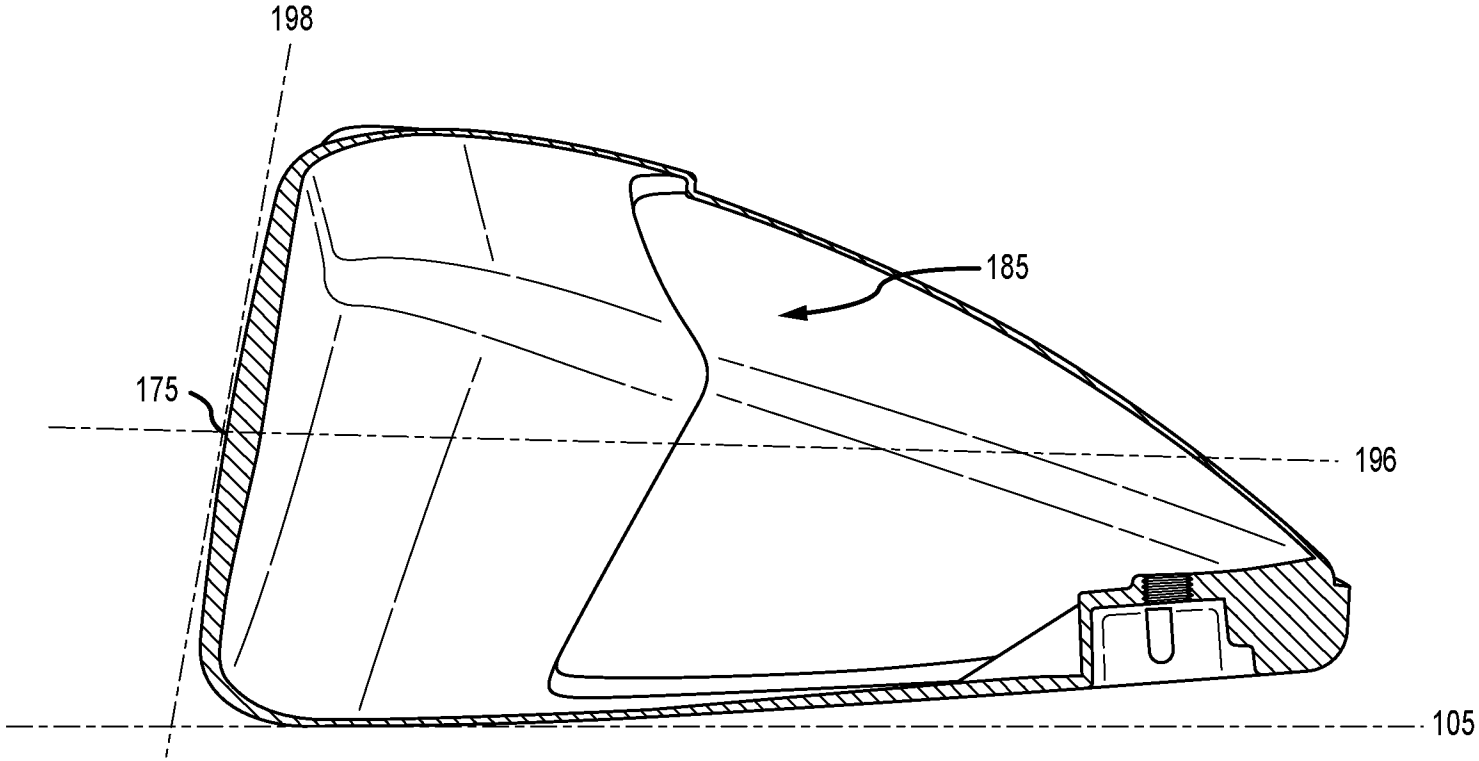
FIG. 1D illustrates a cross-sectional view of a golf club head, taken along the line 1D-1D in FIG. 1B.
Figure 1E:
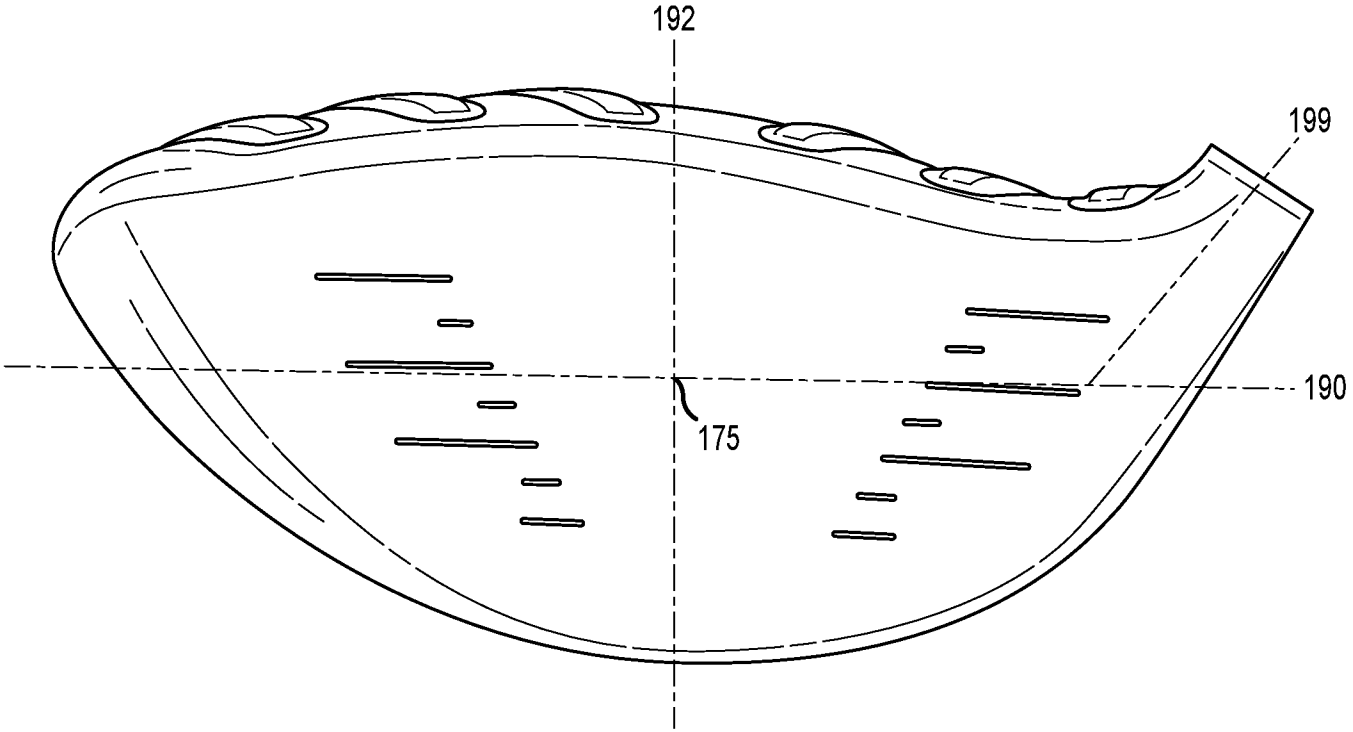
FIG. 1E illustrates a front view of an assembled golf club head with X, Y, and hosel axes.

Referring to FIGS. 1D and 1E, the striking face center (175) further defines a coordinate system having an origin at the striking face center (175). The coordinate system has an X axis, a Y axis, and a Z axis. The X axis (190) is a horizontal axis that extends through the striking face center (175) of the striking face (170) in a direction from the heel end (160) to the toe end (150) of the golf club head (100), and parallel to a ground plane (105) when the club head (100) is at address. The Y axis (192) is a vertical axis that extends through the striking face center (175) of the striking face (170) in a direction from the crown (110) to the sole (120) of the golf club head (100), and perpendicular to the X axis (190), and the Z axis (196) extends through the striking face center (175) of the striking face (170) in a direction from the striking face (170) to the rear end (180) of the golf club head (100) and perpendicular to the X axis (190) and the Y axis (192).

The coordinate system defines an XY plane extending through the X axis (190) and the Y axis (192), an XZ plane extending through the X axis (190) and the Z axis (196), and a YZ plane extending through the Y axis (192) and the Z axis (196), wherein the XY plane, the XZ plane, and the YZ plane are all perpendicular to one another and intersect at the origin of the coordinate system at the striking face center (175) of the striking face (170). The XY plane extends parallel to a hosel axis (199) and is positioned at an angle corresponding to the loft angle of the golf club head (100) from the loft plane. The hosel axis (199) is inclined from the X-axis (190) at a pre-determined angle referred to as the lie angle. The hosel axis (199) can be inclined from the X-axis (190) by a lie angle of between 58 degrees to 65 degrees, inclusively. In some embodiments, the hosel axis (199) is positioned at a 60 degree lie angle to X-axis (190) when viewed from a direction perpendicular to the XY plane.

The sole (120) is a lower hemisphere of the golf club head (100). In some embodiments, the sole (120) can be defined as a portion of the golf club head visible when viewed from a bottom view, when the club is at address. A skirt of the club head (100) can be defined as a junction between the sole (120) and the crown (110), particularly forming a perimeter of the club head behind the striking face (170).

The golf club head (100) can have a hollow body construction that forms a closed internal cavity (185). The outer shell of the golf club head (100) can comprise a first component (300) and a second component (200) that cooperate and/or couple to at least partially define an outer boundary of the internal cavity (185) (i.e., where each component (200, 300) defines at least a portion of the outer boundary of the internal cavity (185)).

Figure 1F:
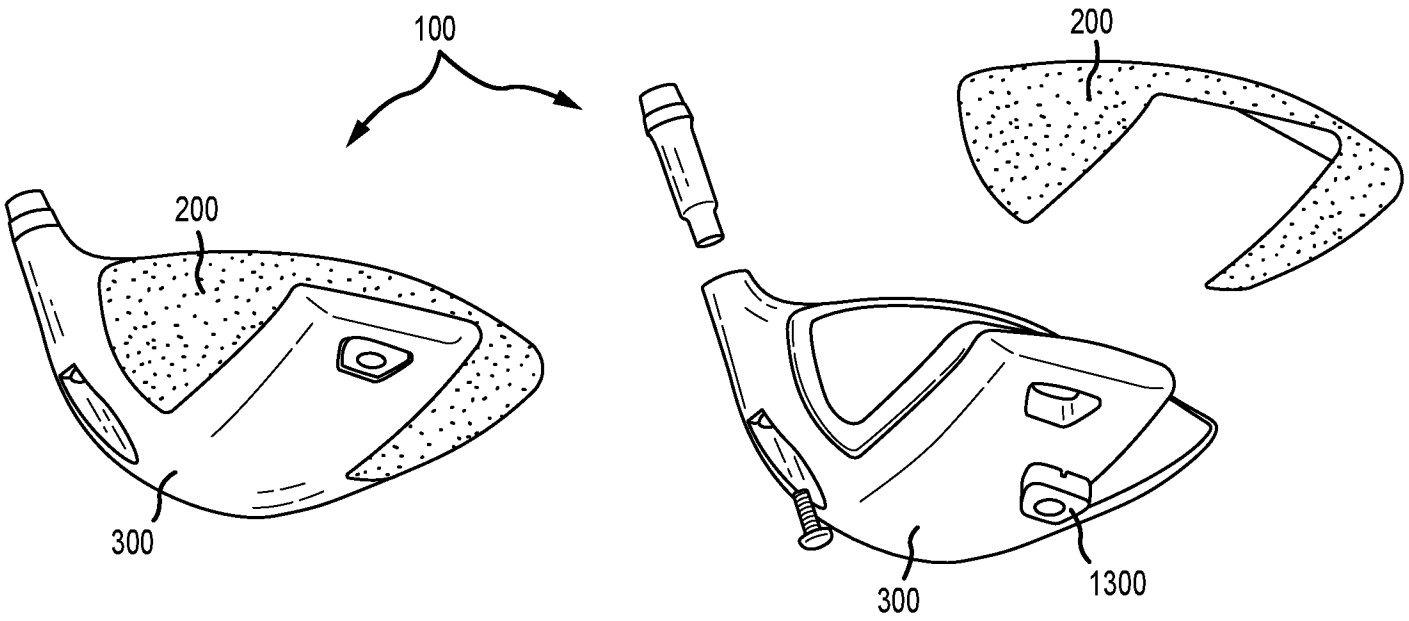
FIG. 1F illustrates an assembled and exploded view of a golf club head.

Referring to FIG. 1F, the first component (300) is roughly T-shaped when viewed from the sole. The sole of the first component (300) has a sole rear extension (500) with a mass portion (510), which houses at least one weight at the extreme rear end of the sole extension (500). The second component (200) forms most of the remainder of the golf club head that is not formed by the first component (300). This configuration lowers the CG of the assembled golf club head, and moves the CG towards the rear of the assembled golf club head.

The first component (300) comprises a first material having a first density. The first material is a metallic material. The second component (200) comprises a second material comprising a second density. The second material is a non-metallic material. The first and second components (300, 200) comprise a first component mass and a second component mass, respectively. In some embodiments, the first component (300) may be integrally formed as a single piece, so the first component can comprise a single material. In some embodiments, the first component (300) may be integrally formed with the exception of a mass portion that is removable and/or repositionable. Alternately, first component (300) may comprise a separately formed striking face insert comprising a different metallic material (i.e. a third material) than the remainder of the first component (300).

The second, non-metallic component (200) is coupled to, wrapped around, or overlapped over the first, metallic component (300) to form the hollow golf club head (100). The second component trailing edge portion (230) connects the second component crown portion (205) with the second component sole portions (212, 214) as they wrap around the first component (300).

The material density of the first component (300) (i.e. the first density) is greater than the material density of the second component (200) (i.e. the second density). The mass percentage of the first component (300) can range from 85% to 96% of the total mass of golf club head (100). For example, the first component percentage of the mass of the golf club head may be 85%, 86%, 87%, 88%, 89%, 90%, 91%, 92%, 93%, 94%, 95%, or 96%. The mass percentage of the second component (200) can range from 4% to 15% of the total mass of golf club head (100). The first component (300) comprises a rear extension (500) on the sole, the rear extension (500) having a mass portion (510). The mass portion (510) is a back end of the rear extension (500), beginning at a front side of a weight port and ending at the trailing edge (130). The mass portion (510) can comprise between 20% and 35% of the mass of the hollow multi-component golf club head (100). Placing so much of the mass of the golf club head at an extreme rear position of the golf club head provides mass characteristics that are functionally desirable. For example, the extreme rear position of the mass portion (510) can lower the CG of the golf club head, which improves launch characteristics.

A) First Component

As illustrated in FIGS. 1A-1F, and 4-8, the first component (300) can comprise the striking face (170), having a return portion (177), and a rearward extension (500). The return portion (177) forms at least a portion of the crown (400), a portion of the sole (120), the hosel (140), a portion of the heel end (160), a portion of the toe end (150), and a recessed lip (450) (also referred to as a joint extension surface). The rearward extension (500) connects to and extends rearwards from the return portion (177). The rearward extension (500) forms at least a portion of the sole (120) and positioned approximately perpendicular to the striking face (170). The rearward extension (500) extends from a rear edge of the return portion (177) towards a trailing edge (130) of the club head (100). The return portion (177) forms a rearward profile in a heel end to toe end direction. In other embodiments, the rearward profile of the first component (300) can extend from the heel end (160) toward the toe end (150) in a straight-lined profile, in a positive parabolic profile, in a bell shaped profile, or any other profiles relative to the striking face (170).

Figure 4:
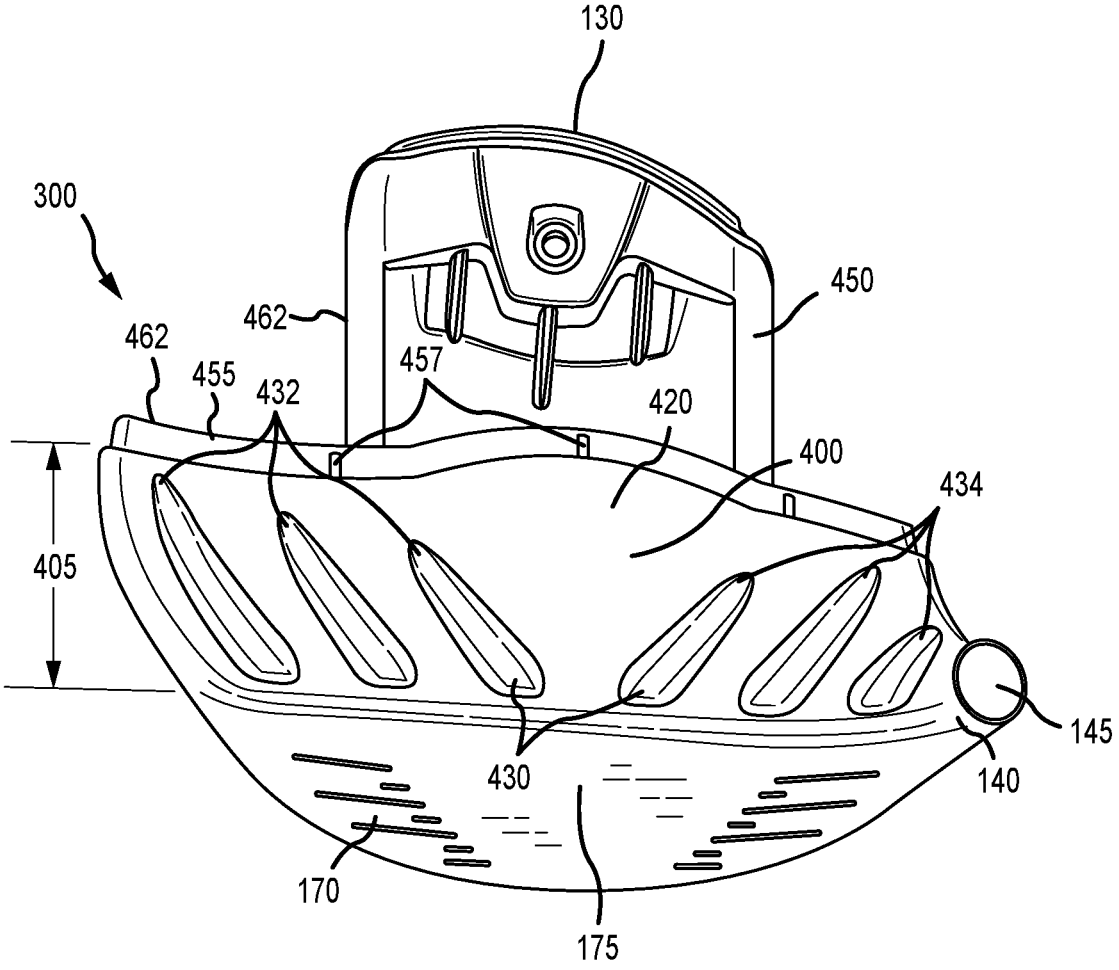
FIG. 4 illustrates a golf club head first component front top view.

Referring to FIGS. 1E and 4, the first component (300) comprises a hosel bore (145) defining a hosel axis (199), a striking face center (175), a forward crown portion (400), having a forward crown portion width (405), and a first component trailing edge (130). Some embodiments may further comprise first component crown portion turbulators (430) having a first component crown portion turbulators toe portion (432) and a first component crown portion turbulators heel portion (434).

The first component can comprise a recessed lip (450, also referred to as a first component lip or a joint extension surface) configured to overlap with a portion of the second component (200), and together form the golf club head (100). The first component lip (450) can border the first component perimeter edge (462) having a first component crown portion lip (455), and first component tabs (457). The first component tabs (457), and matching grooves in the second component, align the first component (300) to the second component (200) during assembly, and also add mechanical support to prevent sideways movement between the first component (300) and the second component (200). In some embodiments, the second component does not comprise grooves to receive the first component tabs (457). In these embodiments, the first component tabs (457) provide predetermined spacing (i.e. an adhesive gap) between the first and second components. This predetermined spacing can cause the adhesive to bond uniformly and evenly across the lap joint.

Figure 5:
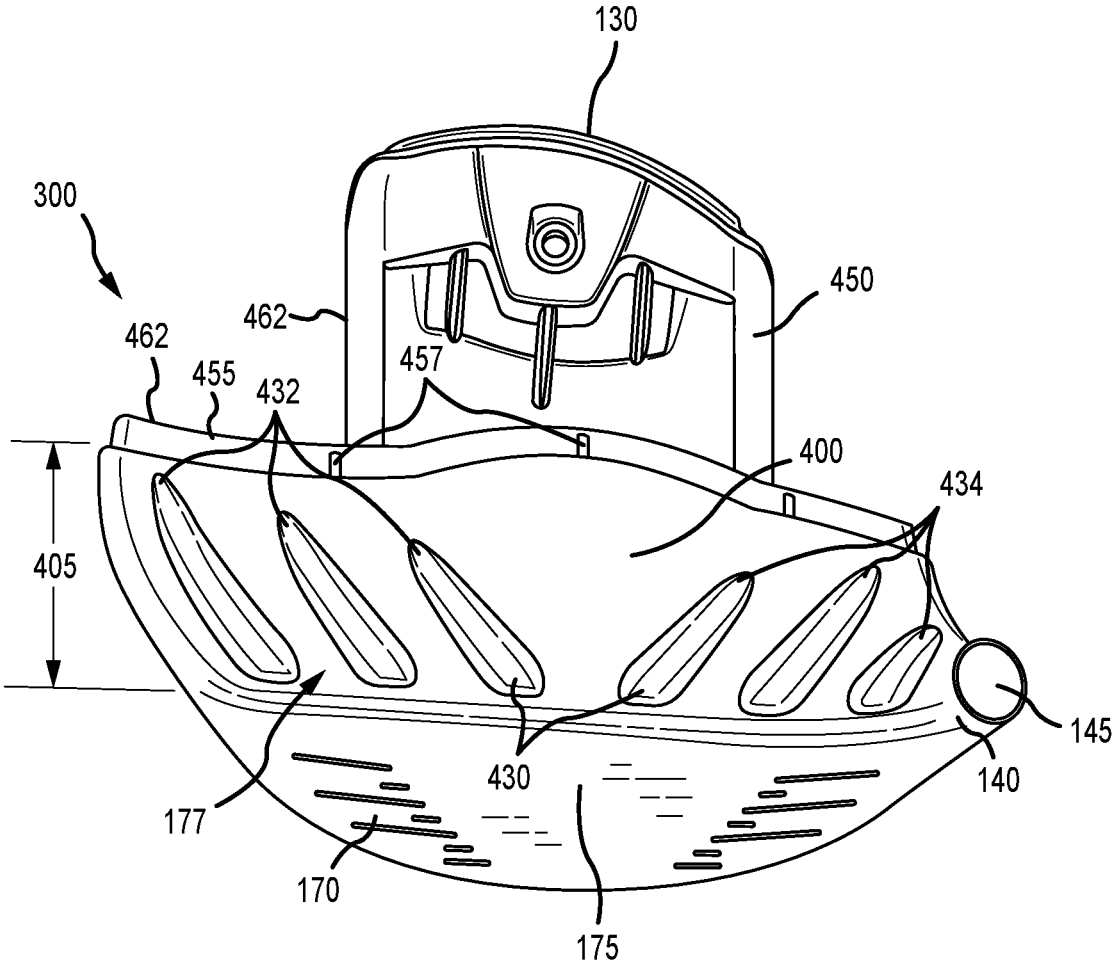
FIG. 5 illustrates a golf club head first component top view.
Figure 9:
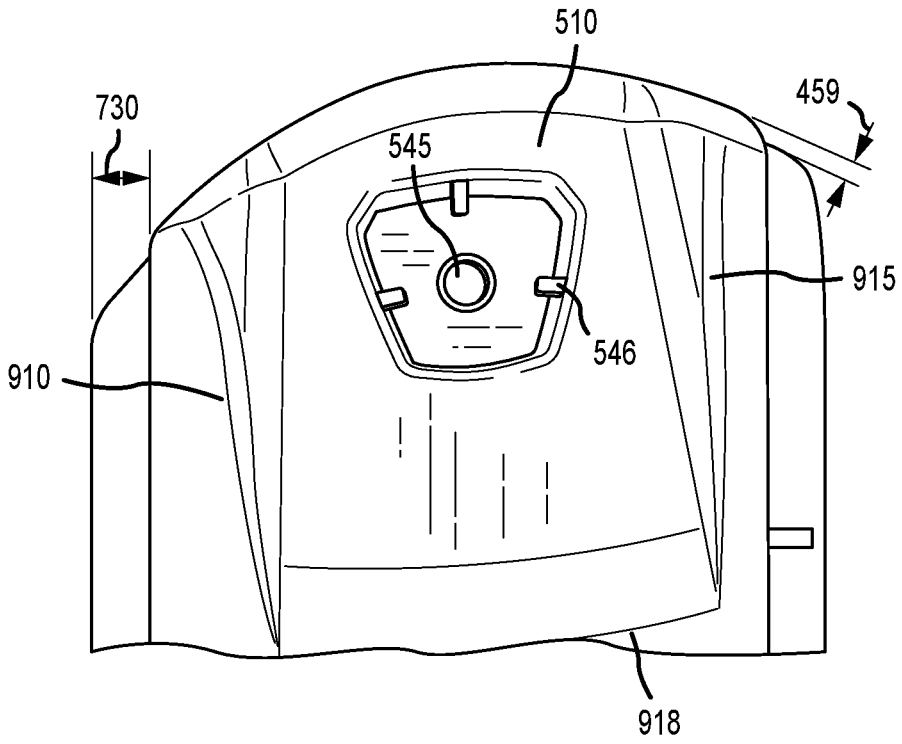
FIG. 9 illustrates a golf club head first component sole portion rear extension mass portion bottom view.
Figure 10:
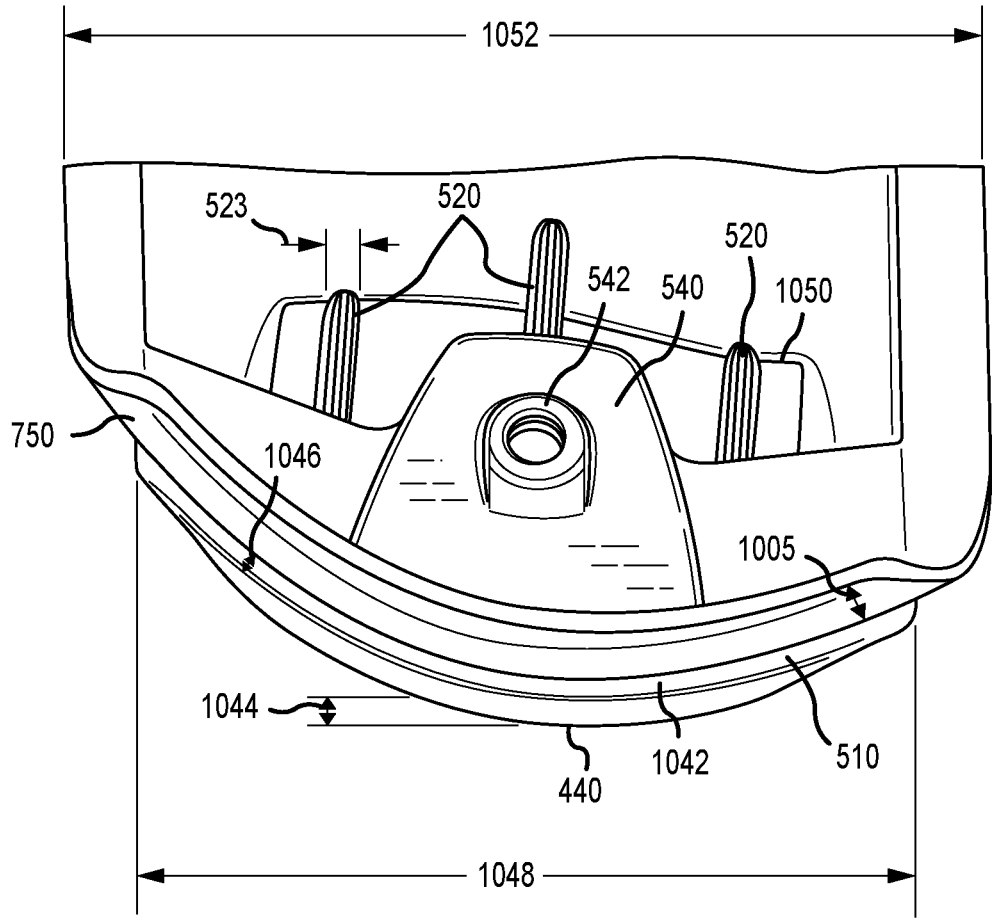
FIG. 10 illustrates a golf club head first component sole portion rear extension mass portion close rear view.

The first component lip (450) is recessed from an outer surface of the golf club head (100) to accommodate the combined thickness of the overlapping lip of the second component (200), and any adhesive securing the two components together. Referring to FIGS. 5, 9, and 10, the first component (300) comprises a first component lip recessed offset (459), a first component sole portion lip (460), a first component sole portion rear extension (500), a first component sole portion rear extension mass portion (510) having a mass portion interior forward boundary (1050 which corresponds to the forward exterior boundary 918, shown in FIG. 9), one or more mass portion interior ribs (520), and a detachable weight recess (540) having a threaded fastener receiver boss (542). Referring also to FIG. 1F, a first component lip (455) is configured to be covered by a portion of the second component (200) when the first component (300) is coupled to the second component (200) to form the golf club (100). The first component (300) may preferably be coupled to the second component (200) with an adhesive placed between the overlapping surfaces of the first component and the second component.

Figure 7A:
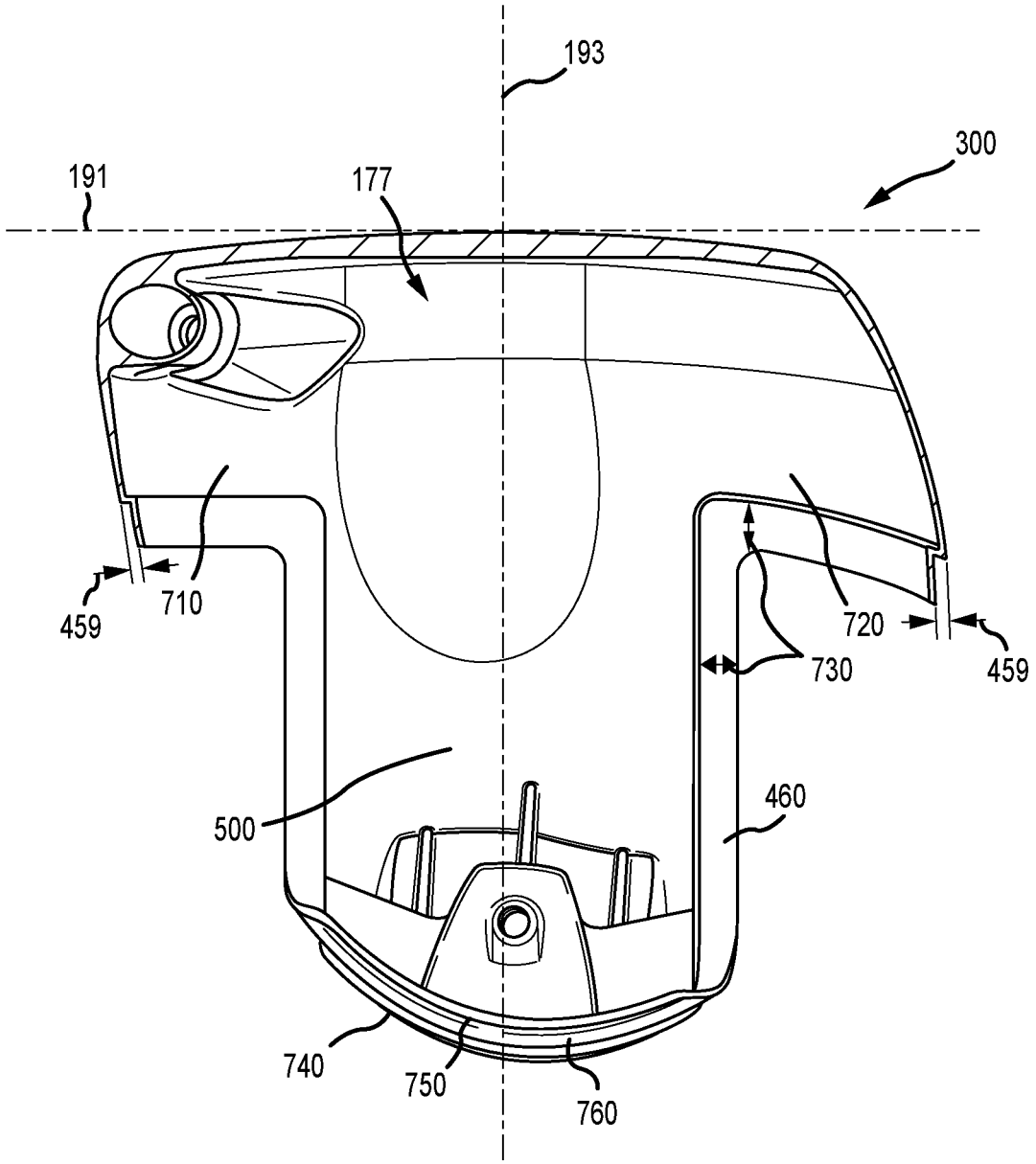
FIG. 7A illustrates a cross section of the first component of FIG. 6 along reference line 610 of FIG. 6.

Referring to FIG. 7A, the first component lip has a width (730), which can range from 0.125 inch to 0.275 inch. For example, the first component lip width (730) may be 0.125 inch, 0.150 inch, 0.175 inch, 0.200 inch, 0.022 inch, 0.225 inch, 0.250 inch, or 0.275 inch.

The first component recessed offset (459) is an offset distance of the lip (455) from the outer surface of the first component (300) toward the interior of the golf club head. The recessed offset (459) can range from 0.060 inch to 0.160 inch toward the interior of the golf club head (100). In other embodiments, the recessed offset (459) can range from 0.060 inch to 0.150 inch, 0.060 inch to 0.140 inch, 0.080 inch to 0.160 inch, 0.090 to 0.150 inch, or 0.090 inch to 0.160 inch. For example, the recessed offset (459) can be 0.060 inch, 0.070 inch, 0.080 inch, 0.090 inch, 0.100 inch, 0.110 inch, 0.120 inch, 0.130 inch, 0.140 inch, 0.150 inch, or 0.160 inch.

The first component lip (450) can comprise a thickness. The thickness of the first component lip (450) can range between 0.007 inch and 0.030 inch. In some embodiments, the thickness of the first component lip (450) can be between about 0.007 inch and 0.009 inch, 0.009 inch and 0.011 inch, 0.011 inch and 0.013 inch, 0.013 inch and 0.015 inch, 0.015 inch and 0.017 inch, 0.017 inch and 0.019 inch, 0.019 inch and 0.021 inch, 0.021 inch and 0.023 inch, 0.023 inch and 0.025 inch, 0.025 inch and 0.027 inch, or 0.027 inch and 0.030 inch.

Still referring to FIG. 5, the first component has a rear extension on the sole, which allows a larger portion of the mass of the assembled golf club head to be moved down to the sole and towards the rear of the assembled golf club head. The rear extension (500) extends from and is integral with the return portion (177), allowing impact stresses to propagate all the way to the rear of the sole, helping to balance the distribution of impact stress in the golf club head.

Still referring to FIG. 5, the first component lip (450) comprises the first component crown portion lip (455), the first component sole portion lip (460). The first component lip (450) may have other portions.

Figure 6:
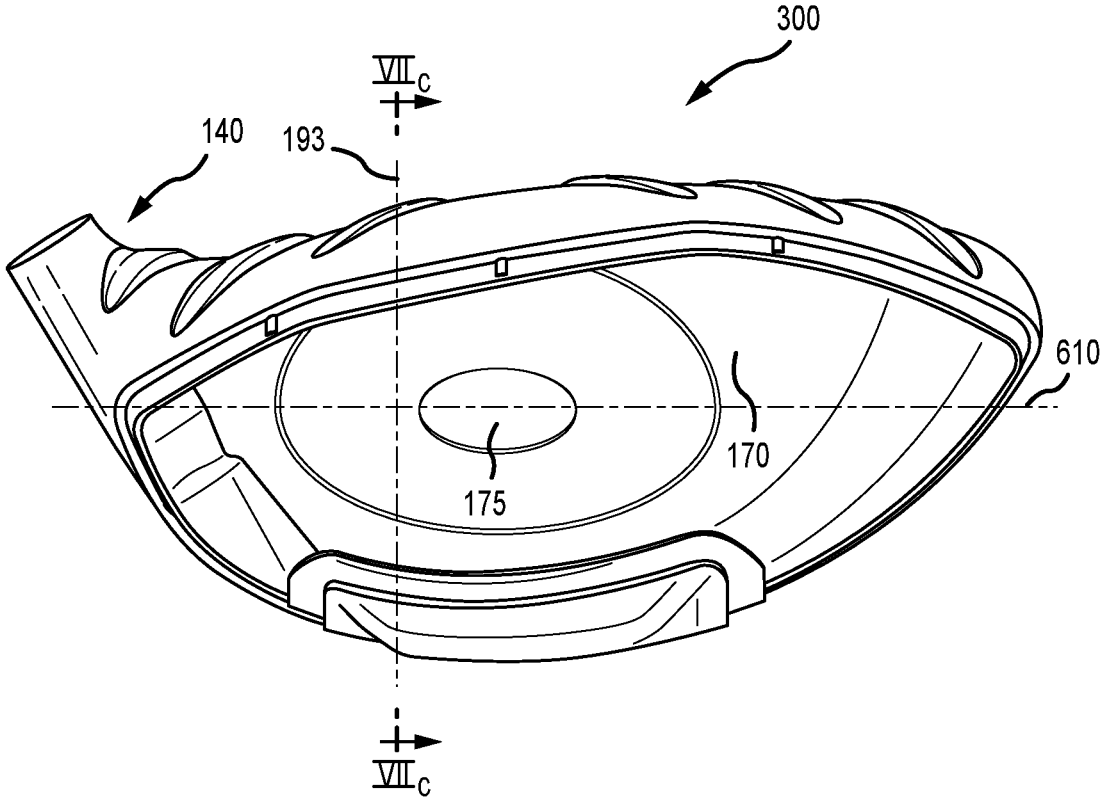
FIG. 6 illustrates a golf club head first component rear view showing a mid-plane through a strike face center parallel to the ground plane.
Figure 8:
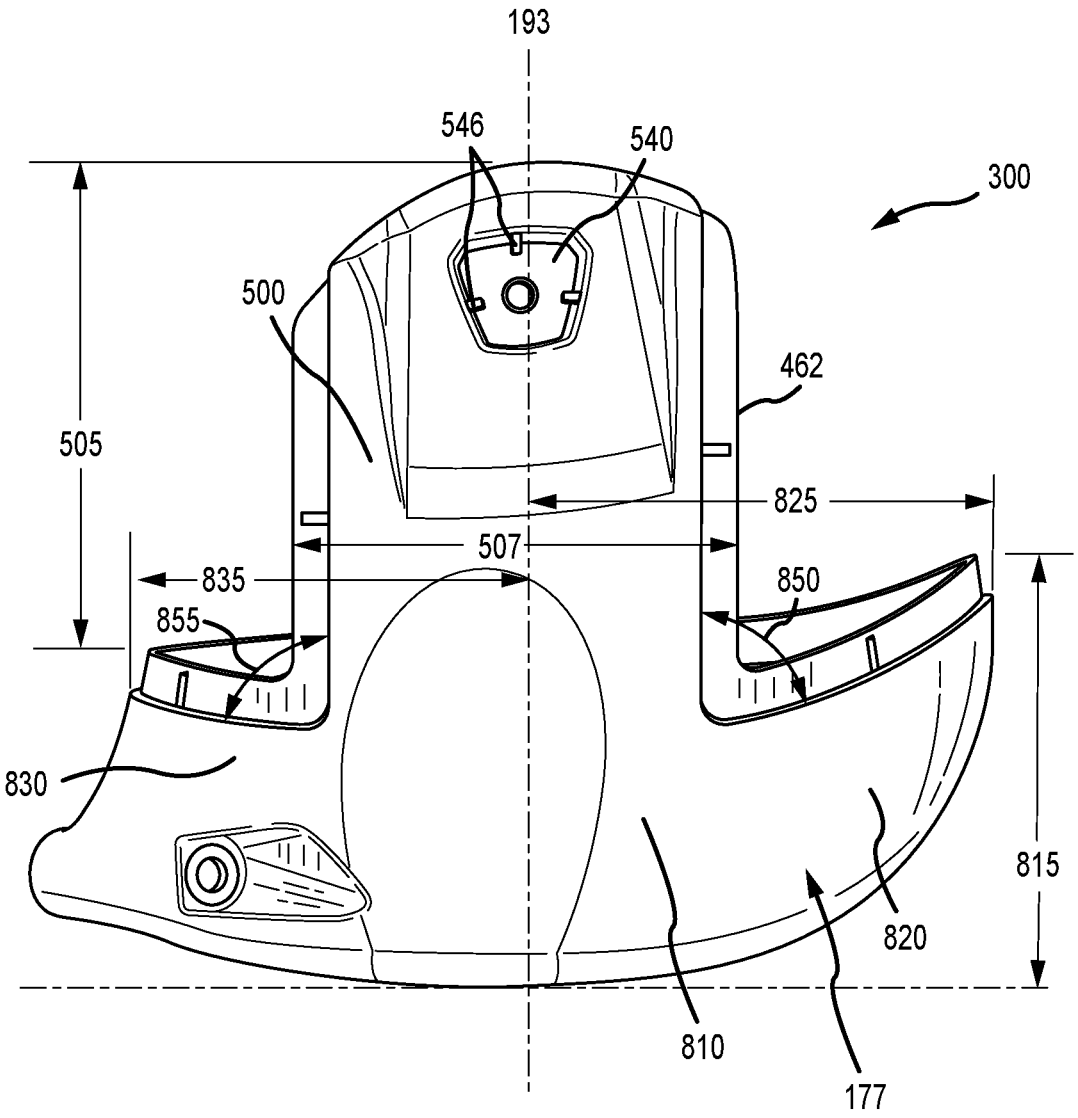
FIG. 8 illustrates a golf club head first component bottom view.

Referring to FIG. 6, a plane (610) parallel to the ground plane (105), and intersecting the strike face center (175) defines a view of the lower portion of the first component (300) as show in FIG. 7A. Referring to FIGS. 7A and 8, the rear extension (500) extends from a rear perimeter of a striking face return sole portion (810) toward the rear end (180) of the golf club head (100).

Referring to FIG. 7A, the first component (300) comprises a first component sole portion heel extension (710), a first component sole portion toe extension (720), a first component lip (460) having a first component lip width (730), a first component trailing edge portion (740), and a first component sole portion rear extension mass portion (510) having a vertical lip (750), and a mass portion trailing edge shelf (760).

The rear extension (500) has a larger mass at a rear most position of the extension. Placing the mass at the rear most position allows for the manipulation of the rear sole extension position to greatly affect the mass properties of the assembled golf club head. In some embodiments, referring to FIGS. 57-60, the first component rear extension (500) can comprise a sole aperture (555). The sole aperture functions to further move mass adjacent the rearmost end of the rear extension (500). As aforementioned, placing the mass at the rearmost end allows the CG to be moved rearward, thereby increasing the moment of inertia of the club head. By added a sole aperture (555), more discretionary mass will be created to place on the rearmost end of the rear extension (500).

Referring to FIG. 8, the first component (300) comprises a striking face return sole portion rear extension (500) having a first component sole portion rear extension length (505) and a first component sole portion rear extension width (507). The first component (300) comprises a striking face return sole portion (810), having a striking face return sole portion width (815), a first component sole portion toe extension (820) having a first component sole portion toe extension length (825), and a first component sole portion heel extension (830) having a first component sole portion heel extension length (835). The rear extension length (505) is measured from a rear perimeter of the striking face return sole portion (810), towards the rear end (180). The rear extension length (505) can range between 2.5 inches to 4.5 inches. The return sole portion width (815) is measured from the loft plane (198) rearwardly to a rear perimeter of the striking face return portion (177), which is a sole portion of a first component perimeter edge (462). The rear extension length (505) and the striking face return sole portion width (815) together comprise a total sole length of the golf club head (100) measured from the loft plane (198) to the rear end (180) along the sole (120). The rear extension width (507) is the width of the rear extension (500). The rear extension width (507) is measured in a heel to toe direction rearward of a rear perimeter of the striking face return sole portion (810), which is a sole portion of a first component perimeter edge (462). The rear extension width (507) is less than an entire width of the sole (120) of the golf club (100). The rear extension width (507) can range from 25% to 85% of an entire width of the sole (120). The rear extension width (507) may be 25%, 30%, 35%, 40%, 45%, 50%, 55%, 60%, 65%, 70%, 75%, 80% or 85% of an entire width of the sole (120). In some embodiments, the rear extension width (507) can range from 0.4 inch to 2.5 inches.

Referring to FIGS. 7A and 8, the first component sole portion rear extension (500), toe extension (720), and heel extension (710) together form a T-like structure. The first component sole portion rear extension (500) forms a toe-ward angle (850) with the toe extension (720), and a heel-ward angle (855) with the heel extension (710). The first component (300) further comprises a detachable weight recess (540) having a plurality of detachable weight recess tabs (546).

Referring to FIGS. 5, 7A, and 8, the striking face return (177) extends rearwardly from a striking face perimeter, essentially perpendicular to the striking face (170). The striking face (170) and striking face return (177) comprise a forward section of the assembled golf club head. The striking face return (177) comprises a striking face return crown portion (400) having a striking face return crown portion width (405), and a return sole portion (810) having a striking face return sole portion width (815). The striking face return crown portion (400) comprises a rearward perimeter that forms a profile on the crown (110) from the heel end (160) of the crown (110) to a toe end (150) of the crown (110). The striking face return crown portion width measured from the striking face (170) toward the rear end (180) may vary. The striking face return crown portion maximum width (405) may be located near the toe end (150) or the heel end (160). In other embodiments, the forward crown portion maximum width (405) may be located in a middle region between the toe end (150) and the heel end (160). The striking face return crown portion width (405) can be at least 0.8 inch, at least 1.0 inch, at least 1.2 inches, or at least 1.4 inches. In some embodiments, the striking face return crown portion maximum width (405) can range from 1.0 inch to 1.5 inches. For example, the striking face return crown portion maximum width (405) may be 1.0 inch, 1.1 inches, 1.2 inches, 1.3 inches, 1.4 inches, or 1.5 inches. The second component crown portion width (405) can be similar to the crown portion as described in U.S. application Ser. No. 11/693,490, now U.S. Pat. No. 7,601,078.

The striking face return (177) of the first component (300) can comprise a thickness extending between the outer surface and the inner surface of the striking face return (177). The thickness of the first component (300) can range from 0.015 inch to 0.040 inch. In other embodiments, the thickness of the first component (300) can range from 0.010 inch to 0.040 inch, 0.010 inch to 0.020 inch, 0.015 inch to 0.025 inch, 0.020 inch to 0.030 inch, 0.025 inch to 0.035 inch, 0.030 inch to 0.040 inch, 0.040 inch to 0.10 inch, or 0.10 inch to 0.25 inch. For example, the thickness of the first component (300) can be 0.010 inch, 0.015 inch, 0.020 inch, 0.025 inch, 0.030 inch, 0.035 inch, or 0.040 inch. In some embodiments, the thickness of the first component (300) can vary at the striking face (170), the return crown portion (400), the first component sole portion (310), the first component sole portion heel extension (710), the first component sole portion toe extension (720), and the first component sole portion rear extension mass portion (510).

Referring to FIG. 5, the crown portion turbulators (430) located on the return crown portion (400) are protrusions that affect the aerodynamics of the golf club head (100). In some embodiments, the return crown portion (400) can comprise indentations on its inner surface that correspond to the crown portion turbulators (430), giving the turbulators (430) the same thickness (wall thickness, measured between the inner and outer surfaces) as the remainder of the return crown portion (400). However, in other embodiments, one or more of the crown portion turbulators (430) can be filled to give it a thickness greater than the remainder of the return crown portion (400). The increased thickness of the return crown portion (400) at the one or more filled turbulators can increase the durability of the golf club head (100) by increasing the rigidity of at least a section of the return crown portion (400).

Figure 7B:
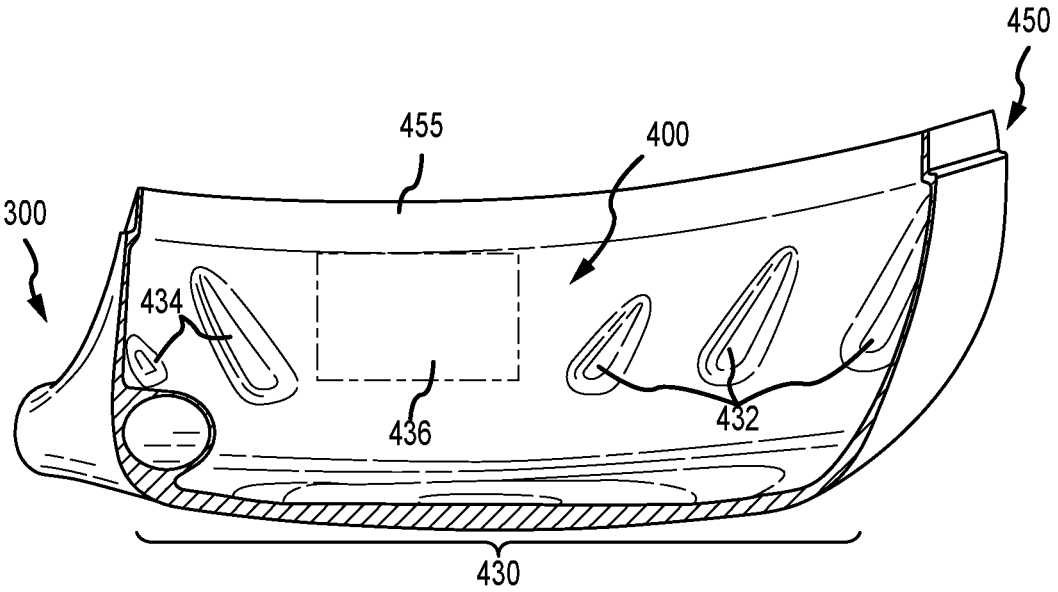
FIG. 7B illustrates a cross section of the first component of FIG. 6 along reference line $VII_A$-$VII_A$ of FIG. 6.
Figure 7C:
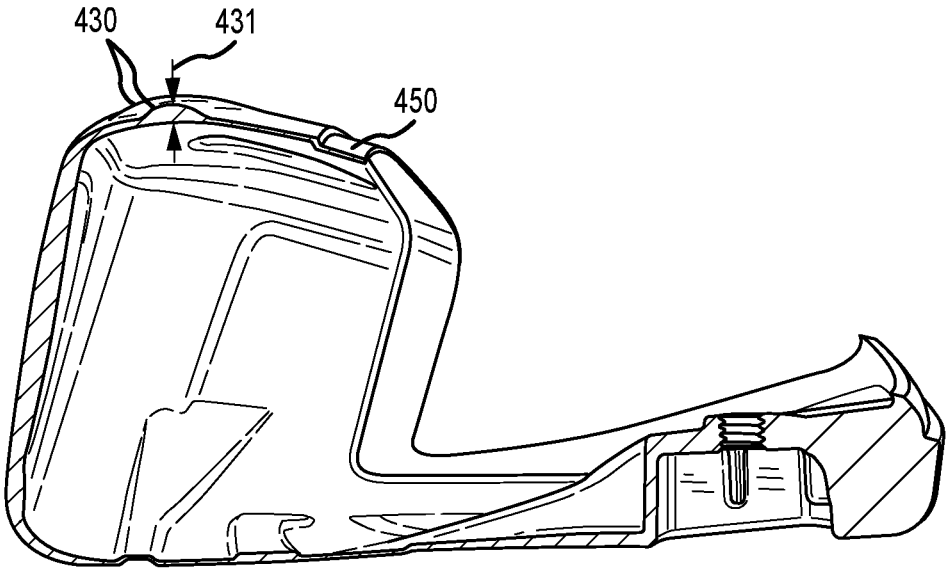
FIG. 7C illustrates a cross section of the golf club first component of FIG. 6 along reference line $VII_B$-$VII_B$ of FIG. 6.

Referring to FIGS. 5, 7B, and 7C, the crown portion turbulators (430) can be categorized as toe portion turbulators (432) and heel portion turbulators (434). In some embodiments, one or more of the crown portion turbulators (430) is filled with material (solid), such that there is no corresponding indentation on an inner surface of the return crown portion (400). In some embodiments, one or more of the toe portion turbulators (432) can be filled. In some embodiments, one or more of the heel portion turbulators (434) can be filled. A region of the crown return portion (400) with one or more filled turbulators can be stiffer or more rigid than regions of the crown return portion (400) that have unfilled turbulators. A solid turbulator comprises a thickness that is greater than the thickness of the remainder of the crown return portion (400).

Referring to FIGS. 7B and 7C, in some embodiments, a thickened region (436) of the crown return portion (400) comprises thicknesses greater than the thickness of the remainder of the crown return portion (400). In general, the crown return portion (400) can have the striking face return (177) thickness, described above. However, in some embodiments, the thickness of the return crown portion (400) can be increased within the thickened region (436) by up to 0.002 inch, up to 0.003 inch, up to 0.004 inch, up to 0.005 inch, up to 0.006 inch, up to 0.007 inch, up to 0.008 inch, up to 0.009 inch, or up to 0.010 inch. The thickened region (436) can be a patch, rectangular region, a bounded region, and/or a shape that at least partially encompasses one or more of the crown portion turbulators (430). In the embodiment shown in FIG. 7B, the bounded region encompasses two of the heel portion turbulators (434). The turbulators are filled (solid) within the bounded region (436). FIG. 7C illustrates a cross section showing a filled crown portion turbulator (430).

When a golf ball impacts the golf club (100), the first component (300), including the crown return portion (400), bends and flexes. This flexing of the crown return portion (400) of the first component (300) can induce stresses within the second component (200), which is bonded to the first component lip (450). The second component (200) can be put at risk of material failure if the crown return portion (400) of the first component (300) repeatedly flexes beyond a certain threshold. Adding a thickened region (436) can locally increase the cross-sectional area of the crown return portion (400) adjacent portions of the second component (200) that might be at risk of material failure after repeated impacts. Increasing the cross-sectional area of the crown return portion (400) at the thickened region (436) reduces the stress, thus increasing the durability of the club head (100).

Manipulating the position of the rear sole extension (500) provides a means of manipulating the mass properties of the assembled golf club head. Referring to FIGS. 4, 5, 7A, and 8, the sole portion of the first component can extend from a center near the striking face toward the toe end forming a first component sole portion toe end extension (720), toward the heel end forming a first component sole portion heel end extension (710), and toward the rear end forming a first component sole portion rear extension (500). The first component sole portion toe extension (720), the first component sole portion heel extension (710), and the first component sole portion rear extension (500) can form a "T" shaped profile. In some embodiments, the toe extension can have a first component sole portion toe end extension length (825) in a range of 1.50 inch to 2.00 inch from the YZ plane toward the toe end (150). For example, the first component sole portion toe extension (720) can have first component sole portion toe end extension length (825) of 1.50 inch, 1.60 inch, 1.70 inch, 1.80 inch, 1.90 inch, or 2.00 inch toward the toe end (150). In some embodiments, the first component sole portion heel end extension (710) can have a first component sole portion heel extension length (835) in a range of 0.90 inch to 1.40 inch from the YZ plane toward the heel end (160). For example, the first component sole portion heel end extension (710) can extend 0.90 inch, 1.10 inch, 1.20 inch, 1.30 inch, or 1.40 inch. The first component sole portion rear extension (500) can extend 2.30 inch to 2.90 inch rearward from the striking face return (177). For example, the first component sole portion rear extension (500) can extend from the striking face return (177) by a distance of 2.30 inch, 2.40 inch, 2.50 inch, 2.60 inch, 2.70 inch, 2.80 inch, or 2.90 inch.

Shifting the first component sole portion rear extension (500) (also simply called the "rear extension") closer to the toe end (150) or the heel end (160) of the golf club head (100) provides one means of manipulating the mass properties of the assembled golf club head, and changing the ball flight. When manufacturing the first component (300), moving the rear extension (500) toward the toe end (150) or toward the heel end (160) of the golf club (100) will change mass properties of the assembled golf club head. If the rear extension (500) is moved toward the toe end (150) by decreasing the first component sole portion toe end extension length (825) the center of gravity of the golf club head (100) will also be moved towards the toe end (150). If the first component sole portion rear extension (500) is moved toward the heel end (160) of the golf club head (100), the center of gravity of the golf club head (100) will also be moved towards the heel end (160).

The first component (300) comprises a surface area ranging from 27 $inch^2$ to 41 $inch^2$ out of the entire surface area of the golf club head (100). In some embodiments, the surface area of the first component (300) can range from 25 $inch^2$ to 43 $inch^2$, 25 $inch^2$ to 28 $inch^2$, 28 $inch^2$ to 31 $inch^2$, 31 $inch^2$ to 34 $inch^2$, 34 $inch^2$ to 37 $inch^2$, 37 $inch^2$ to 40 $inch^2$, or 40 $inch^2$ to 43 $inch^2$. For example, the 25 $inch^2$, 27 $inch^2$, 29 $inch^2$, 31 $inch^2$, 33 $inch^2$, 35 $inch^2$, 37 $inch^2$, 39 $inch^2$, 41 $inch^2$, or 43 $inch^2$.

The first component (300) can comprise a material such as steel, tungsten, aluminum, titanium, vanadium, chromium, cobalt, nickel, other metals, or metal alloys. In some embodiments, the first component (300) can comprise a Ti-8Al-1Mo-1V alloy. In many embodiments wherein the golf club head (100) is a driver-type club head, the first component (300) can comprise a titanium material. In many embodiments wherein the golf club head (100) is a fairway wood-type club head, the first component (300) can comprise a steel material.

In many embodiments, the first component (300) can be casted. In other embodiments, the first component (300) can be forged, pressed, rolled, extruded, machined, electroformed, 3-D printed, or any appropriate forming technique. Referring FIG. 15, in embodiments wherein the first component (300) is cast, the first component (300) may further comprise a plurality of casting support bars, including one or more heel end casting support bars (1510), and one or more toe end casting support bars (1512).

1) First Component Rear Sole Extension

As discussed above, the first component comprises the striking face and striking face return (177). These portions of the golf club head (100) receive and distribute the impact forces when the golf club strikes a ball. The rear extension (500) is integrally formed with the rest of the first component (300), and extends from the striking face return sole portion (810). Further, the mass of the rear extension (500), resists torquing forces caused by off center hits on the striking face. In many embodiments, the first component sole portion toe end extension (720), and the first component sole portion heel end extension (710) can be parallel with the striking face (170), comprising a constant width from front to back. In other embodiments, the toe end extension (720), and heel end extension (710) can increase and/or decrease in width from toward the toe end (150) and heel end (160), comprising a varying width. In some embodiments, the first component sole portion toe (720) and heel end (710) extensions can comprise a width ranging from 1.0 inch to 1.5 inches. For example, the toe (720) and heel end (710) extensions can be 1.00 inch, 1.10 inches, 1.20 inches, 1.30 inches, 1.40 inches, or 1.50 inches.

In many embodiments, the first component sole portion rear extension (500) can increase in width, decrease in width, and/or comprise a consistent width (507) from a rear boundary of the striking face return sole portion (810) toward the rear end (180). In some embodiments, the rear end extension (500) can comprise a width (507) ranging from 1.0 inch to 3.5 inches. For example, the rear end extension can be 1.0 inch, 1.25 inches, 1.50 inches, 1.75 inches, 2.00 inches, 2.25 inches, 2.50 inches, 2.75 inches, 3.0 inches, 3.25 inches, or 3.50 inches. In some embodiments, the rear extension (500) comprises a varying width in a front to rear direction. Specifically, the rear extension (500) can comprise a width that increases in a front to rear direction. In these embodiments, the width of the rear extension (500) has a minimum value adjacent the striking face return sole portion (810), an a maximum value adjacent the rear of the club head. Increasing the width of the rear extension (500) towards the rear of the club head allows the rear extension (500) to support a weight or weight system. Varying the width of the rear extension (500), so that the minimum width is adjacent the striking face return sole portion (810), reduces mass adjacent the face return and allows this saved weight to be redistributed to the perimeter of the club head. In other embodiments, the rear extension (500) can comprise a width that decreasing in a front to rear direction. Decreasing the width of the rear extension towards the rear of the club head can provide additional structural support for the weight or weight systems attached to the rear extension (500).

Figure 2:
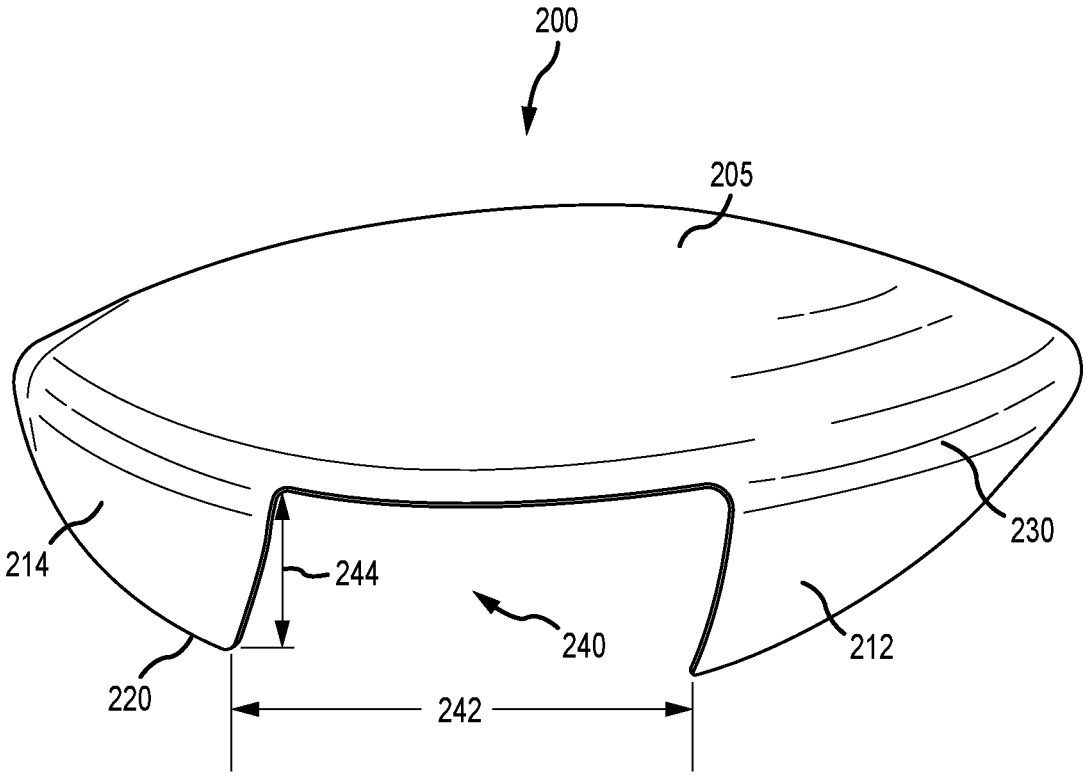
FIG. 2 illustrates a golf club head second component rear exterior view.

In some embodiments as illustrated in FIG. 2, the first component sole portion rear extension (500) can extend in a perpendicular orientation relative to the striking face (170), centered between the toe end (150) and the heel end (160). In other embodiments, the rear extension (500) can extend in an orientation closer to the toe end (150), or closer to the heel end (160). The rear extension (500) can be offset towards the heel end (160) from 0.05 inch to 1.0 inch. For example, the rear extension (500) can be offset towards the heel end (160) 0.1 inch, 0.2 inch, 0.3 inch, 0.4 inch, 0.5 inch, 0.6 inch, 0.7 inch, 0.8 inch, 0.9 inch, or 1.0 inch. The first component sole portion rear end extension (500) can be offset towards the toe end (150) from 0.05 inch to 1.0 inch. For example, the rear extension (500) can be offset towards the toe end (160) 0.1 inch, 0.2 inch, 0.3 inch, 0.4 inch, 0.5 inch, 0.6 inch, 0.7 inch, 0.8 inch, 0.9 inch, or 1.0 inch.

If the first component sole portion rear end extension (500) is offset towards the toe end (150), the center of gravity of the golf club head (100) can be offset towards the toe end (150) up to 0.150 inch, when compared to a similar golf club head with the sole portion rear end extension (500) being centered. For example, the center of gravity may be offset towards the toe end (150) 0.010 inch, 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, or 0.150 inch. If the first component sole portion rear end extension (500) is offset towards the heel end (160), the center of gravity of the golf club head (100) can be offset towards the heel end (160) up to 0.150 inch. For example, the center of gravity may be offset towards the heel end (160) 0.010 inch, 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, or 0.150 inch. The offset of the center of gravity can affect ball flight characteristics by biasing the golf club head towards a fade-counteracting position or a draw-counteracting position at impact.

Figure 31:
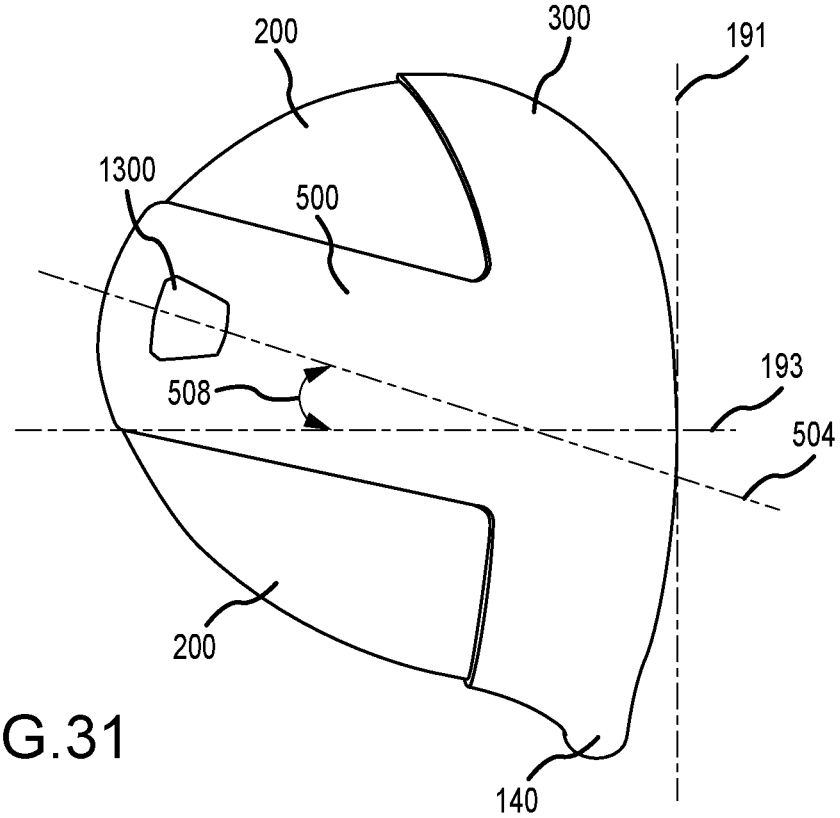
FIG. 31 illustrates a sole view of a golf club head having a toe-ward angled sole rear extension, according to an embodiment.
Figure 32:
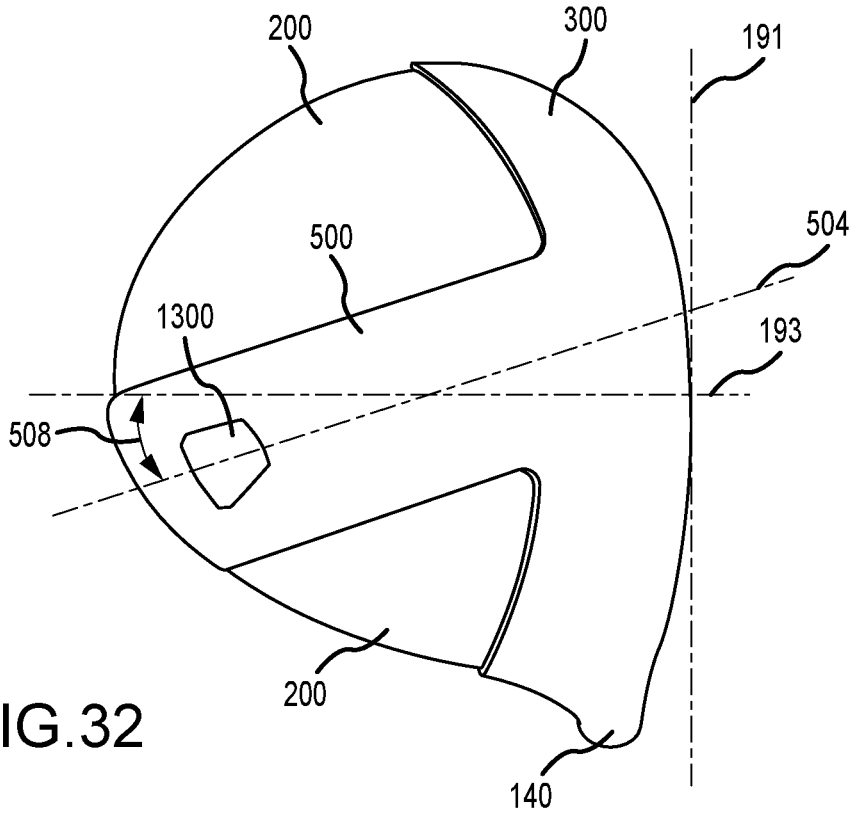
FIG. 32 illustrates a sole view of a golf club head having a heel-ward angled sole rear extension, according to an embodiment.
Figure 33:
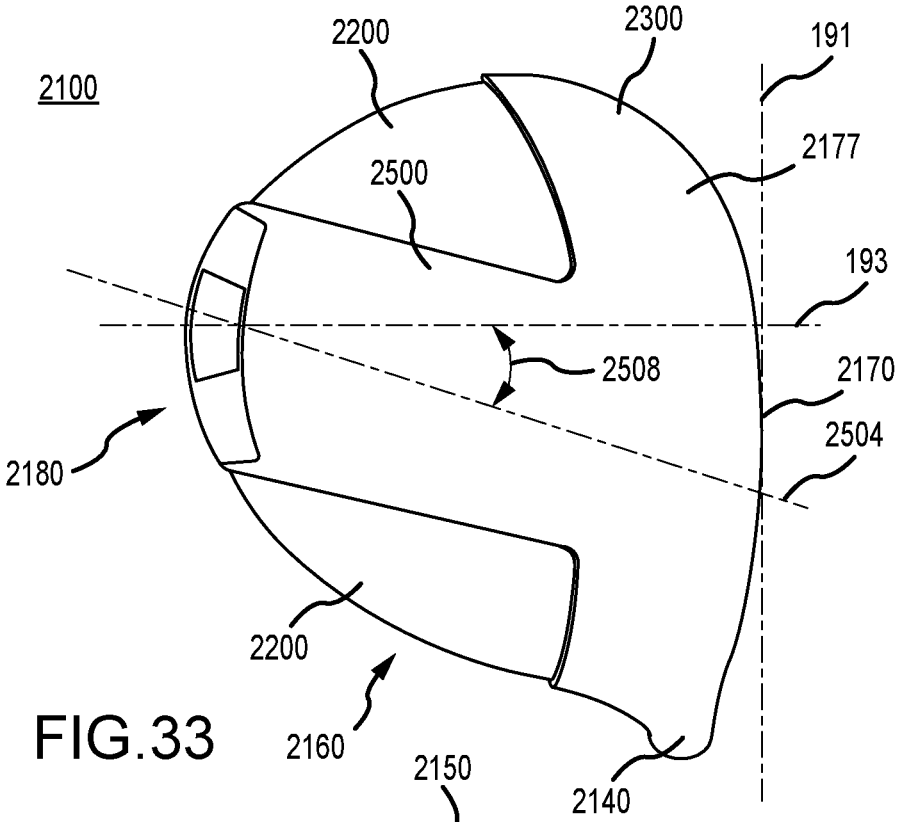
FIG. 33 illustrates a sole view of a golf club head with an angled sole rear extension, according to an embodiment.
Figure 34:
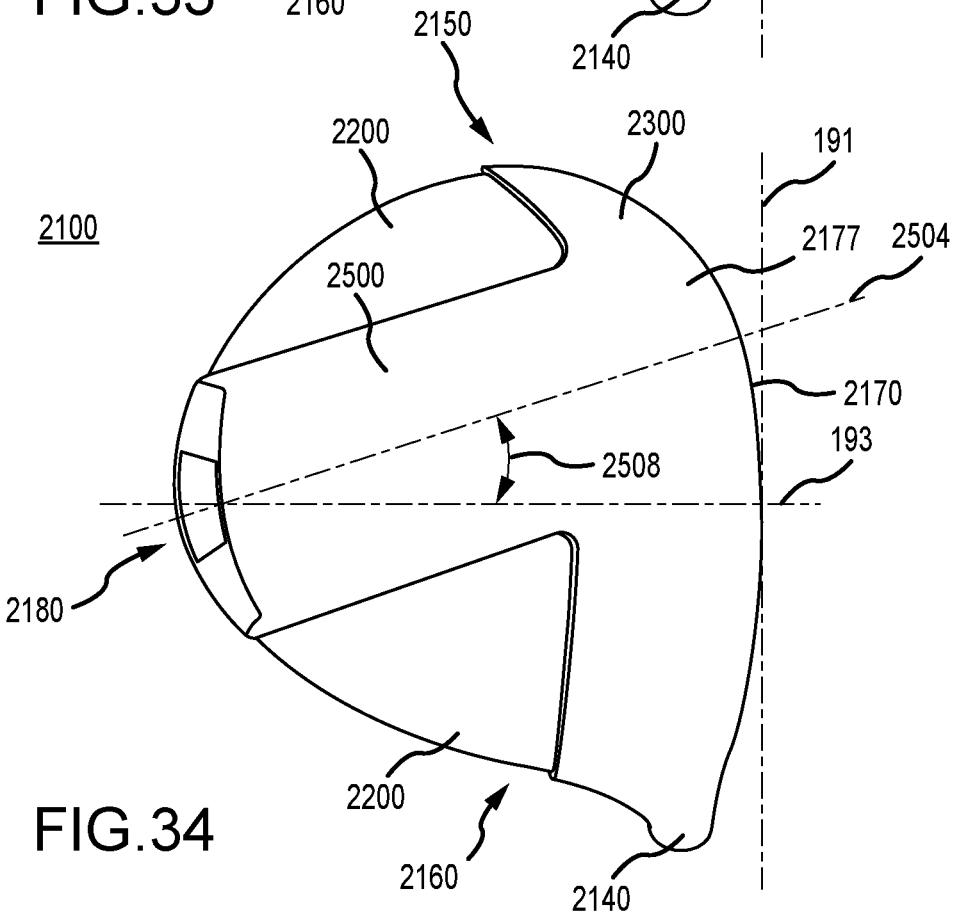
FIG. 34 illustrates a sole view of a golf club head with and angled sole rear extension, according to an embodiment.
Figure 35:
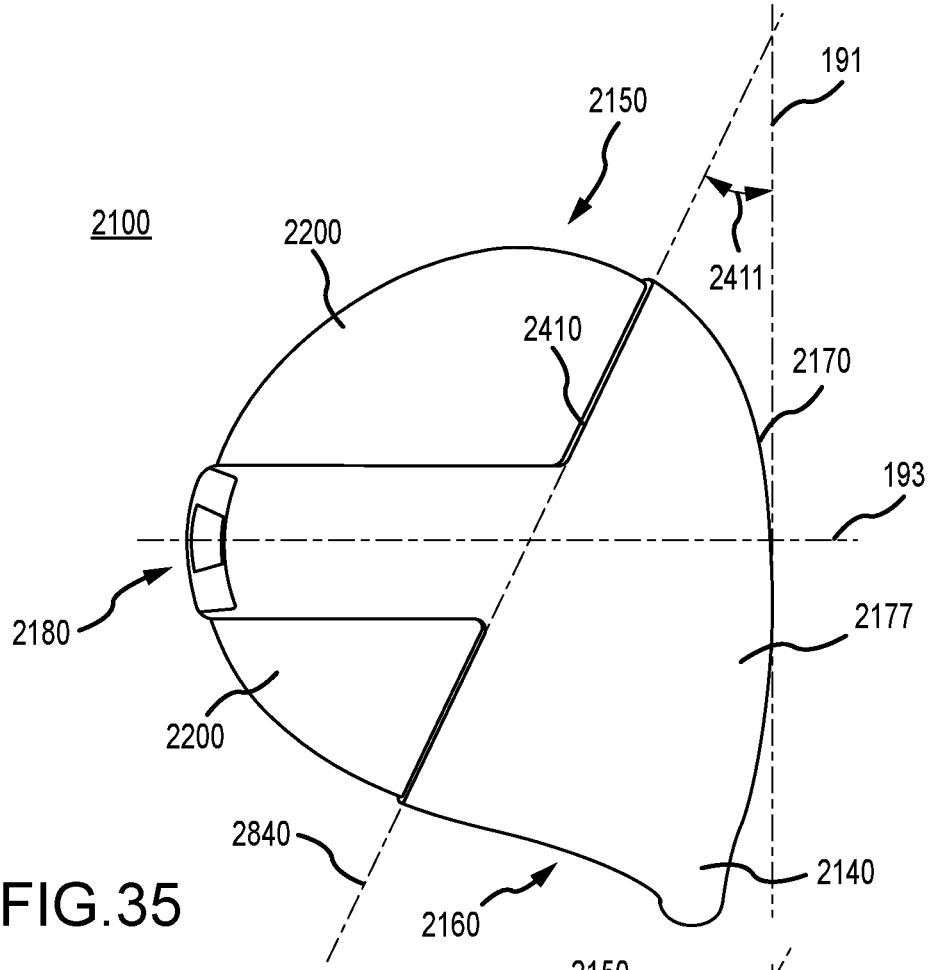
FIG. 35 illustrates a sole view of a golf club head with return portion having an angled rear edge, according to an embodiment.
Figure 36:
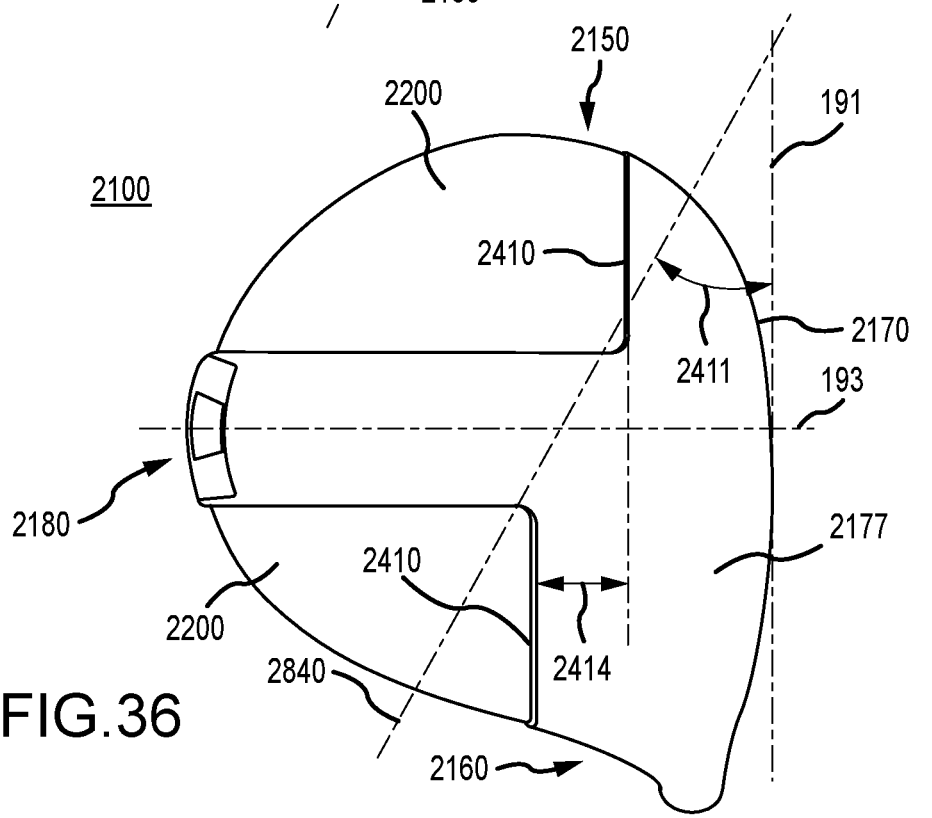
FIG. 36 illustrates a sole view of a golf club head with a return portion having an offset portion of a rear edge, according to an embodiment.

Referring to FIGS. 31 and 32, another means of manipulating the mass properties of the golf club head is to change the angle the rear sole extension relative to striking face of the first component. The first component sole rear extension can comprise a rear extension axis (504). The rear extension axis (504) can extend through a center of the sole extension, from a sole view. The rear extension axis (504) can be positioned so that, in a sole view, it is roughly equidistant from each side of the sole rear extension (500) at all points along the axis (504). The rear extension (500) itself can be positioned so that the rear extension axis intersects the YZ plane (193) at a rear extension angle (508), as illustrated in FIGS. 35 and 36. In some embodiments, the rear extension axis (504) can intersect the YZ plane (193) at a point adjacent a rear edge of the return portion (177). The rear extension angle (508) can range from 0 degrees to 45 degrees. In some embodiments, the rear extension angle (508) can range from 0 to 10 degrees, 0 to 20 degrees, 0 to 30 degrees, 0 to 40 degrees, 10 to 20 degrees, 10 to 30 degrees, 10 to 40 degrees, 10 to 45 degrees, 20 to 30 degrees, 20 to 40 degrees, 20 to 45 degrees, 30 to 40 degrees, or 30 to 45 degrees. FIGS. 25-28, 33, and 34 illustrate other embodiments with angled sole extensions, described below.

Adjusting the angle of the rear extension positions the detachable weight either heel-ward or toe-ward on the club head (100) because the weight is secured within a detachable weight recess (540). By angling the rear extension (500), the club (100) can be weighted to have a draw bias when the extension (500) is angled towards the heel of the club head (100). In other embodiments, angling the rear extension (500) towards the toe of the club head (100) gives the club head a fade bias.

Referring to FIG. 8, the angulation of the rear extension (500) can also be understood through angles between the edges of the sole rear extension (500) and the return portion (177). The first component sole portion rear extension toe-ward angle (850) and the first component sole portion rear extension heel-ward angle (855) are supplementary angles (i.e. the two angles add up to 180 degrees). In one embodiment, the toe-ward angle (850) and the heel-ward angle (855) are each 90 degrees, so the rear extension (500) is essentially perpendicular to the striking face (170). In alternate embodiments, the toe-ward angle (850) and the heel-ward angle (855) can each vary between 45 degrees and 135 degrees, as long as the two angles continue to be supplementary angles. For example, the toe-ward angle (850) can be 100 degrees, while the heel-ward angle (855) is the supplementary 80 degrees. In this example, the mass portion (510) is angularly offset towards the heel end (180) of the golf club head (100).

Other combinations of toe-ward angle (850) and heel-ward angle (855) may be 110 degrees and 70 degrees, 120 degrees and 60 degrees, 130 degrees and 50 degrees, or 135 degrees and 45 degrees. The center of gravity of the golf club head would be offset toward the rear mass portion (510) position. For example, the center of gravity may be offset towards the heel end (160) 0.010 inch, 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, or 0.150 inch. In a similar fashion, the toe-ward angle may decrease while the heel-ward angle increases. For example, the combination of toe-ward angle (850) and heel-ward angle may be 80 degrees and 100 degrees, 70 degrees and 110 degrees, 60 degrees and 120 degrees, 50 degrees and 130 degrees, or 45 degrees and 135 degrees. For example, the center of gravity may be offset towards the toe end (160) by 0.010 inch, 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, or 0.150 inch. This angular offset may be desirable to place a rear mass more toward the rear, heel-ward portion or rear toe-ward portion to position a club head center of gravity in that direction to influence ball flight characteristics. Angular offsets in other embodiments may differently combine the first component sole portion rear extension toe-ward angle (850) and the first component sole portion rear extension heel-ward angle (855), which can produce different club head center of gravity positions and different ball flight characteristics.

2) First Component Rear Sole Extension Rear Mass

As discussed above, the first component comprises most of the mass of the assembled golf club head. The rear extension (500) allows for some of the golf club mass to be positioned away toward the rear of the club head, and in the sole of the club head. The rear extension (500) comprises a mass portion at the rear of the golf club head, allowing the mass there to further influence the CG and MOI of the golf club head. The first component sole portion rear extension mass portion (510) alone can comprise between 20% to 35% of the total mass of the golf club head (100). Placing this mass at the rear most portion of the rear extension (500) is an important aspect to controlling the mass properties of the golf club head (100) during manufacturing the first component (300).

Referring to FIG. 9, the first component sole portion rear extension mass portion (510) comprises a threaded receiver (545), one or more weight recess tabs (546), and the mass portion (510) having a heel side external boundary (910), a toe side external boundary (915), and a forward external boundary (918).

Referring to FIG. 10, the mass portion (510) further comprises a plurality of internal ribs (520) having an internal rib width (523). The plurality of internal ribs (520) may comprise two ribs, three ribs, four ribs, five ribs, or more than five ribs. The plurality of internal ribs (520) mate with, or attach to the interior surface of the rear extension mass portion detachable weight recess (540). The internal ribs (520) can reduce unwanted vibration at the mass portion (510), which is desirable because so much of the mass of the golf club head (100) is located so far to the rear of the golf club head. The mass portion (510) further comprises a vertical lip (750) having a vertical lip height (1150), a mass portion trailing edge shelf (1042) having a shelf length (1048), a shelf height (1044), and a shelf width (1046). The shelf length (1048) is approximately the same as a rear extension width (507), and varies as the width of the mass portion (510) varies.

The shelf (1042) provides a mating surface for a portion of the second component when the first and second components are coupled to form the assembled golf club head. The mass portion (510) further comprises an interior forward boundary (1050), and a vertical lip length (1052).

Figure 11:
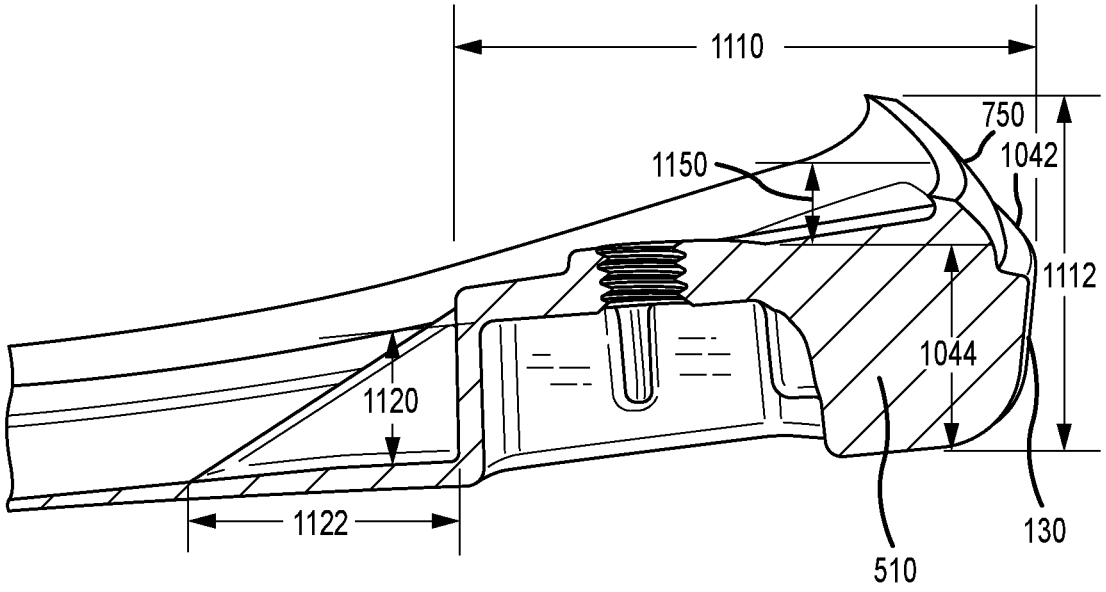
FIG. 11 illustrates a cross section of a golf club head first component sole portion rear extension mass portion.

Referring to FIG. 8, the view of the rear mass (510) is bisected by the YZ plane (193). As shown in FIG. 11, the mass portion comprises an internal length (1110), a mass portion maximum height (1112), and a vertical lip height (1150). The internal ribs further comprise a rib height (1120) and a rib length (1122).

The internal rib width (523) can range from 0.025 inch to 0.100 inch. For example, the internal rib width (523) may be 0.025 inch, 0.050 inch, 0.075 inch, or 0.100 inch. The internal rib height (1120) ranges from 25% to 100% of a detachable weight recess depth (1216). The internal rib length (1122) can range from 0.100 inch to 1.500 inch. For example, the internal rib length (1122) may be 0.100 inch, 0.200 inch, 0.300 inch, 0.400 inch, 0.500 inch, 0.600 inch, 0.700 inch, 0.800 inch, 0.900 inch, 1.000 inch, 1.100 inches, 1.200 inches, 1.300 inches, 1.400 inches, or 1.500 inches.

The mass portion (510) has a mass portion maximum height (1112) located approximately along the most upper portion of the mass portion vertical lip (750). The mass portion (510) decreases in thickness as it approaches the heel side external boundary (910), the toe side external boundary (915), and the forward external boundary (918). The mass portion maximum height (1112) comprises the maximum thickness of the mass portion (510). The maximum thickness of the mass portion (510) can range from 0.40 inch to 0.70 inch. For example, the maximum thickness of the mass portion (510) may be 0.40 inch, 0.50 inch, 0.60 inch, or 0.70 inch.

3) First Component Detachable and Embedded Weights

To allow further control of the mass properties of the assembled golf club head, a detachable weight recess and a detachable weight are provided, wherein the detachable weight mass can fine tune the mass properties of the golf club head at the point of assembly. The detachable weight recess (540) further comprises a plurality of detachable weight recess tabs. The plurality of detachable weight recess tabs may be two tabs, three tabs, four tabs, five tabs, or more than five tabs.

Figure 12:
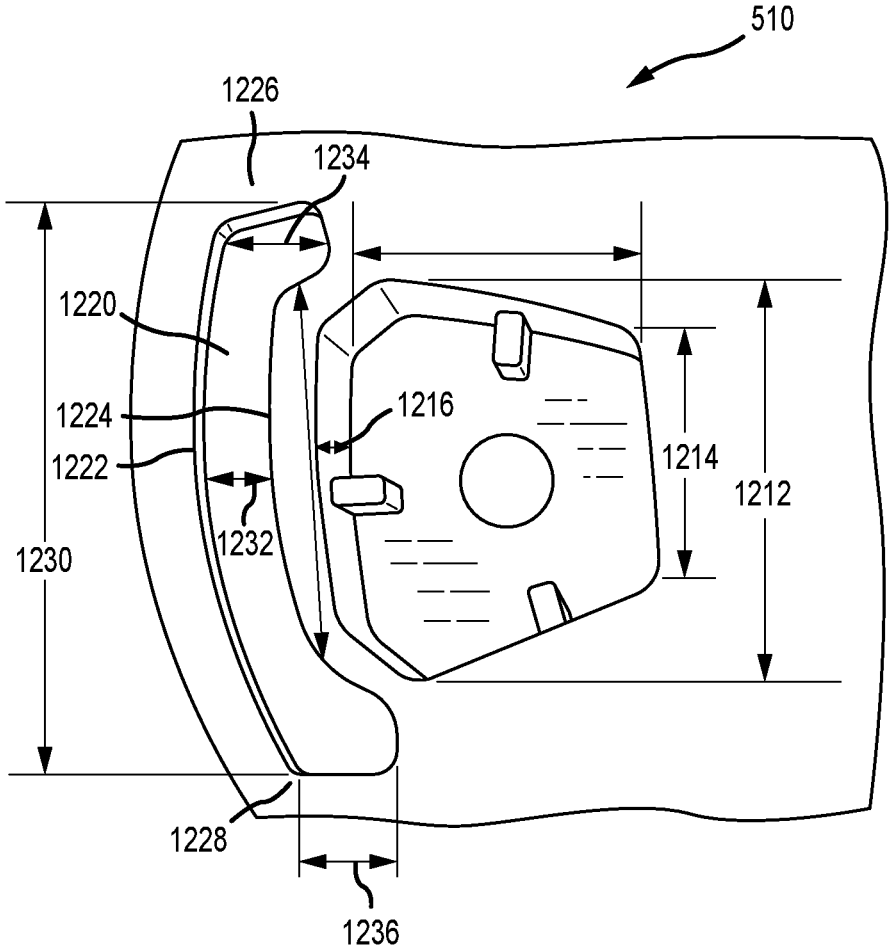
FIG. 12 illustrates a golf club head first component sole portion rear extension mass portion with a detachable weight recess and an embedded weight recess.

Referring to FIG. 12, it may be desirable to further increase the mass placed in the rear most portion of the golf club head. The mass portion (510) may further comprises an embedded weight recess (1220). Therefore, an embedded weight recess (1220) and an embedded weight (1600) (configured to be received with the embedded weight recess (1220)) comprising an embedded weight material having a density that is higher than the first density of the first component (300) first material may be provided.

Figure 13:
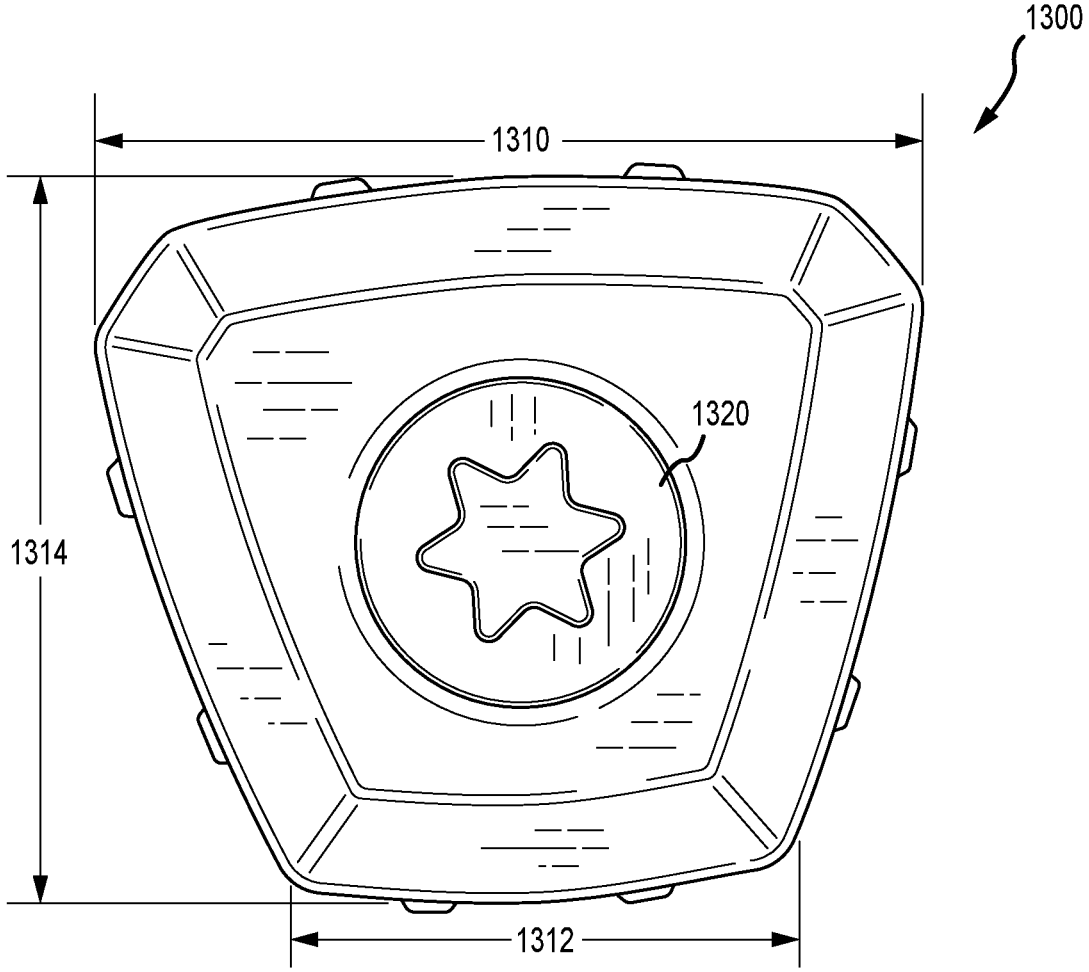
FIG. 13 illustrates a top view of a detachable weight with a threaded fastener.

Referring to FIG. 13, the detachable weight (1300) can comprise a material such as steel, tungsten, aluminum, titanium, vanadium, chromium, cobalt, nickel, other metals, metal alloys, composite polymer materials or any combination thereof. In many embodiments, the sole weight can be tungsten. The detachable weight (1300) has a mass.

The detachable weight (1300) mass can range from 1.0 gram to 35.0 grams. For example, the detachable weight (1300) mass may be 1.0 gram, 1.5 grams, 2.0 grams, 3.0 grams, 4.0 grams, 5.0 grams, 6.0 grams, 7.0 grams, 8.0 grams, 9.0 grams, 10.0 grams, 11.0 grams, 12.0 grams, 13.0 grams, 14.0 grams, 15.0 grams, 16.0 grams, 17.0 grams, 18.0 grams, 19.0 grams, 20.0 grams, 21 grams, 22 grams, 23, grams, 24, grams, 25 grams, 26 grams, 27 grams, 28 grams, 29, grams, 30 grams, 31 grams, 32 grams, 33 grams, 34 grams, or 35 grams.

Referring to FIGS. 8 and 13, the detachable weight (1300) is configured to be received within the detachable weight recess (540). The detachable weight (1300) further comprises a through hole approximately in the center of the detachable weight (1300). The through hole is configured to receive a detachable weight threaded fastener (1320), allowing the threaded fastener (1320) to be threadably received in the threaded receiver boss (542) to secure the detachable weight (1300) into the detachable weight recess (540).

Figure 14:
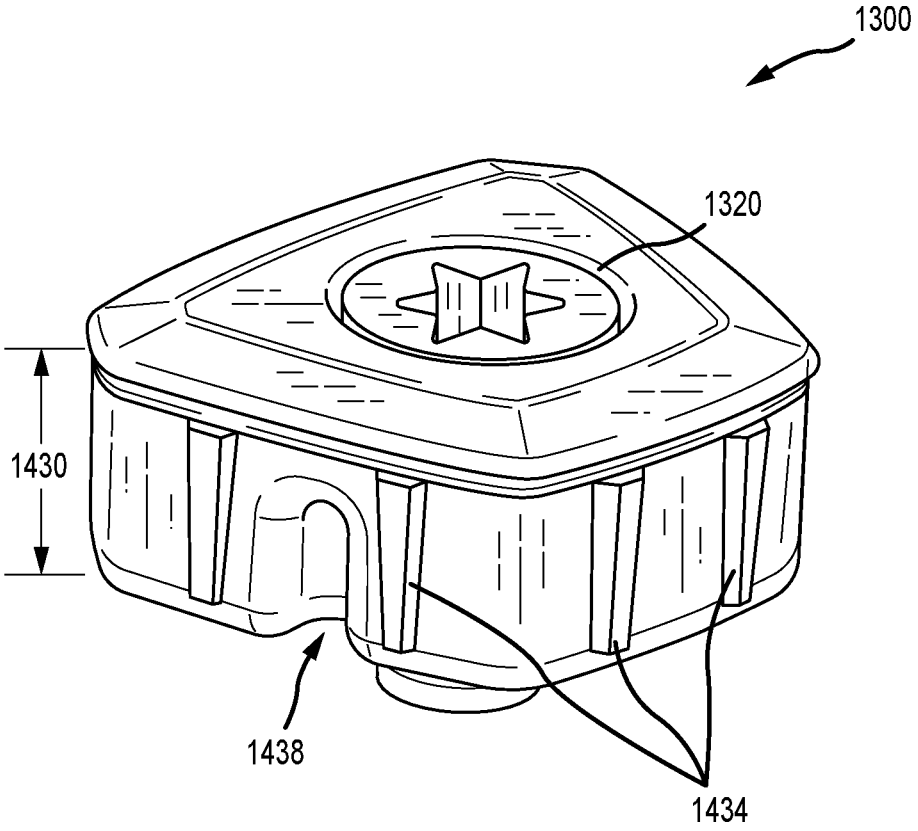
FIG. 14 illustrates side perspective view of a detachable weight with a threaded fastener.

Referring to FIG. 14, the detachable weight (1300) further comprises a thickness (1430), a plurality of detachable weight offsets (1434), and a plurality of detachable weight side grooves (1438). The plurality of detachable weight offsets (1434) may be two offsets, three offsets, four offsets, five offsets, or more than five offsets. The plurality of detachable weight side grooves (1438) may be two grooves, three grooves, four grooves, five grooves, or more than five grooves. The offsets (1434) are configured to cause the detachable weight (1300) to be slightly offset from the walls of the detachable weight recess (540) when the detachable weight (1300) is received within the detachable weight recess (540). The detachable weight side grooves (1438) are configured to receive the detachable weight recess tabs when the detachable weight (1300) is received within the detachable weight recess (540).

Figure 16A:
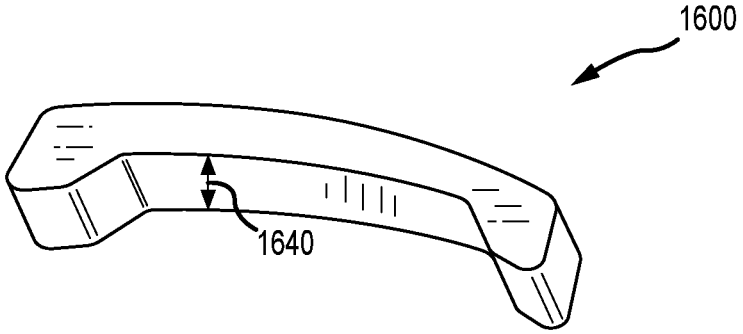
FIG. 16A illustrates a side view of an embedded weight for fitting in the embedded weight recess of FIG. 12.
Figure 16B:
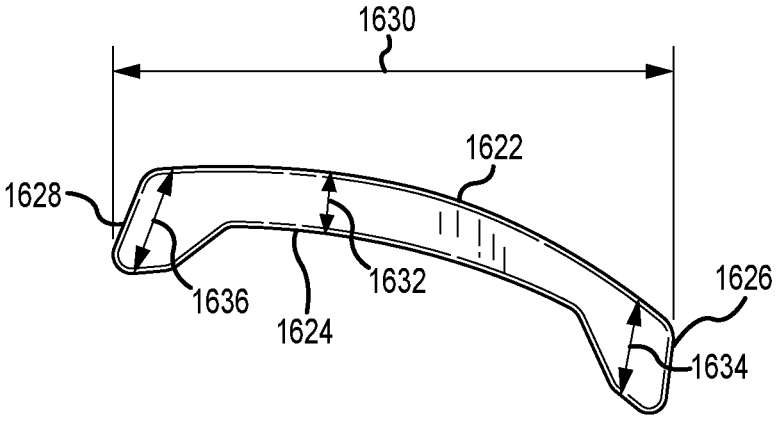
FIG. 16B illustrated a top view of an embedded weight.

Referring to FIGS. 16A and 16B, an embedded weight (1600) has a mass. The embedded weight (1600) mass can range from 1.0 gram to 20.0 grams. For example, the embedded weight (1600) mass may be 1.0 gram, 2.0 grams, 3.0 grams, 4.0 grams, 5.0 grams, 6.0 grams, 7.0 grams, 8.0 grams, 9.0 grams, 10.0 grams, 11.0 grams, 12.0 grams, 13.0 grams, 14.0 grams, 15.0 grams, 16.0 grams, 17.0 grams, 18.0 grams, 19.0 grams, or 20.0 grams.

The embedded weight (1600) comprises a tungsten material, a tungsten alloy material, a polymer matrix embedded with tungsten particles, or any other suitable material having a density greater than the first material density. The embedded weight (1600) is configured to fit within and be permanently affixed in the embedded weight recess (1220). The embedded weight (1600) may be permanently affixed using an adhesive, by swedging or other press fit methods, or by using an appropriate mechanical attachment means.

B) Second Component

Figure 3A:
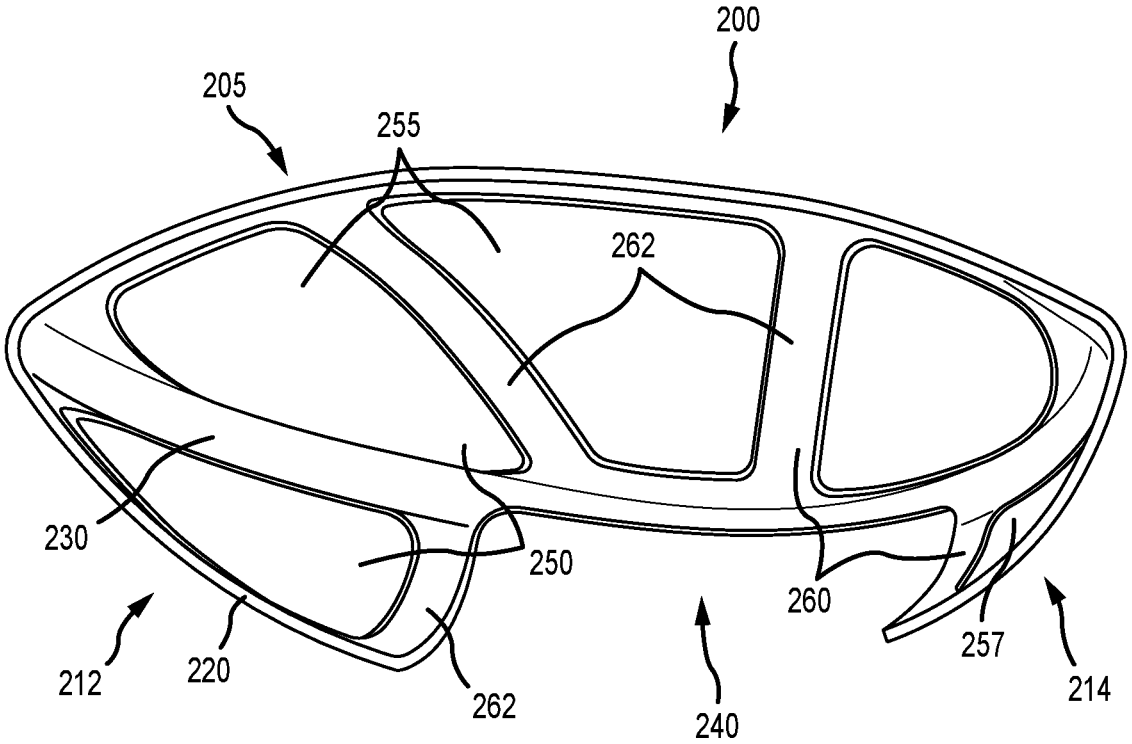
FIG. 3A illustrates a golf club head second component front interior view.

The golf club head (100) comprises a first component (300) and a non-metallic, lightweight second component (200) configured to be coupled together to form the hollow golf club head (100). As illustrated in FIGS. 1F, 2 and 3, the second component (200) can comprise at least a portion of the crown (110), the sole (120), the trailing edge (130), and a rear cutout (240). Referring specifically to FIGS. 1F and 2, the second component (200) comprises a second component crown portion (205), a second component sole portion heel portion (214), a second component sole portion toe portion (212), a second component perimeter edge (220), a second component sole portion rear cutout (240) having a second component sole portion rear cutout width (242) and a second component sole portion rear cutout height (244), and a second component trailing edge portion (230). In some embodiments, not shown, the second component can comprise only a portion of the crown. In these embodiments, the sole portion rear cutout (240) can wrap around into the crown (205).

As illustrated in FIGS. 1-4, the second component crown portion (205) wraps over the trailing edge (130), integrally forming the portions of the sole complementary to the first component. The second component heel and toe sole portions (214) (212) formed by the second component (200) can comprise a triangular shape positioned between the toe end extension and rear end extension, and rear end extension and heel end extension of the first component. In other embodiments, the sole portions formed by the second component (200) can comprise a circular shape, square shape, oval shape, any other polygonal shape, or a shape with at least one curved surface, complementary to the sole portions of the first component (100). The second component (200) may comprise a single monolithic piece, entirely formed together with no further joining necessary. For example, the second component (200) can be formed by injection molding a single monolithic piece comprising a single material.

Alternately, the second component (200) may comprise a plurality of separately formed portions, which may be subsequently permanently joined by adhesives, sonic welding, fusion bonding, or other permanent joining methodologies appropriate to the materials used in forming the plurality of separately formed portions. For example, the second component crown portion (205), toe portion (212), and heel portion (214) may be formed separately from the same or different materials. The second component portions may then be adhesively joined to form the complete second component (200). Such forming of separate portions later joined may be advantageous when using materials such as bi-directional carbon fiber prepreg materials. Bi-directional carbon fiber prepreg does not easily accommodate certain small curvatures, and cannot be easily formed in a single piece to arrive at the desired second component (200) geometry. Using such a material may produce a need to form separate sole portions (212) and (214), which are later joined by adhesives or other methods to the rest of the second component (200).

Alternately, multiple second component portions may be separately attached to the first component, without having been attached to one another.

The second component of the golf club head (100) can comprise a thickness. The thickness of the second component can range from 0.030 inch to 0.500 inch. In some embodiments, the thickness of the second component can range from 0.030 inch to 0.040 inch, or 0.030 inch to 0.045 inch, or 0.030 inch to 0.055 inch, or 0.045 inch to 0.055 inch, 0.045 inch to 0.65 inch, 0.050 inch to 0.060 inch, 0.055 inch to 0.065 inch, 0.060 inch to 0.070 inch, 0.065 inch to 0.075 inch, 0.070 inch to 0.080 inch, 0.075 inch to 0.085 inch, 0.080 inch to 0.090 inch, 0.085 inch to 0.095 inch, 0.080 inch to 0.090 inch, 0.085 inch to 0.095 inch, 0.090 inch to 0.100 inch, 0.100 inch to 0.200 inch, 0.200 inch to 0.300 inch, 0.300 inch to 0.400 inch, or 0.400 inch to 0.500 inch. For example, the thickness of the second component can be 0.008 inch, 0.010 inch, 0.015 inch, 0.020 inch, 0.025 inch, 0.030 inch, 0.035 inch, 0.040 inch, 0.045 inch, 0.050 inch, 0.055 inch, 0.060 inch, or 0.065 inch. The thickness of the second component can further vary from the crown, the sole, the heel end, the toe end, and the trailing edge. For example, in a single embodiment, the thickness of the second component may differ across the crown, sole, heel end, toe end, and trailing edge portions of the second component.

In some embodiments, the second component further comprises internal ribs or an internal thicked section. As used herein, when referring to internal ribs or an internal thickened section, the present disclosure is intending to refer to a portion of the club body that has a varying internal surface contour which presents a thickness (measured normal to the outer surface of the component) that is comparatively thicker than a second, non-thickened area of the component. In each instance, the term "internal" is intended to mean that the feature not readily perceivable from the outside of the club head. Said another way, the outer surface maintains a plain or substantially plain contour across the feature and adjacent structure.

Internal ribs or internal thickened sections may provide additional strength and/or stiffness to the club head through various mechanisms. First, the thickened ribs/sections may act as a strut/gusset that provides a structural framework for the component. In this manner, the design of the structure itself can promote strength. Additionally, the presence of the thickened section may be used during molding to assist in controlling the direction, speed, and uniformity of the polymer flow. In doing so, the orientation of embedded fibers may be controlled so that any anisotropic parameters of the material, itself, are oriented to support the club head's intended purpose. In this sense, the thicked sections can provide both an engineered structure and an engineered material. Finally, in some embodiments, the first component may include a buttressing feature, such as an upstanding strut that is configured to be affixed to the second component. In such a design, the thickened sections may provide a suitable coupling location as the thickened material may distribute any transmitted loads without the risk of fatiguing or fracturing the comparatively thinner sections.

In some embodiments, such as the embodiment of FIG. 3, the second component (200) further comprises a plurality of second component reduced thickness sections (250) having one or more crown portion reduced thickness sections (255) and one or more sole portion reduced thickness sections (257). The second component (200) further comprises a plurality of second component internal ribs (260) having one or more crown portion internal ribs (262) and one or more sole portion internal ribs (264). The plurality of internal ribs (260) may be two ribs, three ribs, four ribs, five ribs, or more than five ribs. The crown portion (262) and sole portion (264) internal ribs are between the second component reduced thickness sections (250). The crown portion (262) and sole portion (264) internal ribs may comprise the greatest thickness of the second component (200). In some embodiments, the second component internal ribs (260) can be similar to the ribs as described in U.S. application Ser. No. 15/076,511, now U.S. Pat. No. 9,700,768, which is hereby incorporated by reference in its entirety. The second component internal ribs (260) can reduce stress on the golf club head (100) and improve sound during an impact.

The plurality of second component reduced thickness sections (250) comprise a thickness. The thickness of the plurality of second component reduced thickness sections (250) can range from 0.008 inch to 0.035 inch. In other embodiments, the thickness of the reduced thickness sections (250) can range from 0.008 inch to 0.015 inch, 0.010 inch to 0.020 inch, 0.015 inch to 0.025 inch, 0.020 inch to 0.030 inch, or 0.025 inch to 0.035 inch. For example, the thickness of the reduced thickness sections (250) can be 0.008 inch, 0.010 inch, 0.015 inch, 0.020 inch, 0.025 inch, 0.030 inch, or 0.035 inch. The thickness of the internal ribs or thickened portions may be up to 0.010 inch thicker than other portions of the second component (200). In some embodiments, the second component is devoid of internal ribs and reduced thickness sections.

Figure 3B:
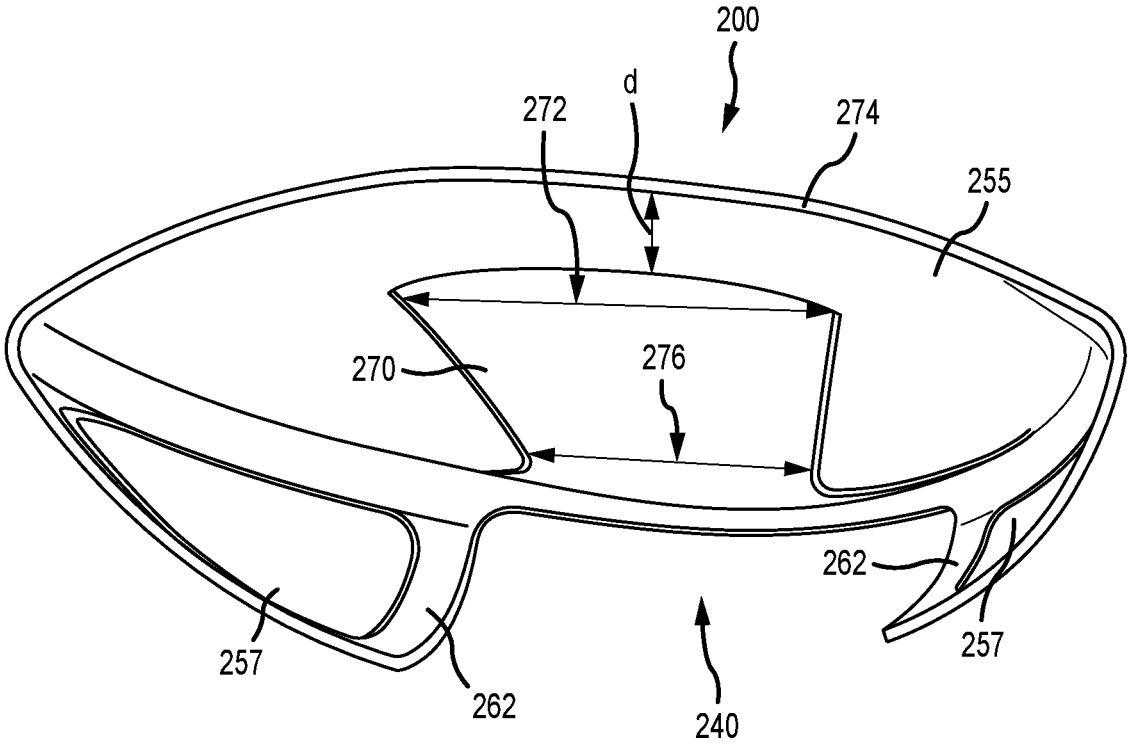
FIG. 3B illustrates a golf club head second component front interior view, according to an embodiment.

In yet another embodiment, such as generally shown in FIG. 3B, the second component comprises a central thickened section (270) that is surrounded by a crown portion reduced thickness sections (255) having a comparatively smaller thickness. In one configuration, this central thickened section (270) has total area of from about 1.5 $in^2$ to about 3.0 $in^2$. In another configuration, this central thickened section (270) has a total area of from about 2.0 $in^2$ to about 2.5 $in^2$. In some embodiments, the central thickened section (270) has a slightly trapezoidal shape, whereby at least a portion (272) of the thickened section (270) that is closer to the face and/or forward edge (274) is wider than a portion (276) of the thickened section (270) that is more distant from the face. Such a width dimension is preferably taken parallel to a horizontal midline of the face that extends between the heel and toe portions of the club head. As further shown, the central thickened section (270) may be spaced from the forward edge (274) by a distance (d) that is greater than about 0.8 inch, or a distance that is between 0.8 inch and 1.0 inch, or between 1.0 inch and 1.2 inch, or between 1.2 inch and 1.4 inch. In some embodiments, the distance (d) is approximately 1.25 inch.

In some embodiments (not depicted), the second component can further comprise a front thickened strip that runs along the perimeter or forward edge (274) of the second component (200). This thickened strip can comprise a thickness equal to the thickness of the trailing edge portion (230) and/or the central thickened section (270). The front thickened strip provides structural stiffness to the forward edge (274). There can be thickness transition region between the front thickened strip and the crown portion reduced thickness sections (255) to ease stress transfer across the crown. The second component comprises a mass percentage of the overall mass of the golf club head (100). The mass percentage of the second component can range from 4% to 15% of the overall mass of the golf club head (100), or can be approximately 10 grams to 25 grams. In other embodiments, the mass percentage of the second component can range from 4% to 15%. For example, the mass percentage of the second component may be 4%, 5%, 6%, 7%, 8%, 9%, 10%, 11%, 12%, 13%, 14%, or 15% of the overall mass of the golf club head (100).

The second component comprises a outer surface area ranging from 17 $inch^2$ to 25 $inch^2$. In some embodiments, the surface area of the second component can range from 15 $inch^2$ to 27 $inch^2$, 15 $inch^2$ to 18 $inch^2$, 18 $inch^2$ to 21 $inch^2$, 21 $inch^2$ to 25 $inch^2$. For example, the surface area of the second component can be 15 $inch^2$, 17 $inch^2$, 19 $inch^2$, 21 $inch^2$, 23 $inch^2$, or 25 $inch^2$.

1) Second Component Materials

The second component (200) comprises a less dense material than the material of the first component. In some embodiments, the second component can comprise a composite formed from polymer resin and reinforcing fiber. The polymer resin can comprise a thermoset or a thermoplastic. The second component (200) composite can be either a filled thermoplastic (FT) or a fiber-reinforced composite (FRC). In some embodiments, the second component (200) can comprise a FT bonded together with a FRC. Filled thermoplastics (FT) are typically injection molded into the desired shape. As the name implies, filled thermoplastics (FT) can comprise a thermoplastic resin and randomly-oriented, non-continuous fibers. In contrast, fiber-reinforced composites (FRCs) are formed from resin-impregnated (prepreg) sheets of continuous fibers. Fiber-reinforced composites (FRCs) can comprise either thermoplastic or thermoset resin.

In embodiments with a thermoplastic resin, the resin can comprise a thermoplastic polyurethane (TPU) or a thermoplastic elastomer (TPE). For example, the resin can comprise polyphenylene sulfide (PPS), polyetheretheretherketone (PEEK), polyimides, polyamides such as PA6 or PA66, polyamide-imides, olyphenylene sulfides (PPS), polycarbonates, engineering polyurethanes, and/or other similar materials. Although strength and weight are the two main properties under consideration for the composite material, a suitable composite material may also exhibit secondary benefits, such as acoustic properties. In some embodiments, PPS and PEEK are desirable because they emit a generally metallic-sounding acoustic response when the club head is impacted.

The reinforcing fiber can comprise carbon fibers (or chopped carbon fibers), glass fibers (or chopped glass fibers), graphine fibers (or chopped graphite fibers), or any other suitable filler material. In other embodiments, the composite material may comprise any reinforcing filler that adds strength, durability, and/or weighting.

The density of the composite material (combined resin and fibers), which forms the second component (200), can range from about 1.15 g/cc to about 2.02 g/cc. In some embodiments, the composite material density ranges between about 1.20 g/cc and about 1.90 g/cc, about 1.25 g/cc and about 1.85 g/cc, about 1.30 g/cc and about 1.80 g/cc, about 1.40 g/cc and about 1.70 g/cc, about 1.30 g/cc and about 1.40 g/cc, or about 1.40 g/cc to about 1.45 g/cc.

Filled Thermoplastic (FT)

In a FT material, the polymer resin should preferably incorporate one or more polymers that have sufficiently high material strengths and/or strength/weight ratio properties to withstand typical use while providing a weight savings benefit to the design. Specifically, it is important for the design and materials to efficiently withstand the stresses imparted during an impact between the strike face and a golf ball, while not contributing substantially to the total weight of the golf club head. In general, the polymers can be characterized by a tensile strength at yield of greater than about 60 MPa (neat). When the polymer resin is combined with the reinforcing fiber, the resulting composite material can have a tensile strength at yield of greater than about 110 MPa, greater than about 180 MPa, greater than about 220 MPa, greater than about 260 MPa, greater than about 280 MPa, or greater than about 290 MPa. In some embodiments, suitable composite materials may have a tensile strength at yield of from about 60 MPa to about 350 MPa.

In some embodiments, the reinforcing fiber comprises a plurality of distributed discontinuous fibers (i.e. "chopped fibers"). In some embodiments, the reinforcing fiber comprises a discontinuous "long fibers," having a designed fiber length of from about 3 mm to 25 mm. In some embodiments the discontinuous "long fibers" have a designed fiber length of from about 3 mm to 14 mm. For example, in some embodiments, the fiber length is about 12.7 mm (0.5 inch) prior to the molding process. In another embodiment, the reinforcing fiber comprises discontinuous "short fibers," having a designed fiber length of from about 0.01 mm to 3 mm. In either case (short or long fiber), it should be noted that the given lengths are the pre-mixed lengths, and due to breakage during the molding process, some fibers may actually be shorter than the described range in the final component. In some configurations, the discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, in certain configurations, the composite material may have a fiber length of from about 0.01 mm to about 25 mm or from about 0.01 mm to about 14 mm.

The composite material may have a polymer resin content of from about 40% to about 90% by weight, or from about 55% to about 70% by weight. The composite material of the second component can have a fiber content between about 10% to about 60% by weight. In some embodiments, the composite material has a fiber content between about 20% to about 50% by weight, between 30% to 40% by weight. In some embodiments, the composite material has a fiber content of between about 10% and about 15%, between about 15% and about 20%, between about 20% and about 25%, between about 25% and about 30%, between about 30% and about 35%, between about 35% and about 40%, between about 40% and about 45%, between about 45% and about 50%, between about 50% and about 55%, or between about 55% and about 60% by weight.

In embodiments where the second component (200) comprises a filled thermoplastic (FT) material, the second embodiment (200) can be injection molded out of composite pellets comprising both the polymer resin and the reinforcing fibers. The reinforcing fibers can be embedded within the resin prior to the injection molding process. The pellets can be melted and injected into an empty mold to form the second component (200). The FT composite material can have a melting temperature of between about 210° C. to about 280° C. In some embodiments, the composite material can have a melting temperature of between about 250° C. and about 270° C.

In embodiments with FT material second components (200), at least 50% of the fibers can be aligned roughly front-to-back in a center region of the crown (110). In other words, the fibers can be aligned roughly perpendicular to the striking face (170). FT materials exhibit greatest strength in the direction of fiber alignment. Therefore, having the fibers oriented roughly front-to-back in the crown (110) can increase the durability of the club head in the front-to-rear direction. The fiber alignment can be correspond to the direction of material flow within the mold during the injection molding process.

When the golf club head (100) strikes a golf ball, the impact can cause the mass at the rear end (180) of the rear extension (500) to displace vertically, in the Y-axis (192) direction. At impact, the sole portion rear extension (500) will bend upwards and exert stress on the second component crown portion (205). The crown portion is compressed between the first component rear extension (500) and a front portion of the first component (300). Therefore, in embodiments with a FT second component (200), aligning the fibers with the direction of compression stress that is expected at impact lowers the likelihood of failure within the composite second component (200).

In some embodiments, the second component (200) can be formed from a long fiber reinforced TPU material (an example FT material). The long fiber TPU can comprise about 40% long carbon fiber by weight. The long fiber TPU can exhibit a high elastic modulus, greater than that of short carbon fiber compounds. The long fiber TPU can withstand high temperatures, making it suitable for use in a golf club head that is used and/or stored in a hot climate. The long fiber TPU further exhibits a high toughness, allowing it to serve well as a replacement for traditionally metal components. In some embodiments, the long fiber TPU comprises a tensile modulus between about 26,000 MPa and about 30,000 MPa or between about 27,000 MPa and about 29,000 MPa. In some embodiments, the long fiber TPU comprises a flexural modulus between about 21,000 MPa and about 26,000 MPa or between about 22,000 MPa and 25,000 MPa. The long fiber TPU material can exhibit an tensile elongation (at break) of between about 0.5% and about 2.5%. In some embodiments, the tensile elongation of the composite TPU material can be between about 1.0% and about 2.0%, between about 1.2% and about 1.4%, between about 1.4% and about 1.6%, between about 1.6% and about 1.8%, between about 1.8% and about 2.0%.

Fiber-Reinforced Composite (FRC)

In some embodiments, the second component (200) may comprise fiber-reinforced composite (FRC) materials. FRC materials generally include one or more layers of a uni- or multi-directional fiber fabric that extend across a larger portion of the polymer. Unlike the reinforcing fibers that may be used in filled thermoplastic (FT) materials, the maximum dimension of fibers used in FRCs may be substantially larger/longer than those used in FT materials, and may have sufficient size and characteristics so they may be provided as a continuous fabric separate from the polymer. When formed with a thermoplastic polymer, even if the polymer is freely flowable when melted, the included continuous fibers are generally not. The reinforcing fibers can comprise an areal weight (weight per length-by-width area) between 75 $g/m^2$ and 150 $g/m^2$.

FRC materials are generally formed by arranging the fiber into a desired arrangement, and then impregnating the fiber material with a sufficient amount of a polymeric material to provide rigidity. In this manner, while FT materials may have a resin content of greater than about 45% by volume or more preferably greater than about 55% by volume, FRC materials desirably have a resin content of less than about 45% by volume, or more preferably less than about 35% by volume. In some embodiments, the resin content of the FRC can be between 24% and 45% by volume.

FRC materials traditionally use two-part thermoset epoxies as the polymeric matrix, however, it is possible to also use thermoplastic polymers as the matrix. In many instances, FRC materials are pre-prepared prior to final manufacturing, and such intermediate material is often referred to as a prepreg. When a thermoset polymer is used, the prepreg is partially cured in intermediate form, and final curing occurs once the prepreg is formed into the final shape. When a thermoplastic polymer is used, the prepreg may include a cooled thermoplastic matrix that can subsequently be heated and molded into a final shape.

A FRC second component (200) can be comprise a plurality of layers (also called a plurality of lamina). Each layer can comprise and/or be the same thickness as a prepreg. Each layer the plurality of layers can comprise either a uni-direcitonal fiber fabric (UD) or a multi-directional fiber fabric (sometimes called a weave). In some embodiments, the plurality of layers can comprise at least three UD layers. The second and third layers can be angled relative to a base layer. For a base layer oriented at 0 degrees, the second and third layers can be oriented at +/−45 degrees from the base layer. In some embodiments, the layers can be oriented at 0, +45, −45, +90, −90 in any suitable order. In some embodiments, the plurality of layers comprises at least one multi-directional weave layer, typically positioned as the top layer to improve the appearance of the FRC second component (200).

Mixed-Material

The second component (200) may have a mixed-material construction that includes both a fiber-reinforced composite resilient layer and a molded thermoplastic structural layer. In some preferred embodiments, the molded thermoplastic structural layer may be formed from a filled thermoplastic material (FT). As described above, the FT can comprise a discontinuous glass, carbon, or aramid polymer fiber filler embedded throughout a thermoplastic material. The thermoplastic resin can be a TPU, such as, for example, polyphenylene sulfide (PPS), polyether ether ketone (PEEK), or a polyamide such as PA6 or PA66. The fiber-reinforced composite resilient layer can comprise a woven glass, carbon fiber, or aramid polymer fiber reinforcing layer embedded in a polymeric resin (or matrix). The polymeric resin of the resilient layer can be a thermoplastic or a thermoset.

In some embodiments, the polymeric resin of fiber-reinforced composite resilient layer is the same thermoplastic material as the resin of the molded thermoplastic structural layer. In other words, the fiber-reinforced resilient layer and the molded structural layer can comprise a common thermoplastic resin. Forming the resilient and structural layers with a common thermoplastic resin allows for a strong chemical bond between the layers. In these embodiments, the resilient and structural layers can be bonded without the use of an intermediate adhesive. In one particular embodiment, the second component (200) resilient layer can comprise a woven carbon fiber fabric embedded in a polyphenylene sulfide (PPS), and the second component (200) structural layer can comprise a filled polyphenylene sulfide (PPS) polymer. In alternate embodiments, the second component (200) can be extruded, injection blow molded, 3-D printed, or any other appropriate forming means.

Cross Connecting Members

In alternate embodiments, the second component (200) may have one or more interior cross connecting members (not shown). The cross connecting members may provide additional structural stiffness or sound control. The interior cross connecting members can comprise members that connect non-adjacent portions of the interior of the second component (200). For example, the cross connecting members may connect the interior surface of the second component crown portion (205) to one of the second component sole portion heel portion (214), or the second component sole portion toe portion (212). The interior cross connecting members may comprise a length that extends entirely from an interior surface of a front most edge of the second component (200) to the second component trailing edge portion (230) interior surface, or the interior cross connect members may comprise a length that does not extend entirely from an interior surface of a front most edge of the second component (200) to the second component trailing edge portion (230) interior surface. The interior cross connecting members comprise a thickness. The thickness of interior cross connecting members can range from 0.01 inch to 0.25 inch. For example, the thickness of interior cross connecting members may be 0.01 inch, 0.05 inch, 0.10 inch, 0.15 inch, 0.20 inch, or 0.25 inch.

II) Second Embodiment of Golf Club Head (Including a Weight Channel)

Figure 17:
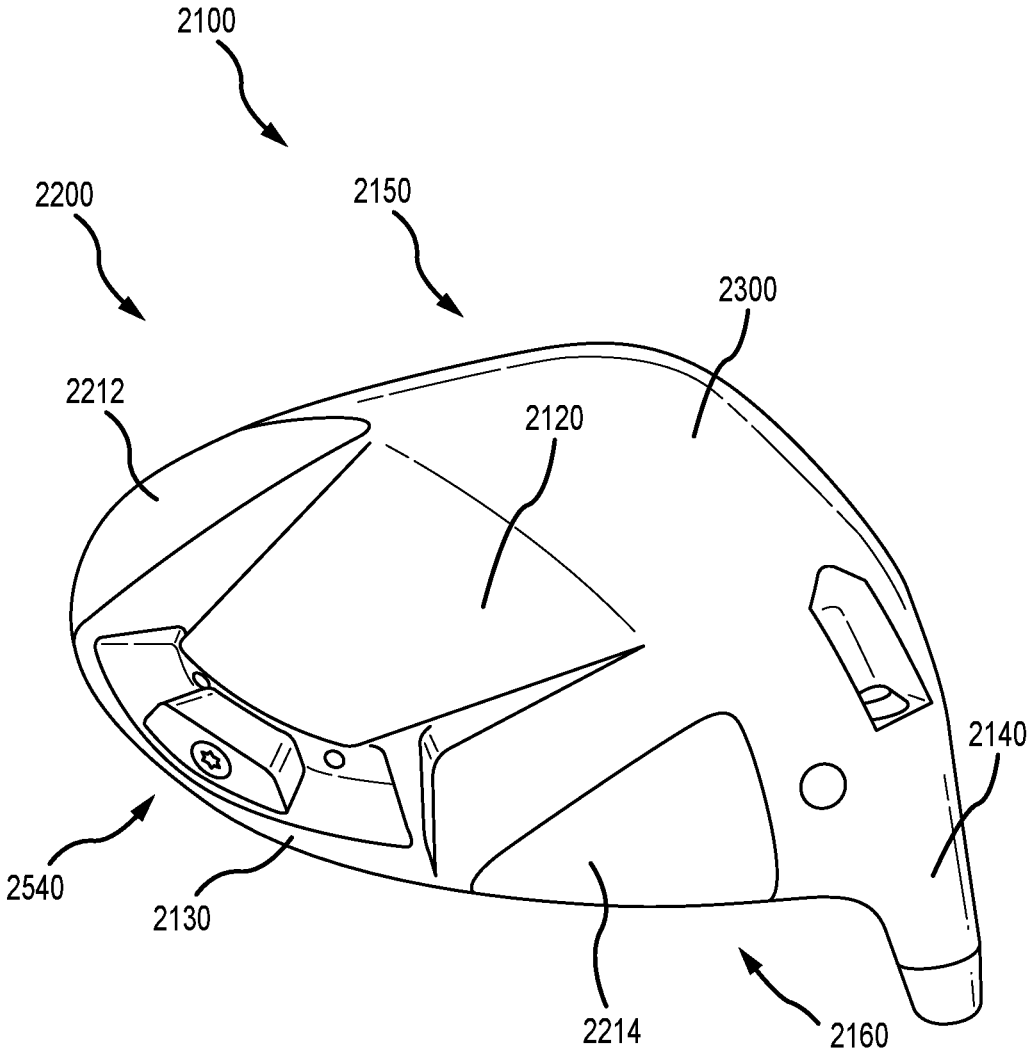
FIG. 17 illustrates a perspective view of a golf club head, according to a second embodiment.

A second embodiment of a golf club head (2100), illustrated in FIG. 17, comprises a first component (2300) with a weight channel and a second component (2200) that joins onto the first component (2300). The first component (2300) of golf club head (2100) can be similar to the first component (300) of golf club head (100), with the exception of the weight system. The second component (2200) of golf club head (2100) can be similar to the second component of golf club head (100), described above. The golf club head (2100) forms a striking face (2170), a striking face return (2177), a hosel (2140), a crown (2110), a sole (2120), a heel end (2160), a toe end (2150), a skirt (2125) with a trailing edge (2130) at a rear-most portion of a rear end (2180), and a sole portion hosel adaptor attachment recess (2195). The skirt (2125) can extend along a perimeter of the club head between the crown (2110) and the sole (2120), behind the hosel (2140).

First Component

Figure 18:
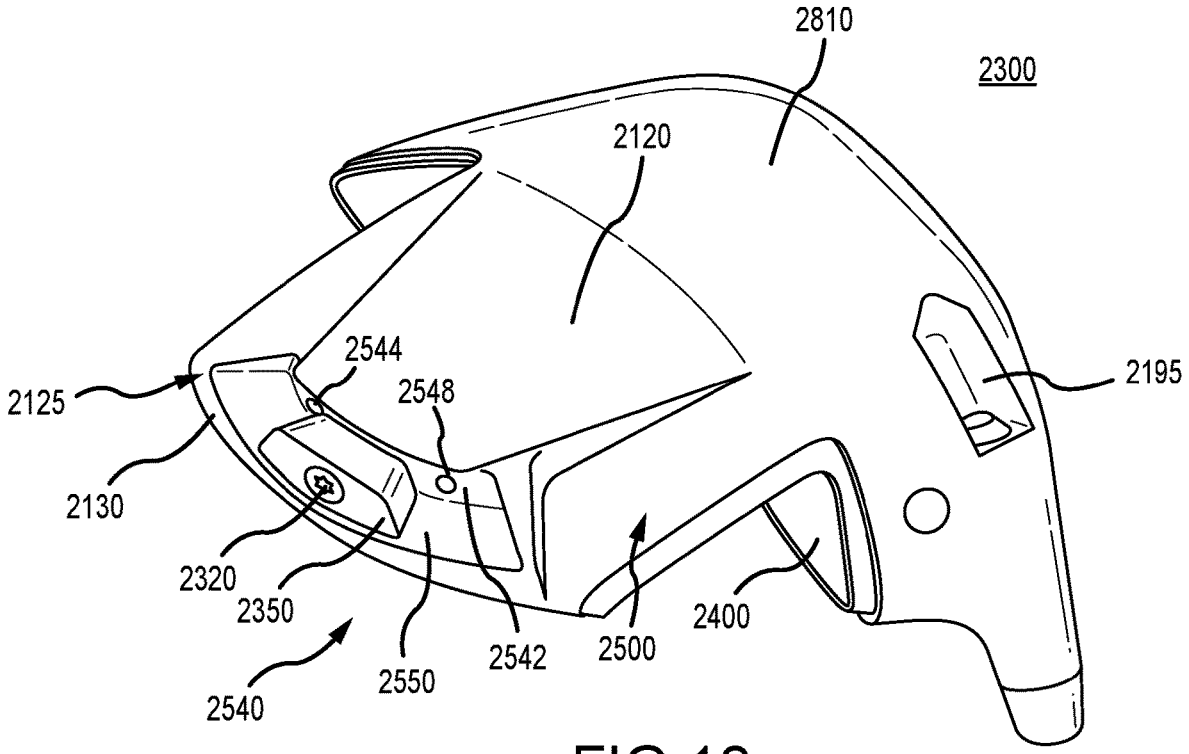
FIG. 18 illustrates a perspective view of a first component of the club head of FIG. 17.

As illustrated in FIG. 18, the first component (2300) can comprise a rear extension (2500). The rear extension (2500) can comprise a portion of the sole (2120). The rear extension (2500) comprises a weight channel (2540). The weight channel (2540) is exposed at the rear end (2180) and sole (2120) of the club head (2300).

The weight channel (2540) is configured to receive a movable weight (2350) in one of three positions. The weight (2350) can be secured to the weight channel (2540) by a threaded fastener (2320). The weight (2350) can be placed in a toe-side position, a central position, or a heel-side position. The weight channel (2540) comprises a mounting wall (2542) and a sole wall (2550). The mounting wall (2542) can be oriented approximately perpendicular to the sole (2120). The sole wall (2550) can be oriented approximately parallel to the main sole (2120), but inset by a distance equal to a height of the mounting wall (2542). The movable weight (2350) can comprise an elongate, trapezoidal shape, or any other suitable weight. The movable weight (2350) can comprise a inward wall and a connecting wall. The inward wall lies flush against the sole wall (2550) of the weight channel (2540). The connecting wall lies flush with the mounting wall (2542) when the weight (2350) is attached in one of the three positions.

The movable weight (2350) mass can range from 1.0 gram to 35.0 grams. For example, the movable weight (2350) mass may be 1.0 gram, 1.5 grams, 2.0 grams, 3.0 grams, 4.0 grams, 5.0 grams, 6.0 grams, 7.0 grams, 8.0 grams, 9.0 grams, 10.0 grams, 11.0 grams, 12.0 grams, 13.0 grams, 14.0 grams, 15.0 grams, 16.0 grams, 17.0 grams, 18.0 grams, 19.0 grams, 20.0 grams, 21 grams, 22 grams, 23, grams, 24, grams, 25 grams, 26 grams, 27 grams, 28 grams, 29, grams, 30 grams, 31 grams, 32 grams, 33 grams, 34 grams, or 35 grams. The concentration of mass within the weight channel (2540) at the rear end (2180) of the club head can strategically position the head center of gravity to improve the launch characteristics of the golf club.

The mounting wall (2542) of the weight channel (2540) comprises three threaded apertures that correspond to the three weight positions. The mounting wall (2542) comprises a toe-side threaded aperture (2544), a center threaded aperture (2546), and a heel-side threaded aperture (2548). The movable weight (2350) is positioned in the toe-side position by placing the connecting wall of the weight (2350) flush against the mounting wall (2542) of the channel (2540) and securing the fastener (2320) into the toe-side threaded aperture (2544). The movable weight (2350) is positioned in the central position by placing the connecting wall of the weight (2350) flush against the mounting wall (2542) of the channel (2540) and securing the fastener (2320) into the center threaded aperture (2546). The movable weight (2350) is positioned in the heel-side position by placing the connecting wall of the weight (2350) flush against the mounting wall (2542) of the channel (2540) and securing the fastener (2320) into the heel-side threaded aperture (2548).

Figure 19A:
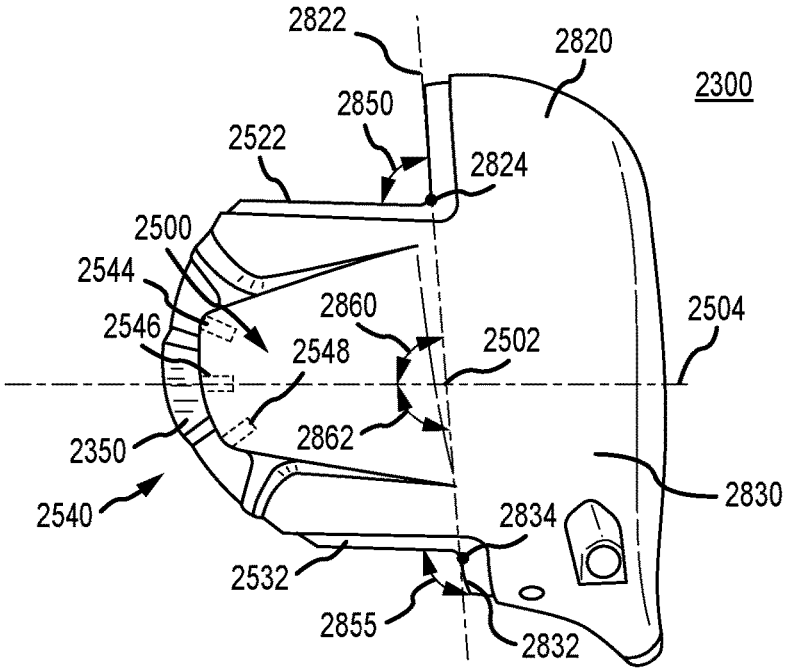
FIG. 19A illustrates a sole view of the first component of FIG. 18, with the movable weight in a central position.
Figure 19B:
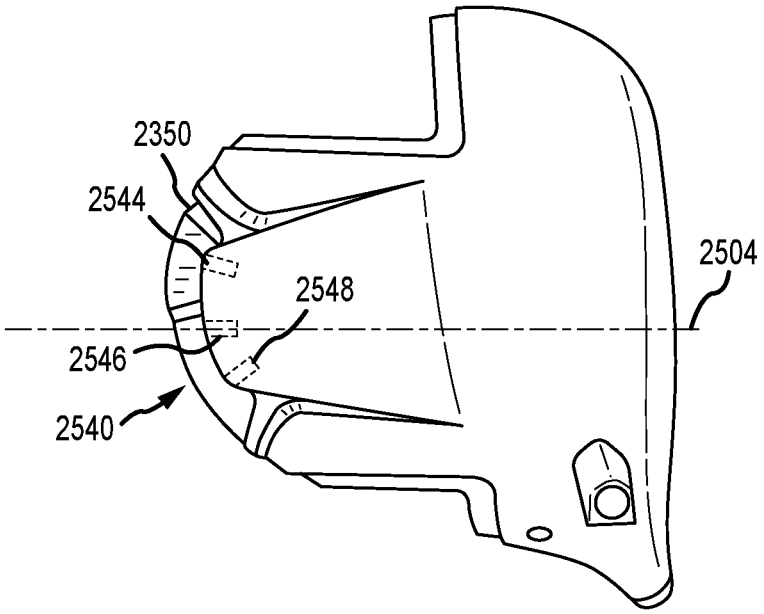
FIG. 19B illustrates a sole view of the first component of FIG. 18, with the movable weight in a toe-side position.
Figure 19C:
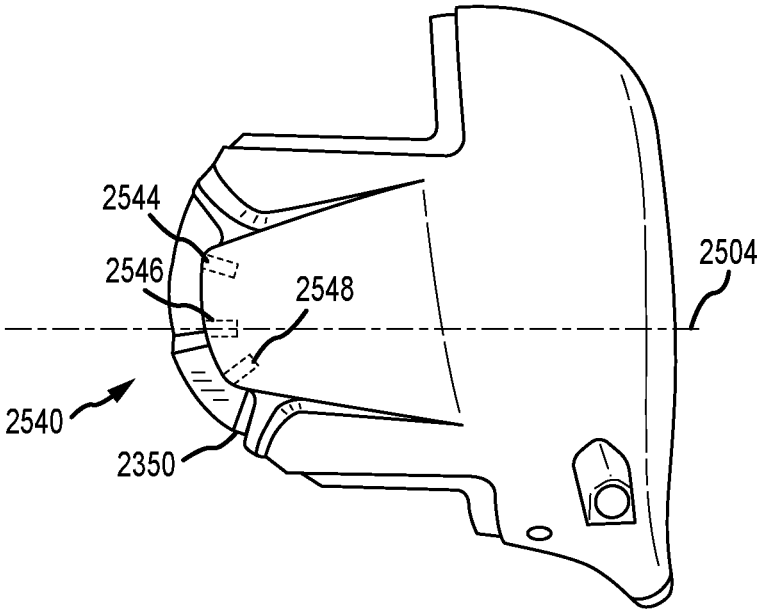
FIG. 19C illustrates a sole view of the first component of FIG. 18, with the movable weight in a heel-side position.

When the movable weight (2350) is positioned in the central position, as illustrated in the sole view of FIG. 19A, the golf club (2100) is configured to offer no draw or fade bias. When the weight (2350) is positioned in the toe-side position, as illustrated in FIG. 19B, the weight (2350) gives the club head a fade bias. When the weight (2350) is positioned in the heel-side position, as illustrated in FIG. 19C, the weight (2350) gives the club head a draw bias. When the weight (2350) has a greater mass, the weight (2350) causes a greater fade or draw bias when positioned in the toe-side or heel-side positions, respectively. A larger separation distance between each of the toe-side, central, and heel-side positions can also increase the fade or draw bias. Therefore, in some embodiments, the mass of the movable weight (2350) can be balanced against the separation distance of the weight positions to achieve the desired shot bias.

Figure 20:
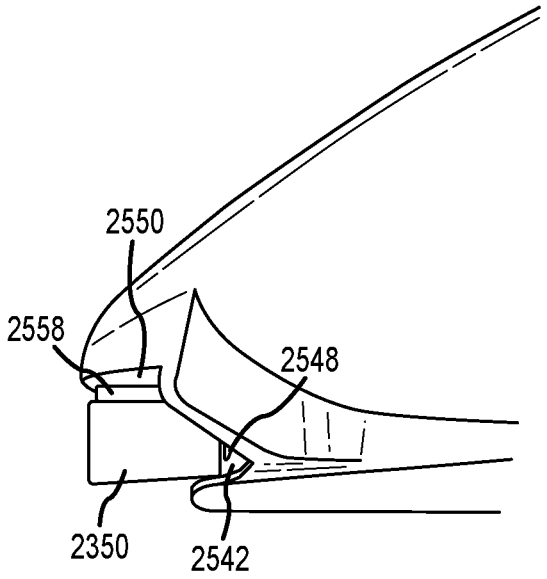
FIG. 20 illustrates a close up side view of a golf club head, similar to the golf club head of FIG. 17, with a weight channel and a movable weight in a central position.
Figure 21:
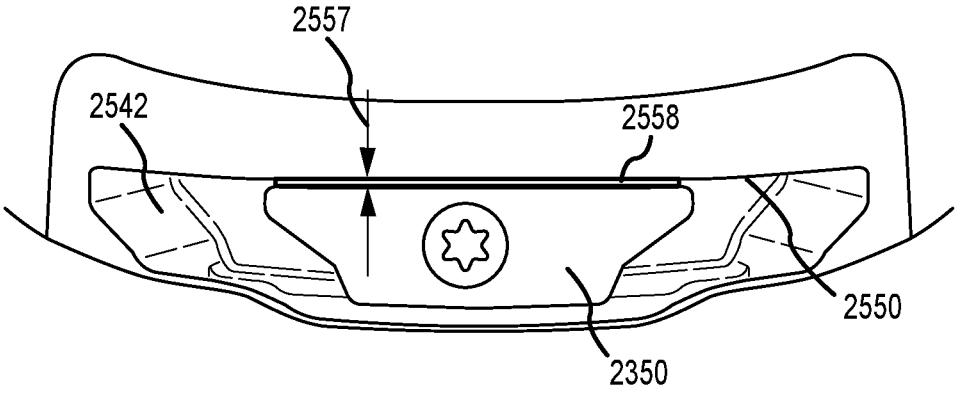
FIG. 21 illustrates a close up rear view of the weight channel of FIG. 20.

Referring to FIGS. 20 and 21, when the movable weight (2350) is installed in the weight channel (2540), the movable weight (2350) can be offset from the sole wall (2550) of the weight channel (2540) by a gap. The gap or offset distance (2557) can be measured as the shortest distance between the movable weight (2350) and the sole wall (2550). The offset distance (2557) can be between approximately 0.004 inch and 0.050 inch. In some embodiments, the offset distance (2557) is between approximately 0.004 inch and 0.010 inch, 0.006 inch and 0.010 inch, 0.008 inch and 0.012 inch, 0.010 inch and 0.014 inch, 0.012 inch and 0.016 inch, 0.014 inch to 0.018 inch, 0.016 to 0.020 inch, 0.020 inch to 0.030 inch, 0.030 inch to 0.040 inch, or 0.040 inch to 0.050 inch. When the offset distance (2557) is larger, the movable weight (2350) can vibrate or oscillate up and down after the golf club head impacts a golf ball. This oscillation can induce stresses in the fastener (2320), threaded apertures (2544, 2546, 2548), and/or the weight channel (2540), which can cause durability issues over time.

Reducing the ability of the movable weight (2350) to deflect vertically can reduce stress by more than 10%, more than 20%, more than 30%, or more than 40%, compared to a similar design that allows vertical deflection of the movable weight (2350). In some embodiments, reduction of the vertical deflection of the weight (2350), results in approximately 40% less stress, according to a finite element analysis (FEA) simulation. The vertical deflection (towards the crown or the sole) of the movable weight (2350) correlates to the oscillation amplitude of the movable weight (2350). The vertical deflection of the weight (2350) can be limited by the aforementioned offset distance (gap size) between the movable weight (2350) and the sole wall (2550). In some embodiments, to maintain durability by reducing vertical deflection of the weight (2350), the offset distance must be less than 0.040 inch, less than 0.030 inch, less than 0.020 inch, less than 0.010 inch, less than 0.009 inch, less than 0.008 inch, less than 0.007 inch, less than 0.006 inch, or less than 0.005 inch.

The vertical deflection and oscillation of the weight (2350) can also be controlled by inserting heavy duty tape (2558) such as very high bond (VHB) tape between the movable weight (2350) and the sole wall (2550). The VHB tape (2558) can fill a majority of the gap. In some embodiments, the VHB tape (2558) fills the entire gap. The VHB tape (2558) can reduce or eliminate the oscillation of the movable weight (2350).

The first component (2300) comprises a sole portion rear extension (2500), a striking face return crown portion (2400), and a striking face return sole portion (2810). The striking face return sole portion (2810) comprises a heel extension (2830) and a toe extension (2820). The heel extension (2830) comprises a rear wall (2832). The toe extension (2820) comprises a rear wall (2822).

The first component rear extension (2500) comprises a toe-side wall (2522) and a heel-side wall (2532) that connect the weight channel (2540) to the striking face sole return (2810). The rear extension toe-side wall (2522) and the toe extension rear wall (2822) can form a toe-side wall angle (2850). The toe-side wall angle (2850) can range between 45 degrees and 180 degrees. The rear extension heel-side wall (2532) and the heel extension rear wall (2832) can form a heel-side wall angle (2855). The heel-side wall angle (2855) can range between 45 degrees and 180 degrees. In some embodiments, the toe-side wall angle (2850) is roughly equal to the heel-side wall angle (2855). In other embodiments, the toe-side wall angle (2850) and the heel-side wall angle (2855) are different. In some embodiments, the toe-side wall angle (2850) and the heel-side wall angle (2855) are supplementary angles (their sum equals roughly 180 degrees). In these embodiments, the toe extension rear wall (2822) and the heel extension rear wall (2832) are located roughly within the same plane (the toe rear wall (2822) and the heel rear wall (2832) are roughly parallel when viewed from the sole). For example, the toe-side wall angle (2850) can be a acute angle, while the heel-side wall angle (2855) is a supplementary obtuse angle.

Figure 22:
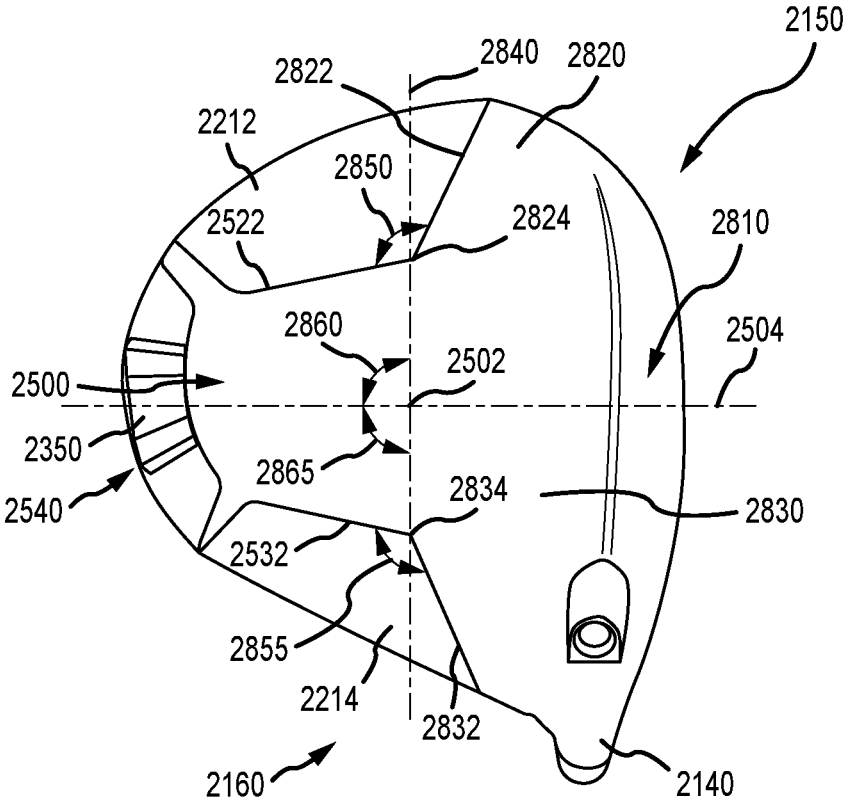
FIG. 22 illustrates a sole view of a golf club head, with a straight rear sole extension, according to an embodiment.
Figure 23:
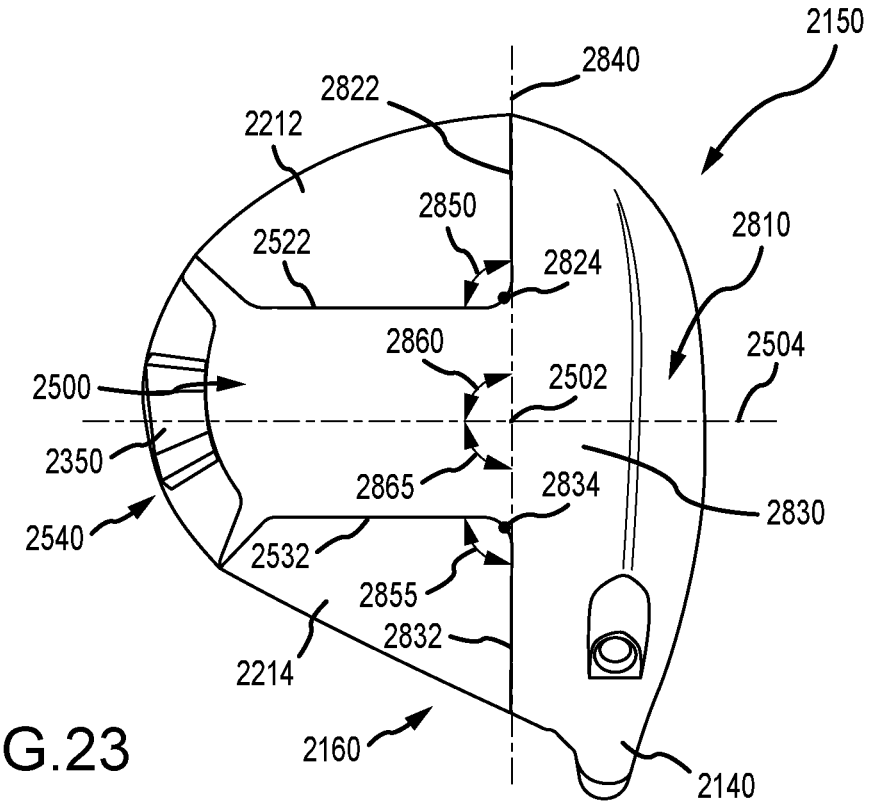
FIG. 23 illustrates a sole view of a golf club head, with a straight rear sole extension, according to an embodiment.
Figure 24:
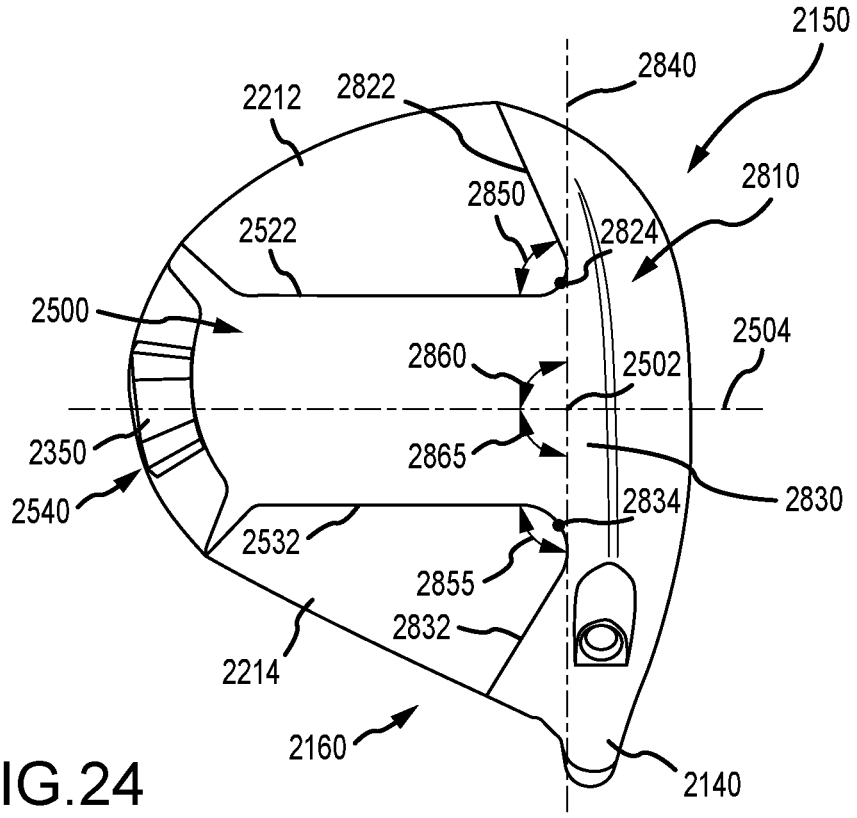
FIG. 24 illustrates a sole view of a golf club head, with a straight rear sole extension, according to an embodiment.

Referring to FIGS. 19 and 22, some embodiments comprise obtuse toe-side and heel-side wall angles (2850 and 2855). Referring to FIG. 23, some embodiments comprise approximately 90 degree toe-side and heel-side wall angles (2850 and 2855). Referring to FIG. 24, some embodiments comprise acute toe-side and heel-side wall angles (2850 and 2855). Embodiments with obtuse toe-side and heel-side wall angles (2850 and 2855) can distribute stress smoothly, rearward into the sole (2120). The obtuse angles can increase the strength of the sole (2120) and support the sole rear extension (2500). However, embodiments with acute angles can comprise a first component with a smaller mass than embodiments with obtuse or 90 degree angles. Therefore, the embodiments with acute toe-side and heel-side wall angles (2850 and 2855) can allow for improved weighting properties, such as a high MOI.

The weight channel (2540) can fan outward beyond a main section of the rear sole extension (2500), as shown in the embodiment of FIGS. 19-21. In these embodiments, where the weight channel (2540) extends toe-ward and heel-ward, the rear extension toe-side wall (2522) and heel-side wall (2532) each have a bend adjacent the weight channel (2540). In other embodiments, such as is illustrated in FIG. 22, the rear extension toe-side wall (2522) and heel-side wall (2532) can be straight. In some embodiments, the rear extension toe-side wall (2522) can be parallel to the rear extension heel-side wall (2532). In some embodiments, the rear extension toe-side wall (2522) can be non-parallel to the rear extension heel-side wall (2532). The rear extension (2500) can extend from the return portion (2810) at different locations. This shift of the placement of the rear extension (2500) can affect how the rear extension (2500) is angled with respect to the return portion (2810). A rear extension axis (2504) approximates a center of the rear extension (2500). The rear extension axis (2504) extends between a front midpoint (2502) of the rear extension and the center threaded aperture (2546) of the weight channel (2540). The front midpoint (2502) is located half way between a toe-side intersection point (2824) and a heel-side intersection point (2834). The toe-side intersection point (2824) is the point at which the toe extension rear wall (2822) intersects and connects to the rear extension toe-side wall (2522). Similarly, a heel-side intersection point (2834) is the point at which the heel extension rear wall (2832) intersects and connects to the rear extension heel-side wall (2532). The toe-side and heel-side intersection points (2824 and 2834) can be located anywhere along a rear edge of the forward sole portion (2810). In some embodiments, the connection between the toe/heel extension rear wall (2822/2832) and the rear extension toe/heel-side wall (2522/2532), respectively, is filleted, beveled, or chamfered.

The sole rear extension (2500) of the first component (2300) can be angled with respect to an intersection plane (2840). As illustrated in FIGS. 19 and 22-28 the intersection plane (2840) is coincident with the toe-side intersection point (2824) and the heel-side intersection point (2834). In some embodiments, intersection plane (2840) extends parallel to the XY plane (191). In some embodiments, such as those of FIGS. 19-24, the rear extension (2500) extends straight rearward, such that the intersection plane (2840) and the rear extension axis (2504) form an approximately 90 degree angle when viewed from a sole view. In some embodiments, such as that of FIGS. 25-28, the intersection plane (2840) and the rear extension axis (2504) intersect at an angle that is not 90 degrees.

A toe-side axis angle (2860) is measured (in the sole view) from the intersection plane (2840) to the rear extension axis (2504) on the toe-side of the rear extension axis (2504). A heel-side axis angle (2865) is measured (in the sole view) from the intersection plane (2840) to the rear extension axis (2504) on the heel-side of the rear extension axis (2504). The toe-side axis angle (2860) and the heel-side axis angle (2865) are supplementary angles (adding to 180 degrees).

Figure 25:
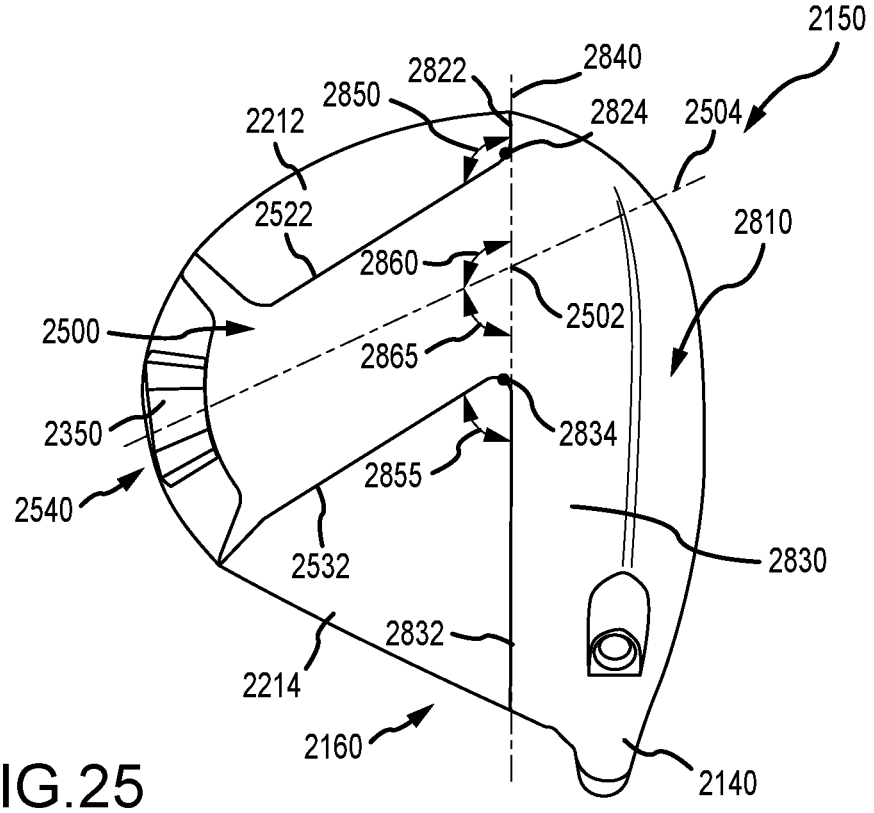
FIG. 25 illustrates a sole view of a golf club head, with an angled rear sole extension, according to an embodiment.

Referring to FIG. 25, in some embodiments, the rear extension is attached to the striking face sole return (2810) closer to the toe end (2150) of the club head (2100) than the heel end (2160) of the club head (2100). In these embodiments, the toe-side axis angle (2860) is greater than 90 degrees, and the heel-side axis angle (2865) is less than 90 degrees. The weight channel (2540) remains centrally located in the rear end (2180) of the golf club head (2100). Because of the location of the first component rear extension (2500), the second component (2200) can occupy a greater portion of the heel side of the sole (2120). More specifically, a second component heel sole portion (2214) can be greater than a second component toe sole portion (2212).

Figure 26:
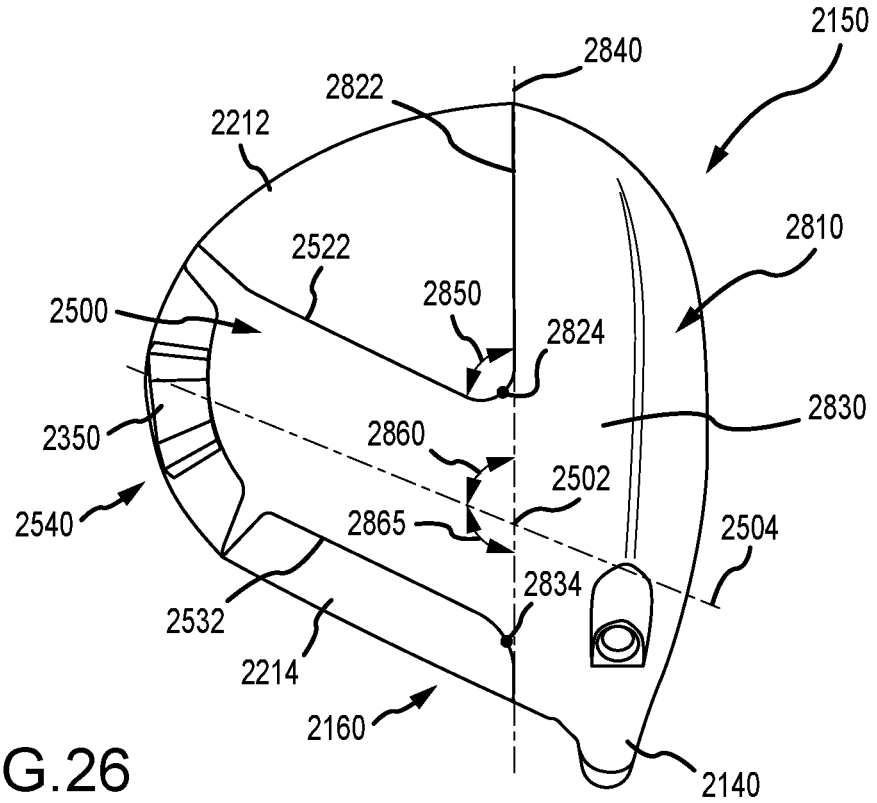
FIG. 26 illustrates a sole view of a golf club head, with an angled rear sole extension, according to an embodiment.

Referring to FIG. 26, in some embodiments, the rear extension is attached to the striking face sole return (2810) closer to the heel end (2160) of the club head (2100) than the toe end (2150) of the club head (2100). In this embodiment, the toe-side axis angle (2860) is greater than 90 degrees, and the heel-side axis angle (2865) is less than 90 degrees. The weight channel (2540) remains centrally located in the rear end (2180) of the golf club head (2100). Because of the location of the first component (2300) rear extension (2500), the second component (2200) can occupy a greater portion of the toe side of the sole (2120). More specifically, the second component toe sole portion (2212) can be greater than the second component heel sole portion (2214). The attachment position of the rear extension can alter the weighting and launch characteristics of the golf club head (2100).

Figure 27:
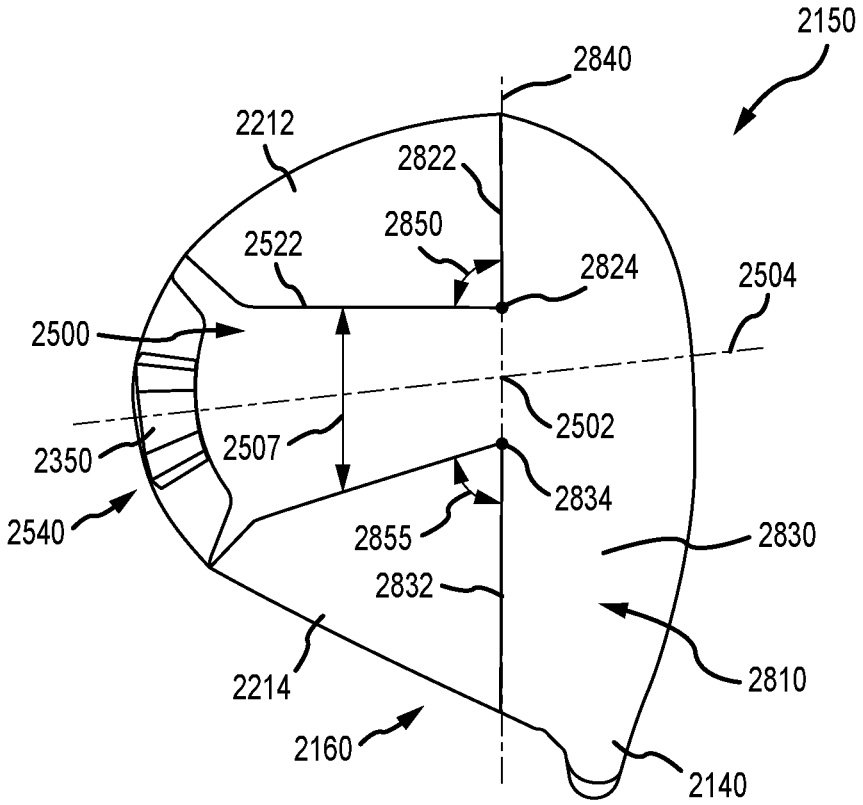
FIG. 27 illustrates a sole view of a golf club head, with a varying width sole extension, according to an embodiment.
Figure 28:
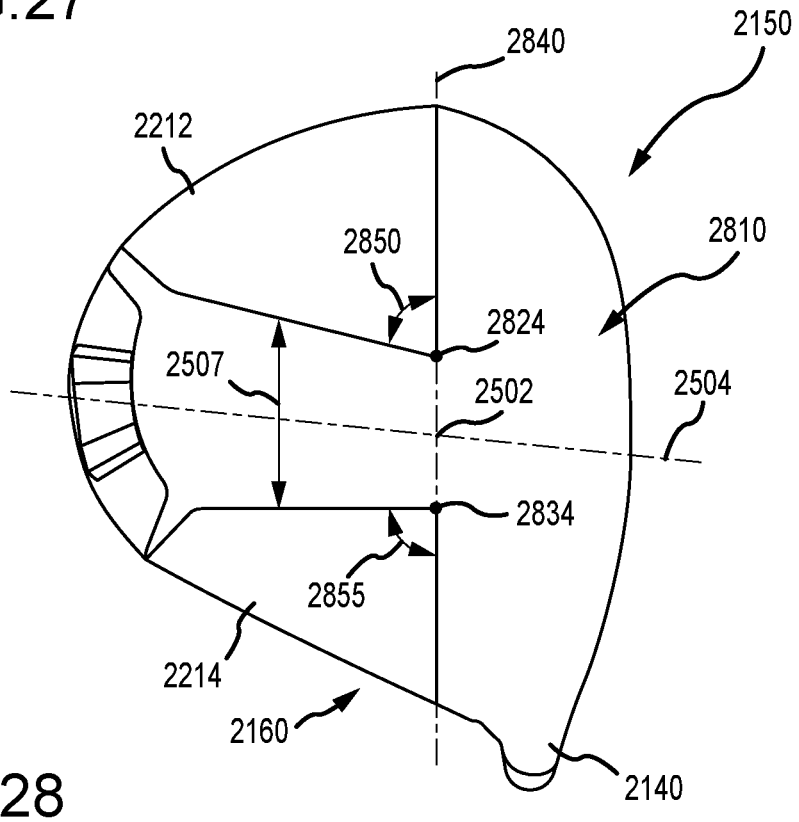
FIG. 28 illustrates a sole view of a golf club head, with a varying width sole extension, according to an embodiment.

Referring to FIGS. 27 and 28, in some embodiments, the rear extension can have a varying width. In these embodiments, the toe-side wall angle (2850) and the heel-side wall angle (2855) may not be supplementary angles (may not sum to 180 degrees). In some embodiments, both the toe-side and the heel side wall angles (2850 and 2855) may be acute angles, reducing the weight of the first component and allowing greater perimeter weighting in the club head. In other embodiments, both the toe-side and the heel side wall angles (2850 and 2855) may be obtuse angles, increasing the durability of the sole and simplifying manufacturing assembly of the golf club head (2100).

The rear extension width (2507) is measured in a heel to toe direction rearward of a rear perimeter of the forward sole portion (2810). The rear extension width (2507) is less than an entire width of the sole (2120) of the golf club (2100). The rear extension width (2507) can range from 25% to 85% of an entire width of the sole (2120). The rear extension width (2507) may be 25%, 30%, 35%, 40%, 45%, 50%, 55%, 60%, 65%, 70%, 75%, 80% or 85% of an entire width of the sole (2120). The width of the rear extension adjacent the weight channel (2540) can range between 1 inch to 2.5 inches. The rear extension width (8507) between the toe-side intersection point (2824) and the heel-side intersection point (2834) can range between 1 inch and 5 inches. The rear extension width (2507) can be greater adjacent the weight channel (2540), as illustrated in FIGS. 27 and 28, or greater adjacent the return portion (2810).

Figure 37:
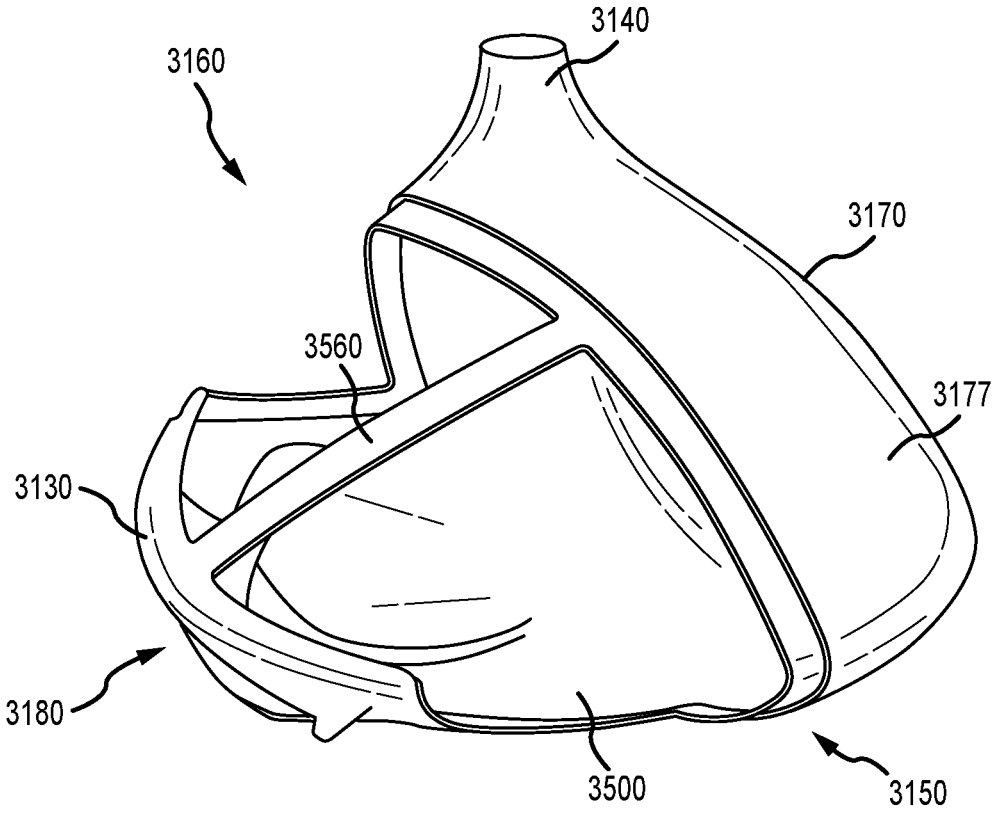
FIG. 37 illustrates a crown perspective view of a first component of a golf club head having a crown and sole return, including a weight channel and a crown brace, according to an embodiment.
Figure 38:
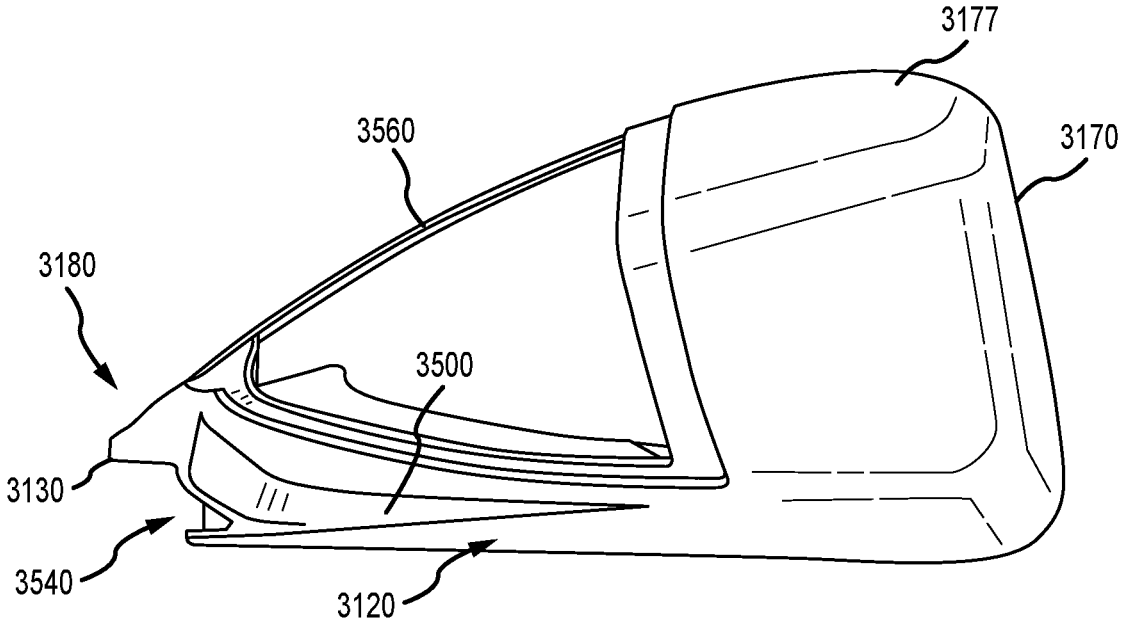
FIG. 38 illustrates a side view of the first component of FIG. 37.

Referring to FIGS. 37 and 38, the position of the sole rear extension (2500) of the first component (2300) can also be understood in relationship to the striking face (2170) and the X, Y, Z coordinate system. A rear extension angle (2508) can be measured, from the sole view, between the rear extension axis (2504) and the YZ plane (193). In some embodiments, the rear extension axis (2504) can intersect the YZ plane (193) adjacent the rear end (2180) of the club head (2100). In other embodiments, the rear extension axis (2504) can intersect the YZ plane (193) at a point between the return portion (2177) and the rear end (2180) of the golf club head (2100). The rear extension angle (2508) can range from 0 degrees to 45 degrees. In some embodiments, the rear extension angle (2508) can range from 0 to 10 degrees, 0 to 20 degrees, 0 to 30 degrees, 0 to 40 degrees, 10 to 20 degrees, 10 to 30 degrees, 10 to 40 degrees, 10 to 45 degrees, 20 to 30 degrees, 20 to 40 degrees, 20 to 45 degrees, 30 to 40 degrees, or 30 to 45 degrees.

In the embodiment of FIG. 37, the rear extension axis (2504) intersects the YZ plane (193) adjacent or at the rear end (2180) of the club head (2100). A front end of the rear extension (2500) is positioned closer to the heel end (2160) than the toe end (2150). By shifting the front end of the rear extension (2500), the CG and MOI of the club head (2100) is affected because the first component (2300) comprises a higher density than the second component. Placement of more of the first component (2300) within a heel end (2160) of the club head (2100) increases the mass within the heel end (2160) of the club head (2100).

In the embodiment of FIG. 38, the rear extension axis (2504) intersects the YZ plane (193) adjacent or at the rear end (2180) of the club head (2100). A front end of the rear extension (2500) is positioned closer to the toe end (2150) than the heel end (2160). Placement of more of the first component (2300) within a toe end (2150) of the club head (2100) increases the mass within the toe end (2150) of the club head (2100).

Figure 39:
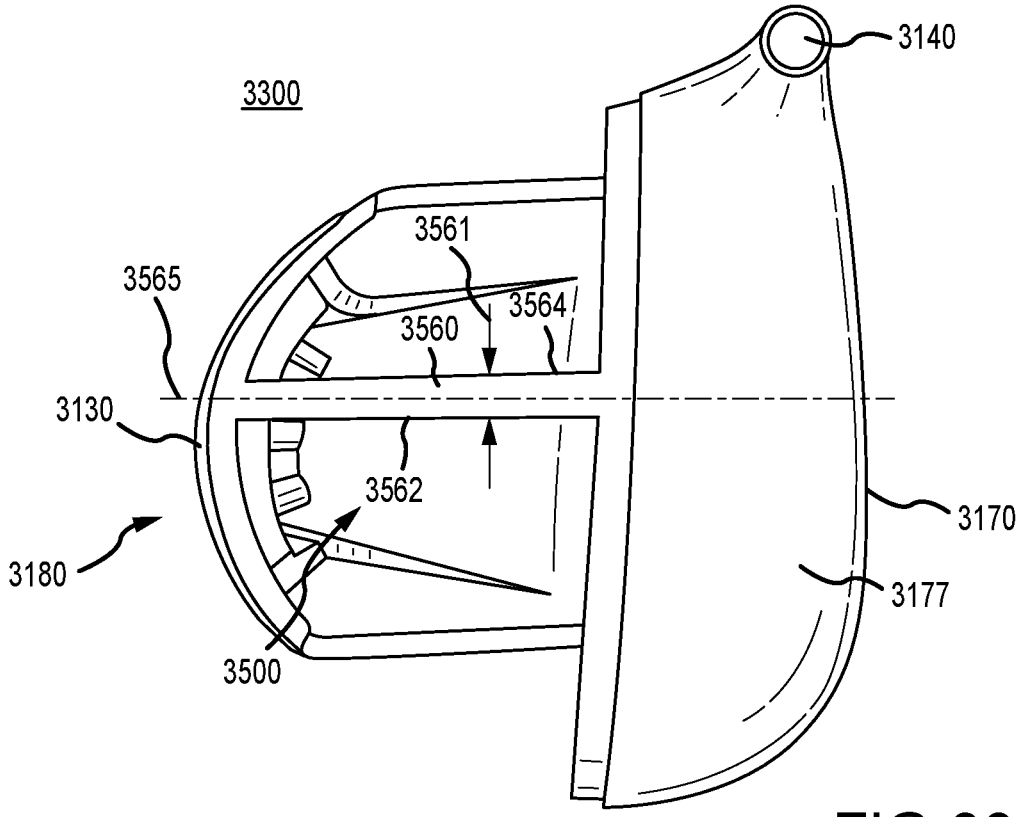
FIG. 39 illustrates a top view of the first component of FIG. 37.
Figure 40:
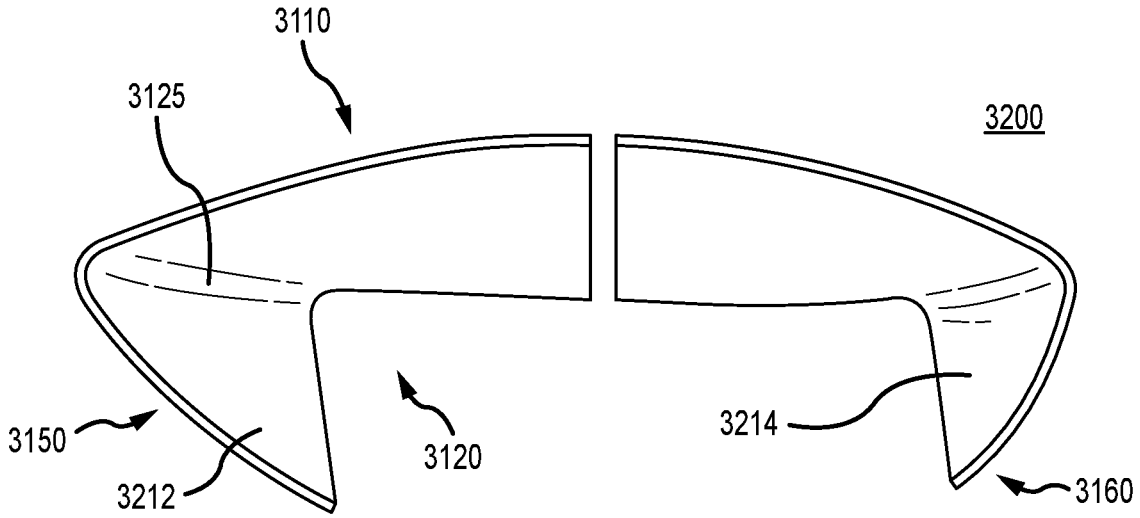
FIG. 40 illustrates a front view of a divided second component of a golf club head, configured to join with the first component of FIG. 37.

Referring to FIG. 39, in some embodiments, the rear edge (2410) of the return portion (2177) can be angled with respect to the XY plane (191). In some embodiments, the rear edge (2410) can be aligned with the intersection plane (2840). In other embodiments, the rear edge (2410) is at least partially curved or angled so that it does not fully align with the intersection plane (2840). In some embodiments, as illustrated in FIG. 40, portions of the rear edge (2410) can be parallel to the XY plane (191), while the intersection plane (2840) remains angled with respect to the XY plane (191). A rear edge angle (2411) can be defined between the intersection plane (2840) and the XY plane (191). The rear edge angle (2411) can range from 0 degrees to 45 degrees. In some embodiments, the rear edge angle (2411) can range from 0 degrees to 10 degrees, 10 degrees to 20 degrees, 20 degrees to 30 degrees, or 30 degrees to 45 degrees. Angling the rear edge (2410) places more mass in either the heel end (2160) or toe end (2150) of the club head (2100).

Referring to FIG. 40, in some embodiments, a portion of the rear edge (2410) is offset from the remainder of the rear edge (2410). For example, a portion of the rear edge (2410) on the toe-ward side of the rear extension (2500) (hereafter "rear edge toe-ward portion (2412)") can be further forward than a second portion of the rear edge (2410) on the heel-ward side of the rear extension (2500) (hereafter "rear edge heel-ward portion (2413)"). The rear edge toe-ward portion (2412) can be offset from the rear edge heel-ward portion (2413) by a distance (2414). In the embodiment illustrated in FIG. 40, the rear edge heel-ward portion (2413) is offset a distance (2414) rearwards from the rear edge toe-ward portion (2412). In other embodiments, the rear edge toe-ward portion (2412) can be offset rearwards from the heel-ward portion (2413). In yet other embodiments, the rear edge (2410) of the return portion (2177) can be arcuate, parabolic, tapered, or shaped to contribute to specific mass properties and/or impact durability of the first component (2300).

Second Component

Figure 29:
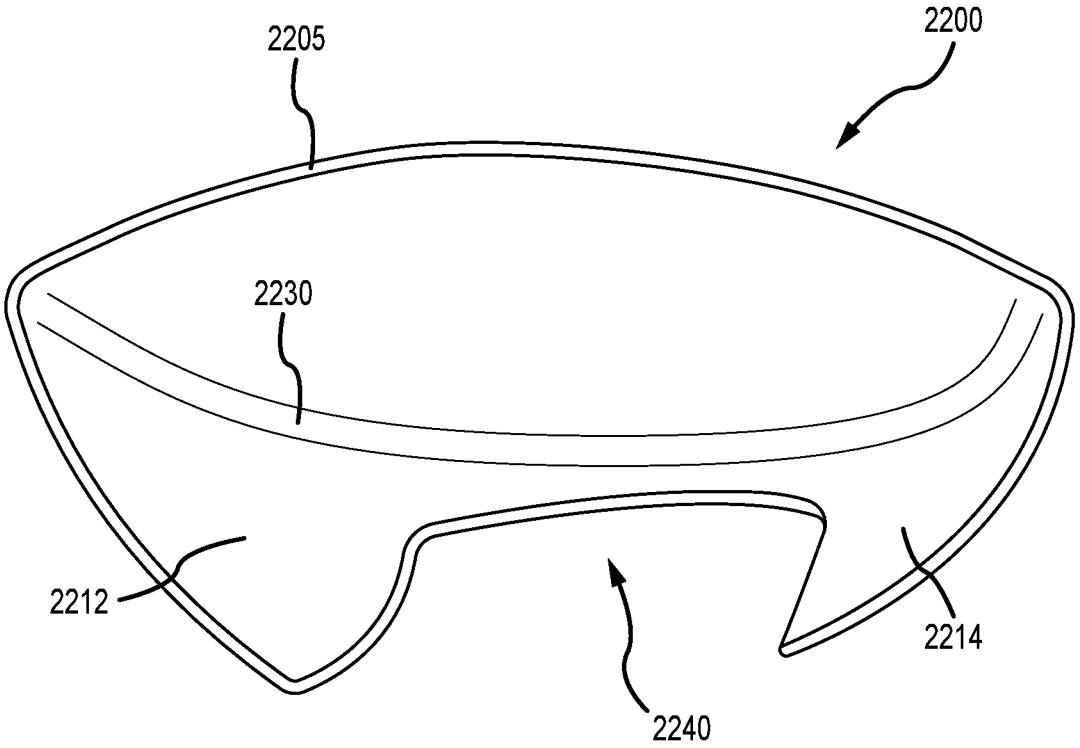
FIG. 29 illustrates a front view the second component of a golf club head, according to an embodiment.
Figure 30:
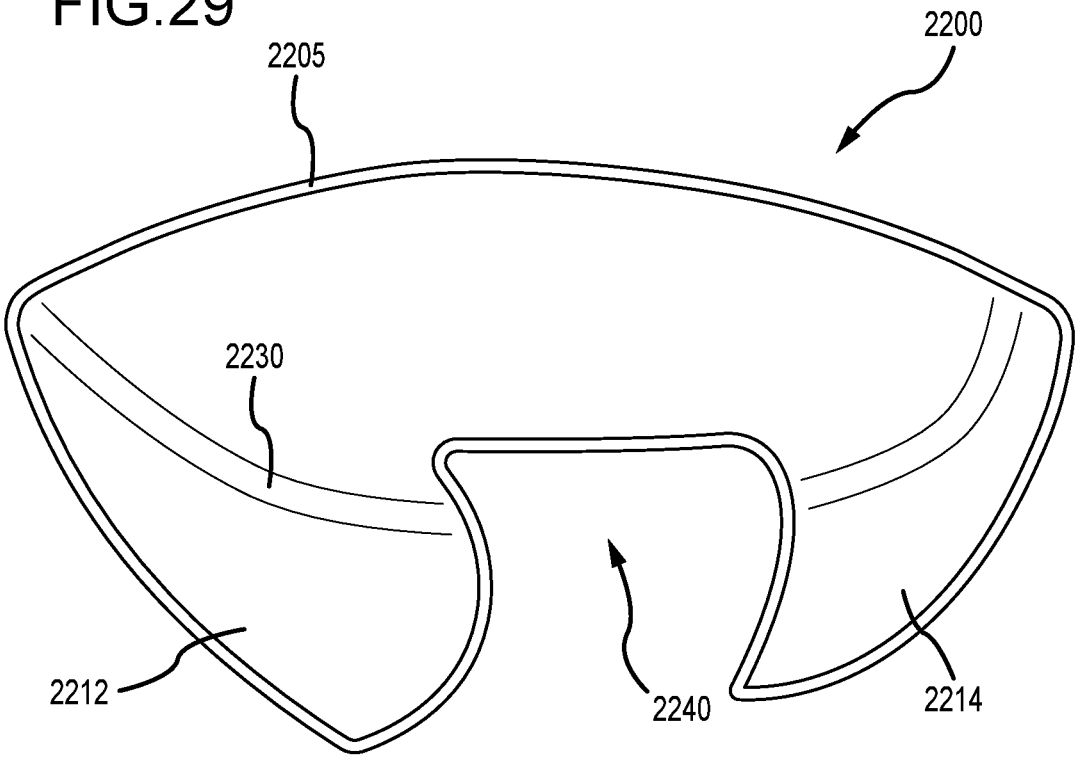
FIG. 30 illustrates a front view the second component of a golf club head, according to an embodiment.

As illustrated in FIGS. 29 and 30, the second component can comprise a crown portion (2205), a trailing edge portion (2230), a sole toe portion (2212), and a sole heel portion (2214). The crown portion (2205) connects the sole toe portion (2212) and the sole heel portion (2214). The trailing edge portion (2230) connects the crown portion (2205) to the sole toe and heel portions (2212 and 2214). The crown portion (2205), sole toe portion (2212) and sole heel portion (2214) define a rear cutout (2240) in the sole side of the second component (2200). In some embodiments, such as the one illustrated in FIG. 29, the rear cutout 2240 cuts into the sole only. In other embodiments, such as the one illustrated in FIG. 30, the rear cutout 2240 cuts into both the sole and the crown portion (2205). The embodiment that cuts into both the sole and the crown portion (2205) allows more room in the rear end (2180) of the club head (2100) for the weight channel (2540) of the first component (2300).

The second component sole toe portion (2212) and sole heel portion (2214) can be dimensioned to correspond to the dimensions of the first component (2300), as illustrated in FIGS. 22-28. For example, the second component sole toe portion (2212) can be roughly the same size as the sole heel portion (2214) when the rear extension (2500) is centrally located, such as in the embodiments of FIG. 22-24. In embodiments where the rear extension axis (2504) is angled with respect to the intersection plane (2840), the sole toe portion (2212) can be either smaller or larger than the sole heel portion (2214), as illustrated in the embodiments of FIGS. 25 and 26.

In some embodiments, the second component (2200) can be secured to the first component (2300) in a way similar to that described above for the first golf club head (100) embodiment. In some embodiments, the materials of the first (2300) and second (2200) components can also be similar to those described above for the first golf club head (100) embodiments.

III) Third Embodiment of Golf Club Head (Includes a Crown Brace and a Split Second Component)

A third embodiment of a golf club head (3100), illustrated in FIGS. 37-41, and FIG. 53, comprises a first component (3300) and a second component (3200) that joins onto the first component (3300). The first component (3300) comprises a sole rear extension (3500) and a crown brace (3560). The first component (3300) of third embodiment golf club head can be similar to the first components (300 and 1300) of golf club heads (100 and 2100), with the exception of the added crown brace (3560). The second component (3200) can comprise a toe portion (3212) and a heel portion (3214). The toe and heel portions (3212 and 3214) can be separate parts. With the exception of the two-part design, the second component (3200) of golf club head can be similar to the second components (200 and 2200) of golf club head (100 and 2100). The golf club head forms a striking face (3170), a return portion (3177), a hosel (3140), a crown (3110), a sole (3120), a heel end (3160), a toe end (3150), and a skirt (3125) having a trailing edge (3130) at a rear-most portion of a rear end (3180). The skirt (3125) can extend along a perimeter of the club head between the crown (3110) and the sole (3120), behind the hosel (3140).

Figure 41:
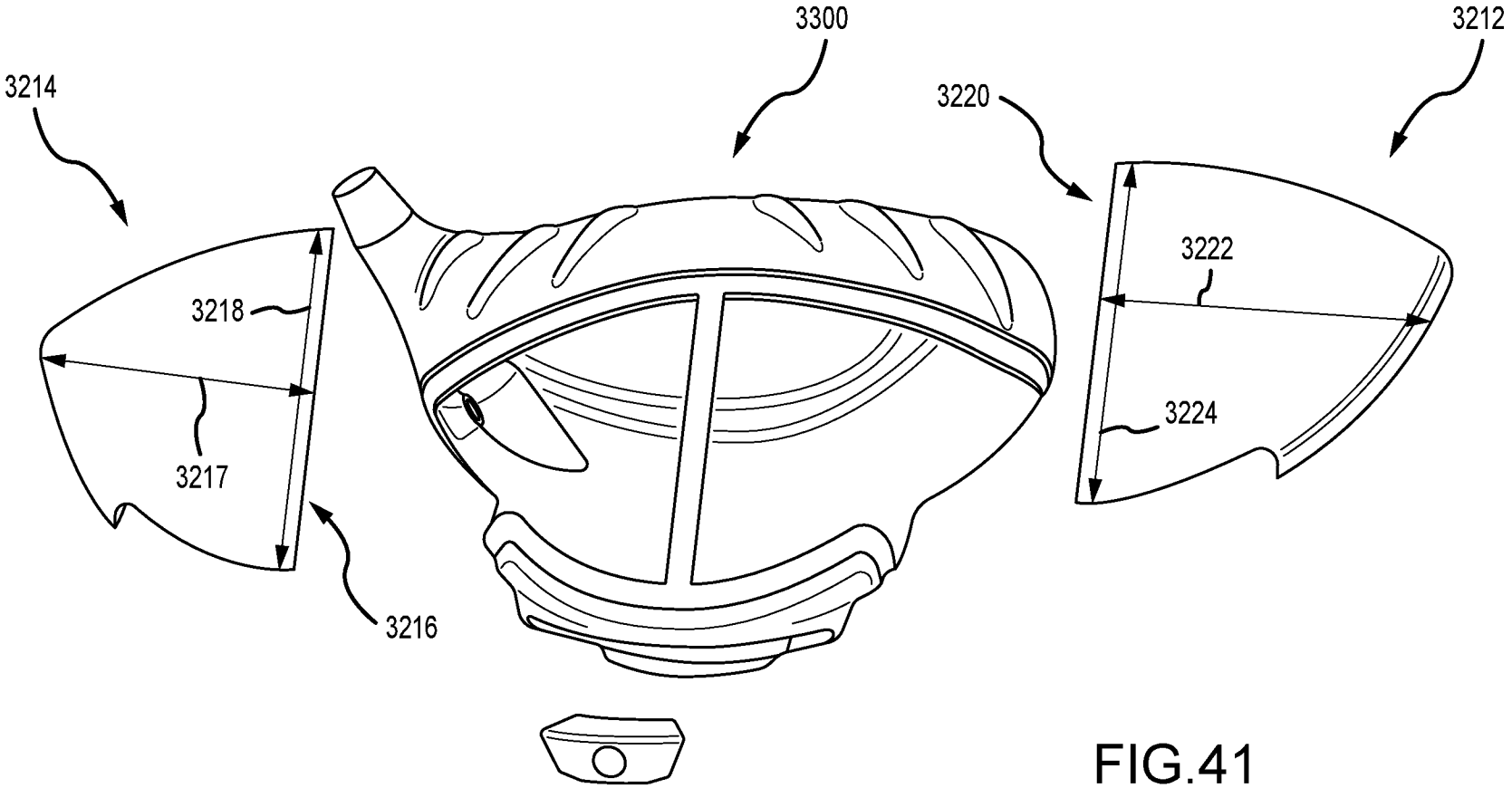
FIG. 41 illustrates an exploded view of a golf club head, according to a third embodiment.

Referring to FIGS. 40 and 41, the second component toe portion (3212) can comprise a toe portion central edge (3220) configured to be positioned along the central portion of the crown (3110) when the golf club head is fully assembled, a toe portion maximum crown width (3222) measured from the toe portion central edge (3220) toward the toe end (3150), and a toe portion maximum crown length (3224) measured from a front end toward the rear end. The second component heel portion (3214) can comprise a heel portion central edge (3216) configured to be positioned along the central portion of the crown (3110) when the golf club head is fully assembled, a heel portion maximum crown width (3217) measured from the heel portion central edge (3216) toward the heel end (3160), and a heel portion maximum crown length (3218) measured from a front end toward the rear end.

The toe portion (3212) and heel portion (3214) may have maximum lengths (3224 and 3218) that are the same. Alternately, the toe portion (3212) and heel portion (3214) may have maximum lengths (3224 and 3218) may vary such that one is larger than the other. The toe portion (3212) and heel portion (3214) may have maximum widths (3222 and 3217) that are the same. Alternately, the toe portion (3212) and heel portion (3214) may have maximum widths (3222 and 3217) may vary such that one is larger than the other. The maximum lengths may be between 3.0 inches and 6.0 inches. The maximum lengths may be 3.0 inches, 3.1 inches, 3.2 inches, 3.0 inches, 3.4 inches, 3.5 inches, 3.6 inches, 3.7 inches, 3.8 inches, 3.9 inches, 4.0 inches, 4.1 inches, 4.2 inches, 4.3 inches, 4.4 inches, 4.5 inches, 4.6 inches, 4.7 inches, 4.8 inches, 4.9 inches, 5.0 inches, 5.1 inches, 5.2 inches, 5.3 inches, 5.4 inches, 5.5 inches, 5.6 inches, 5.7 inches, 5.8 inches, 5.9 inches, or 6.0 inches.

As illustrated in FIGS. 37-39, the first component (3300) of the third embodiment can comprise both a sole rear extension (3500) and a crown brace (3560). The sole rear extension (3500) houses a weight channel (3540) at the rear end (3180). The crown brace (3560) attaches to a forward crown portion (3400) and the sole rear extension (3500). The crown brace (3560) attaches to the sole rear extension (3500) adjacent the weight channel (3540) at the rear end (3180) of the club head. As illustrated in FIG. 39, the crown brace (3560) and the weight channel (3540) of the rear extension (3500) can form a hammerhead shape. In other embodiments, the shape of the crown brace (3560) and rear extension (3500) connection can be filleted, rounded, or otherwise shaped.

The crown brace (3560) can provide support to prevent the sole rear extension (3500) from bending too far upwards when the golf club head impacts a golf ball. Since the weight channel (3540) houses a movable weight (3350), the weight channel (3540) holds a significant amount of mass. The mass of the weight channel (3540) and the weight (3350) are supported by the sole rear extension (3500). However, an impact with a golf ball can cause the weight channel (3540) portion of the rear extension (3500) to bend upwards. This upwards bending of the rear extension (3500) can cause compressive stresses within the crown (3110). In some embodiments, these stresses can cause failure or cracking within the second component (3200) that forms the majority of the crown (3110). The crown brace (3560) can provide support that prevents the stress-causing bending (or clam-shell effect) of the sole rear extension (3500). In other words, the crown brace (3560) can reduce the vibration and oscillation of the weight channel (3540).

In some embodiments, the sole rear extension (3500) and the crown brace (3560) can together be angled, similar to the manner in which the sole rear extensions (500 and 2500) of the golf club heads (100 and 2100) are angled. In some embodiments, the crown brace (3560) is positioned at an angle different than the angle of the sole rear extension (3500).

Referring to FIG. 39, the crown brace (3560) comprises a crown brace longitudinal axis (3565). The crown brace longitudinal axis (3565) bisects the crown brace (3560) along its maximum length. In some embodiments, the crown brace longitudinal axis (3565) can be offset toward the heel end or toe end of the golf club head parallel to the rear extension axis (2504), or, alternately, non-parallel to the rear extension axis (2504) such that crown brace longitudinal axis (3565) forms an acute angle to the rear extension axis (2504).

The crown brace (3560) can comprise a toe-side edge (3562) and a heel-side edge (3564). The crown brace (3560) can comprise a width (3561), measured from the toe-side edge (3562) to the heel-side edge (3564). The crown brace width (3561) can range between 0.05 inch and 0.8 inch. In some embodiments, the crown brace width (3561) can range between 0.05 inch and 0.1 inch, 0.1 inch and 0.2 inch, 0.2 inch and 0.4 inch, 0.3 inch and 0.5 inch, 0.3 inch and 0.6 inch, or 0.4 inch and 0.7 inch. In some embodiments, the crown brace width can be approximately 0.2 inch, 0.25 inch, 0.3 inch, 0.35 inch, 0.4 inch, 0.45 inch, 0.5 inch, 0.55 inch, 0.6 inch, 0.65 inch, 0.7 inch, 0.75 inch, or 0.8 inch. The crown brace width (3561) can affect or determine the mass of the crown brace (3560). To preserve discretionary mass, the crown brace (3560) can be designed to weigh less than 0.6 g, less than 0.5 g, less than 0.4 g, less than 0.3 g, less than 0.2 g, or less than 0.1 g.

Referring to FIGS. 40 and 41, the two portions of the second component (3200) can each comprise portions of the crown (3110), the sole (3120), and the trailing edge (3130). The toe portion (3212) can be configured to fit over and secure to a perimeter lip or ledge of the first component (3300) (not illustrated). In particular, the toe portion (3212) can be configured to engage the rear extension toe-side wall (3522) and overlap the crown brace toe-side wall (3562). The heal portion (3214) can be configured to engage the rear extension heel-side wall (3532) and overlap the crown brace heel-side wall (3564).

Since the second component (3200) comprises two separate portions (3212 and 3214), the second component (3200) can be assembled onto the first component (3300) in two steps. For example, the toe portion (3212) can be slid onto the first component (3300) in a toe-to-heel direction first. The heel portion (3214) can be separately slid onto the first component (3300) in a heel-to-toe direction. The first component (3300) can have more complex geometry because the second component (3200) can be assembled onto the first component from the heel and toe sides, as described in more detail below. The materials of the first (3300) and second (3200) components can be similar to those described above for the first golf club head (100) embodiment.

When the two second component portions (3212 and 3214) are assembled onto the first component, the two portions (3212 and 3214) can be positioned to completely cover the crown brace (3560). Fully covering the crown brace (3560) can ensure a strong bond joint between the two portions (3212 and 3214) and the first component (2300). The two portions (3212 and 3214) can be positioned such that no portion of the crown brace (3560) is exposed to an exterior of the golf club head.

In an alternate embodiment, the club head (3100) can be formed without the crown brace (3560), while still comprising the two second component portions (3212 and 3214). The two second component portions (3212 and 3214) may comprise central edge interior extensions, by which the component portions (3212 and 3214) are connected. The interior extension may extend along the entire central edge of each portion, or may extend along only a portion of the central edge of each portion. The interior extensions may extend inwardly, toward the golf club head interior, parallel to each other and approximately parallel to the Y-axis. The heel portion (3214) may have an heel portion interior extension (3234). The toe portion (3212) may have a toe portion interior extension (3232). The interior extensions may each have an interior extension length between 0.1 inch and 1.0 inch. The interior extension length may be 0.1 inch, 0.2 inch, 0.3 inch, 0.4 inch, 0.5 inch, 0.6 inch, 0.7 inch, 0.8 inch, 0.9 inch, or 1.0 inch.

Figure 42:
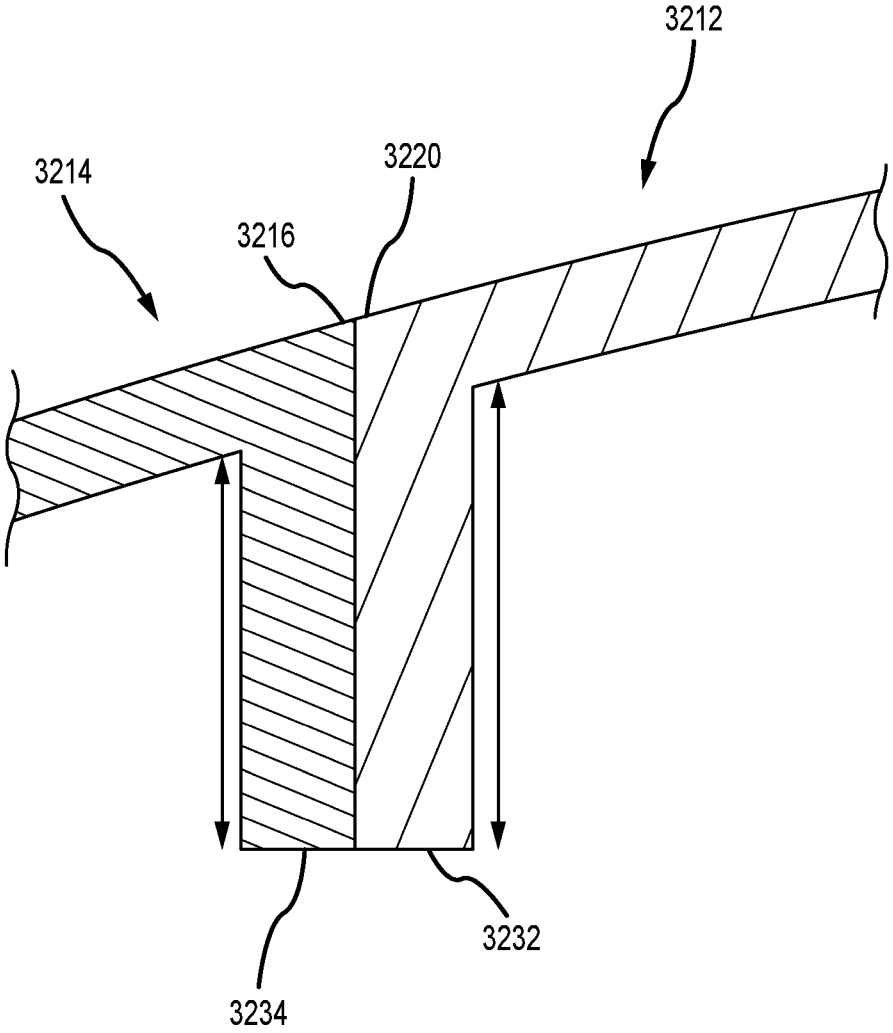
FIG. 42 illustrates second portion interior extensions of an alternate golf club head embodiment.

Referring to FIG. 42, in some embodiments the interior extensions (3232 and 3234) may positioned to abut one another when the golf club head is assembled. The interior extension (3232 and 3234) may be mechanically affixed to one another with mechanical fasteners or press fit fasteners, or they may be adhesively affixed via epoxies or other appropriate adhesives.

In another alternate embodiment, the golf club head (3100) can be formed with a single, unitary second component, similar to the second components (200 and 2200) described above for the first and second embodiments (100 and 2100), rather than two separate second component portions. This alternate embodiment can comprise the crown brace (3560), which helps support the weight channel (3540) and the single second component.

IV) Fourth Embodiment of Golf Club Head (Including Two or More Braces)

A fourth embodiment of a golf club head (4100), comprises a first component (4300) and a second component (not shown) that joins onto the first component (4300). In this fourth embodiment, the first component (4300) can have more than one brace, support, bridge, or span extending between a forward crown portion (4400) and the sole rear extension (4500). The braces can reduce the vibration and oscillation of the rear end of the club head, increasing durability. The second component (not shown) of the fourth embodiment, can be a single, unitary second component, similar to second component (200 or 2200), or can be a split (divided) second component, similar to second component (3200).

The golf club head (4100) can be similar to the golf club heads (100, 2100, and 3100), described above. Although the full golf club head (4100) is not shown in FIGS. 43-56, the golf club head (4100) can form the same components as the golf club heads (100, 2100, and 3100) described above. The golf club head (4100) forms a striking face (4170, similar to 170, 2170, 3170), a return portion (similar to 177, 2177, 3177), a hosel (4140, similar to 140, 2140, 3140), a crown (similar to 110, 2110, 3110), a sole (similar to 120, 2120, 3120), a heel end (similar to 160, 2160, 3160), a toe end (similar to 150, 2150, 3150), and a skirt (similar to 125, 2125, 3125) having a trailing edge (similar to 130, 2130, 3130) at a rear-most portion of a rear end (4180, similar to 180, 2180, 3180).

As illustrated in FIGS. 43-56, the golf club head (4100) can comprise a first component (4300) with various brace configurations. All variations of the first component (4300) comprise the striking face (4170), a forward crown portion (4400), a forward sole portion (4810), and a sole rear extension (4500) connected to the forward sole portion (4810). The rear extension (4500) can comprise a toe side edge (4522), a heel-side edge (4532), and a weight channel (4540) configured to allow the mounting of a movable weight (4350) at the trailing edge (4130) of the golf club head (4100). The weight channel (4540) and movable weight (4350) can be similar, respectively, to the weight channels (2540, 3540) and movable weight (2350, 3350) of golf club heads (2100, 3100), as described above, primarily with reference to FIGS. 17-21 and 41. The first component (4300) can also comprise a peripheral lip (4450), which is offset inwards around the edges of the forward crown portion (4400), the forward sole portion (4810), and the sole rear extension (4500). The peripheral lip (4450) can be similar to a shelf and can act as a lap joint when the second component (4200) is attached to the first component (4300). The braces can reduce impact-induced vibrations or oscillations of the weight channel (4540) at the rear end (4180), thereby reducing the stress experienced across the lap joint. Reducing the stress at the lap joint increases the durability of the lap joint bond and helps prevent delamination.

All the variations of the first component (4300) can also comprise two or more braces (also called supports, bridges, spans, or connection members). The two or more braces can provide stability to the weight channel (4540), reducing oscillations and vertical displacement of the rear weight channel after the golf club head (4100) impacts a golf ball. The two or more braces can also increase the side-to-side rigidity of the rear extension (4500) of the first component (4300).

Figure 43:
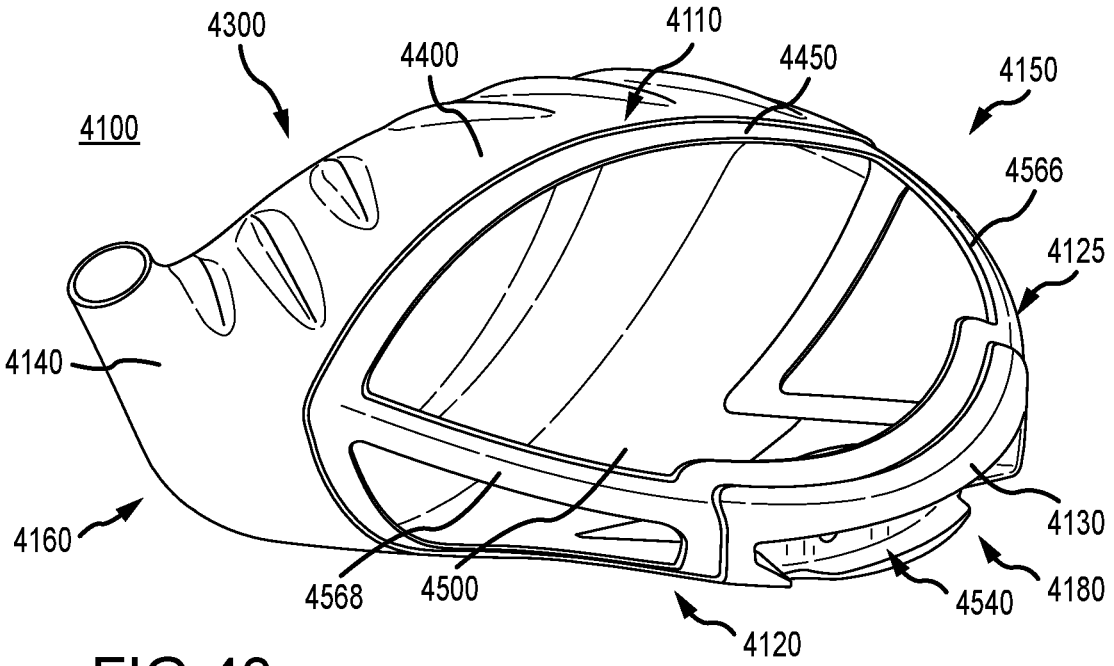
FIG. 43 illustrates a perspective view of a golf club head, according to a fourth embodiment variation with toe and heel skirt braces.
Figure 44:
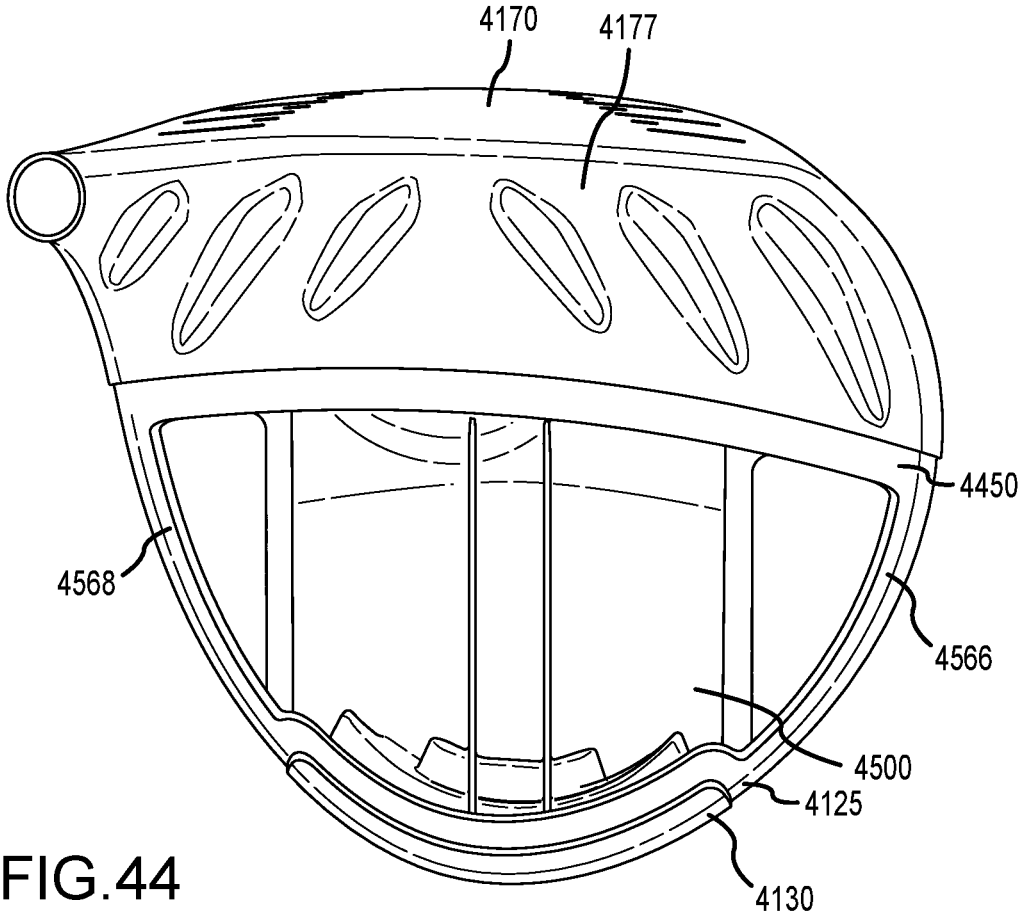
FIG. 44 illustrates a top view of the golf club head of FIG. 43.

In the variation illustrated in FIGS. 43 and 44, the first component (4300) comprises a toe skirt brace (4566) and a heel skirt brace (4568). The toe skirt brace (4566) can extend from the return portion to the rear end of the club head. More specifically, the toe skirt brace (4566) can extend from the forward crown and sole portions (4400 and 4810) to the rear extension (4500) at the trailing edge of the club head (4100). The toe skirt brace (4566) and the heel skirt brace (4568) are configured to sit at the same level as a the peripheral lip (4450) of the first component (4300). In other words, the toe and heel skirt braces (4566 and 4568) can be flush with the peripheral lip (4450). The second component (4200) can fit over and fully cover the toe and skirt braces (4566 and 4568) when the club head (4100) is assembled.

Figure 45:
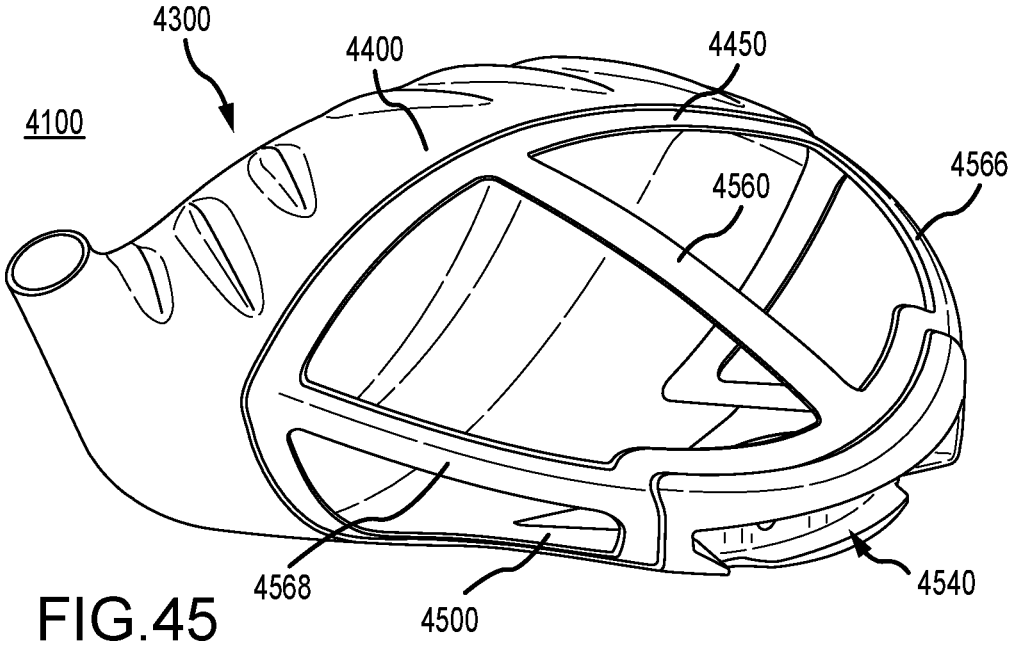
FIG. 45 illustrates a perspective view of a gold club head, according to a fourth embodiment variation with toe and heel skirt braces and a crown brace.
Figure 46:
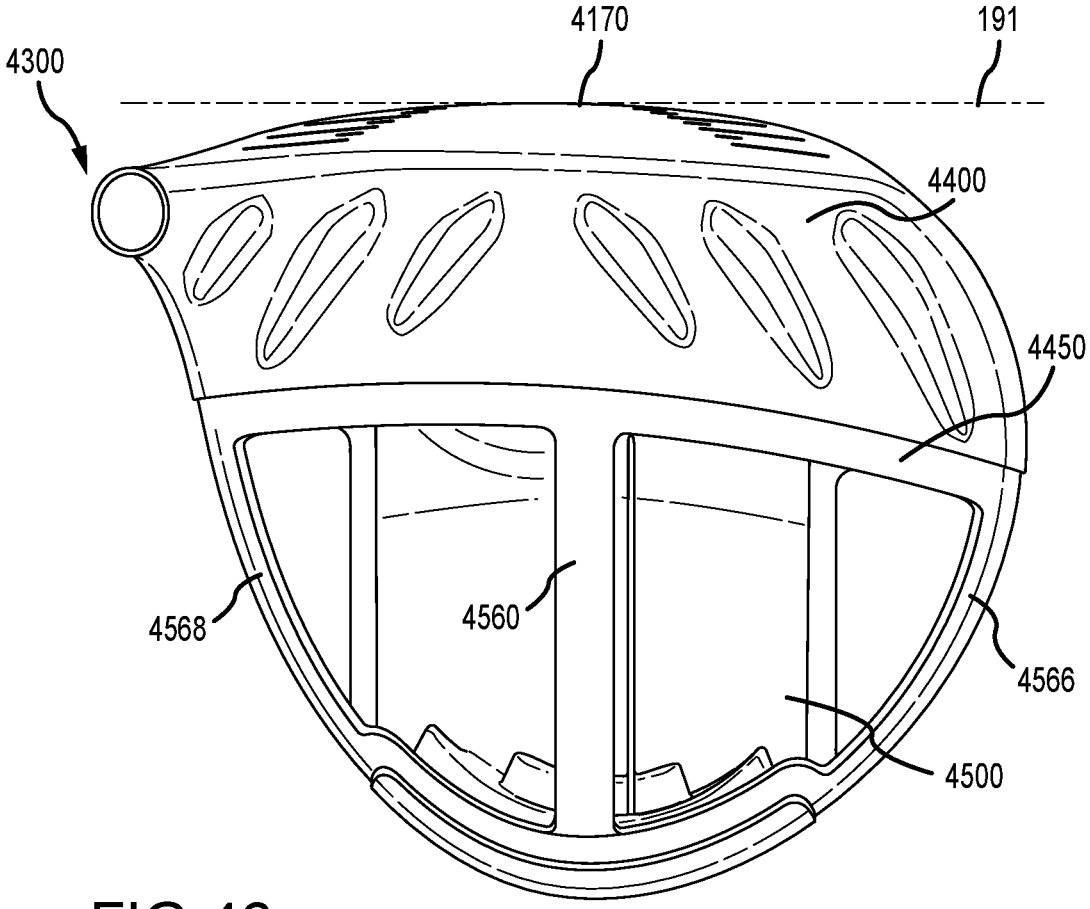
FIG. 46 illustrates a top view of the golf club head of FIG. 45.

In the variation illustrated in FIGS. 45 and 46, the first component (4300) comprises a toe skirt brace (4566), a heel skirt brace (4568), and a central crown brace (4560). The toe skirt brace (4566) and the heel skirt brace (4568) can be similar to the toe and skirt braces (4566 and 4568), described above for the variation of FIGS. 43 and 44. The crown brace (4560) can be similar to the crown brace (3560), described above for golf club head (3100), illustrated in FIGS. 37-42. The central crown brace (4560) can extend from the forward crown portion (4400) to the rear extension (4500) at the trailing edge of the club head (4100). The central crown brace (4560) can be positioned approximately half way between the toe end (4150) and the heel end (4160) of the club head (4100). From a top view, such as FIG. 46, the central crown brace (4560) can be approximately perpendicular to the XY plane (191). The orientation of the central crown brace (4560) can approximately bisect the sole rear extension (4500).

Figure 47:
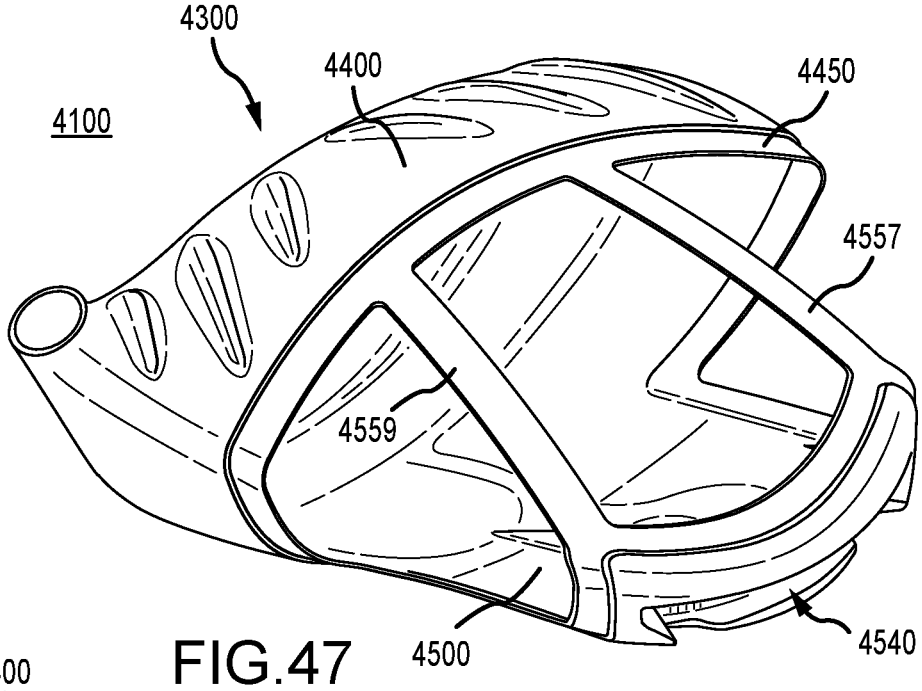
FIG. 47 illustrates a perspective view of a golf club head, according to a fourth embodiment variation with toe and heel side crown braces attached to sides of the sole extension.
Figure 48:
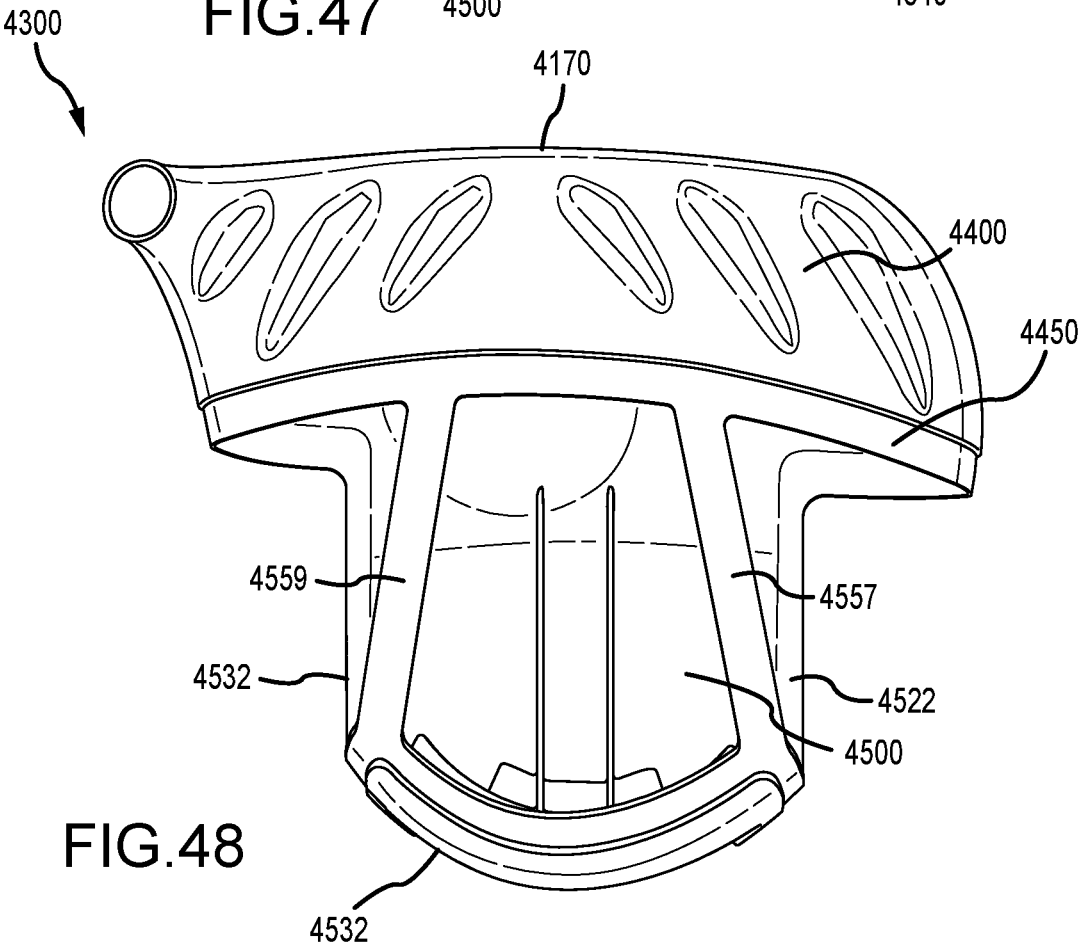
FIG. 48 illustrates a top view of the golf club head of FIG. 47.

The variation illustrated in FIGS. 47 and 48 comprises a toe-side brace (4557) and a heel-side brace (4559), both connected to outer edges of the rear extension (4500). The toe-side brace (4557) can extend rearward from the forward crown portion (4400) and attach to the rear extension (4500) toe-side edge (4522) at the trailing edge (4532) of the club head (4100). Similarly, the heel-side brace (4557) can extend rearward from the forward crown portion (4400) and attach to the rear extension (4500) heel-side edge (4532) at the trailing edge (4130) of the club head (4100). The toe-side and heel-side braces (4557 and 4559) can be attached to the forward crown portion (4400) at positions that roughly divide the forward crown portion (4400) into thirds, from a top view. In other words, from a top view, the toe-side and heel-side braces (4557 and 4559) are attached to the forward crown portion (4400) such that when measuring along a rear edge of the forward crown portion (4400): the distance between the toe end (4150) of the club head (4100) and the toe-side brace (4557) is approximately equal to the distance between the toe-side brace (4557) and the heel-side brace (4559), which is also approximately equal to the distance between the heel-side brace (4559) and the heel end (4160) of the club head (4100).

The toe and heel-side braces (4557 and 4559) can be separated by a greater distance towards the trailing edge (4130) at the rear end (4180) of golf club head (4100), as illustrated in the top view of FIG. 48. From a top view, the toe and heel-side braces (4557 and 4559) can be within the footprint of the sole rear extension (4500).

Figure 49:
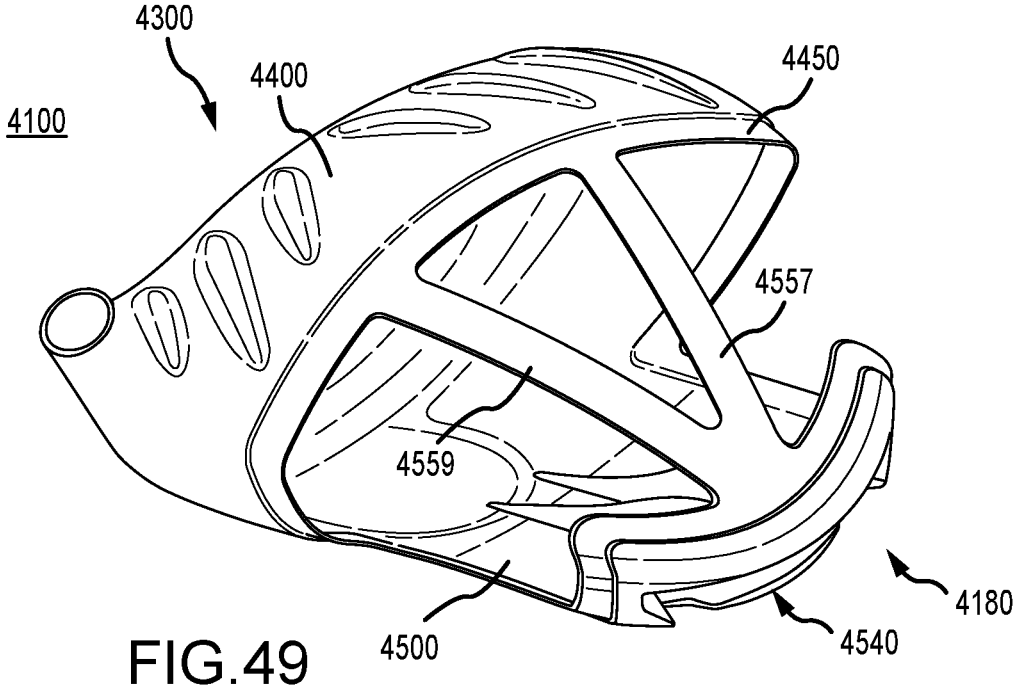
FIG. 49 illustrates a perspective view of a golf club head, according to a fourth embodiment variation with toe and heel side crown braces attached to a center of the sole extension.
Figure 50:
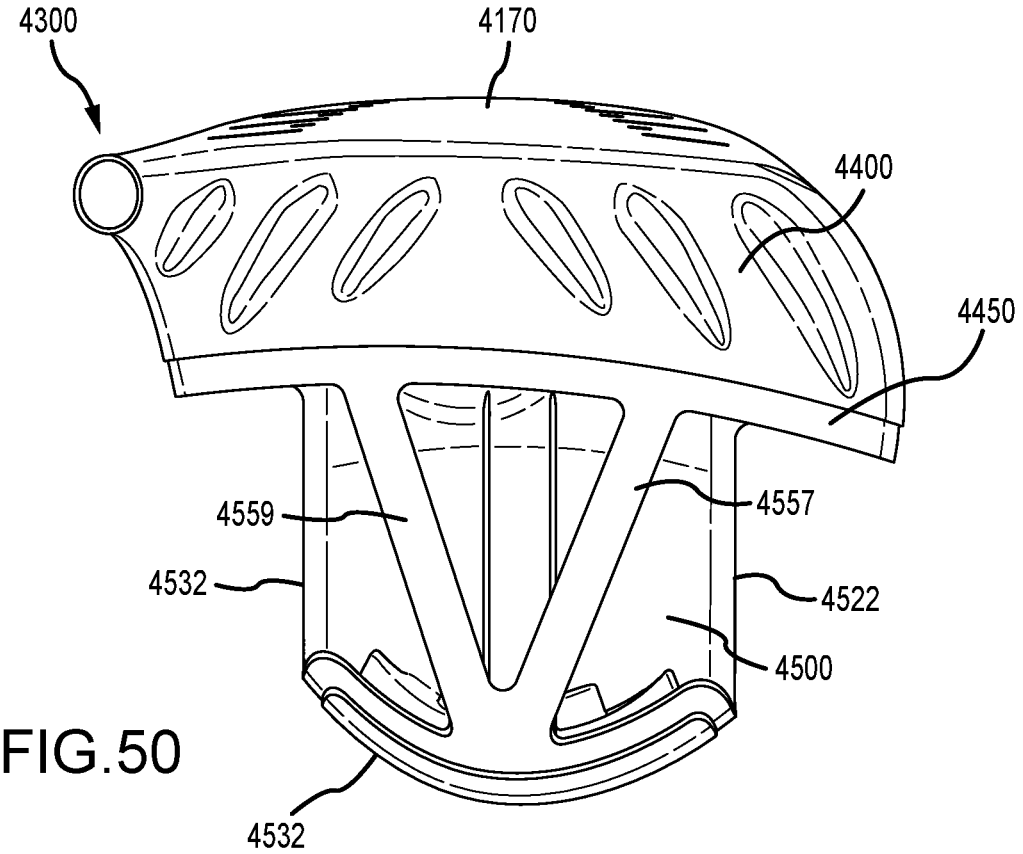
FIG. 50 illustrates a top view of the golf club head of FIG. 49.

The variation illustrated in FIGS. 49 and 50 comprises a toe-side brace (4557) and a heel-side brace (4559), both connected to a center of the rear extension (4500). The toe-side and heel-side braces (4557 and 4559) can be attached to the forward crown portion (4400) at positions that roughly divide the forward crown portion (4400) into thirds, from a top view, as described above for the variation of FIGS. 47 and 48. However, in the variation of FIGS. 49 and 50, the toe-side and heel-side braces (4557 and 4559) are separated by a lesser distance towards the trailing (4130) at the rear end (4180) of the golf club head (4100). The toe-side brace (4557) can join with the heel-side brace (4559) prior to or at the connection with the rear extension (4500) at the rear end (4180). The toe-side and heel-side braces (4557 and 4559) can form a V-shaped pattern from a top view, as illustrated in FIG. 50.

Figure 51:
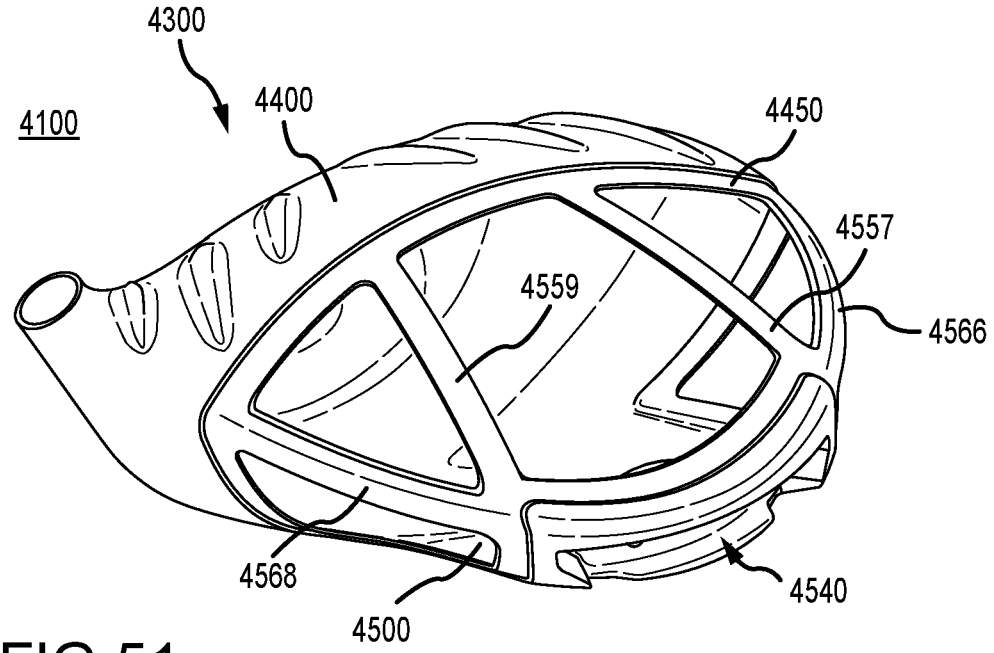
FIG. 51 illustrates a perspective view of a golf club head, according to a fourth embodiment variation with toe and heel side crown braces attached to sides of the sole extension and toe and heel side skirt braces.
Figure 52:
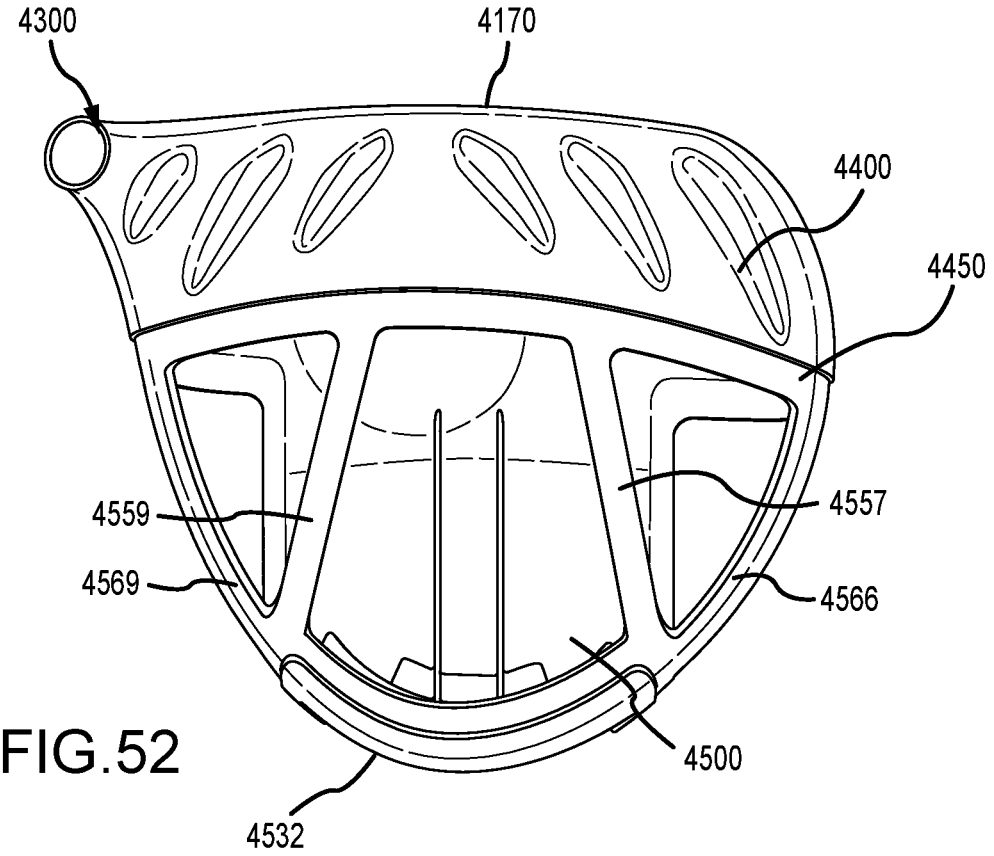
FIG. 52 illustrates a top view of the golf club head of FIG. 51.

The variation illustrated in FIGS. 51 and 52 comprises four braces: a toe-side brace (4557), a heel-side brace (4559), a toe skirt brace (4566), and a heel skirt brace (4568). The toe and heel-side braces (4557 and 4559) of the FIGS. 51 and 52 variation can be similar to the toe and heel side braces of the FIGS. 47 and 48 variation, described above. The toe and heel skirt braces (4566 and 4568) of the FIGS. 51 and 52 variation can be similar to the toe and heel skirt braces of the FIGS. 43 and 44 variation, described above.

Figure 53:
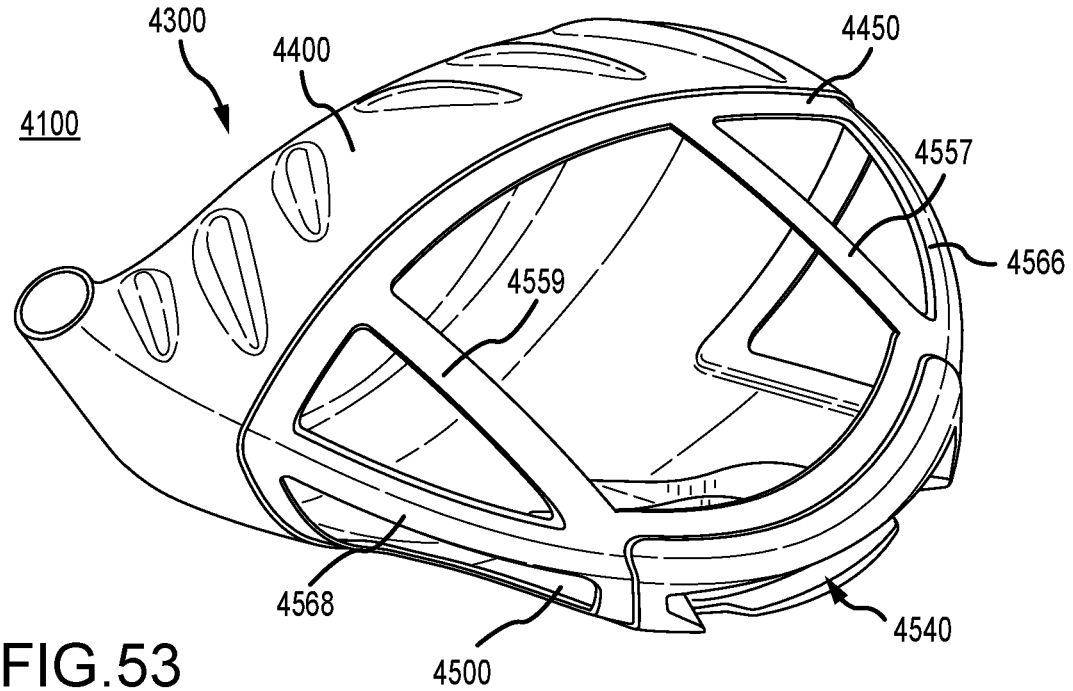
FIG. 53 illustrates a perspective view of a golf club head, according to a fourth embodiment variation with parallel toe and heel side crown braces attached to sides of the sole extension and toe and heel side skirt braces.
Figure 54:
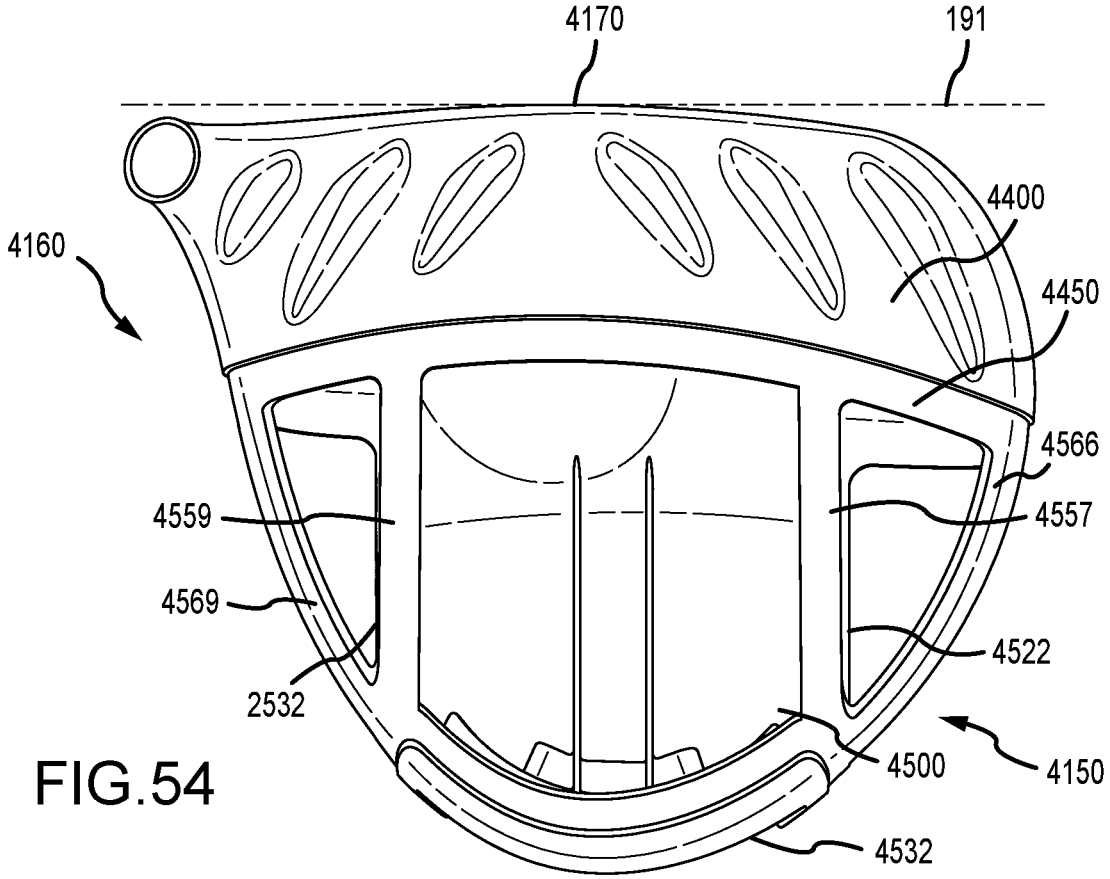
FIG. 54 illustrates a top view of the golf club head of FIG. 53.

The variation illustrated in FIGS. 53 and 54 comprises four braces: a toe-side brace (4557), a heel-side brace (4559), a toe skirt brace (4566), and a heel skirt brace (4568). The toe and heel-side braces (4557 and 4559) of the FIGS. 53 and 54 variation can extend from the forward crown portion (4400) to the rear extension (4500) at the trailing edge (4130) of the club head rear end (4180). From a top view, the toe-side brace (4557) and the heel-side brace (4559) can be oriented roughly perpendicular to the XY plane (191). In some embodiments, the toe-side and heel-side braces (4557 and 4559) can be aligned so that their top view footprint approximately follows the edges (4522 and 4532) of the sole rear extension (4500).

Referring to FIGS. 53 and 54, in some embodiments, when measuring along a rear edge of the forward crown portion (4400), a distance between the toe end (4150) and the toe-side brace (4557) can be less than a distance between the heel-side brace (4559) and the heel end (4160). In other embodiments, when measuring along the rear edge of the forward crown portion (4400), a distance between the toe end (4150) and the toe-side brace (4557) can be approximately equal to a distance between the heel-side brace (4559) and the heel end (4160). Both the distance between the toe end (4150) and the toe-side brace (4557) and the distance between the heel end (4160) and the heel-side brace (4559) can be less than the distance between the toe-side brace (4557) and the heel-side brace (4559).

Figure 55:
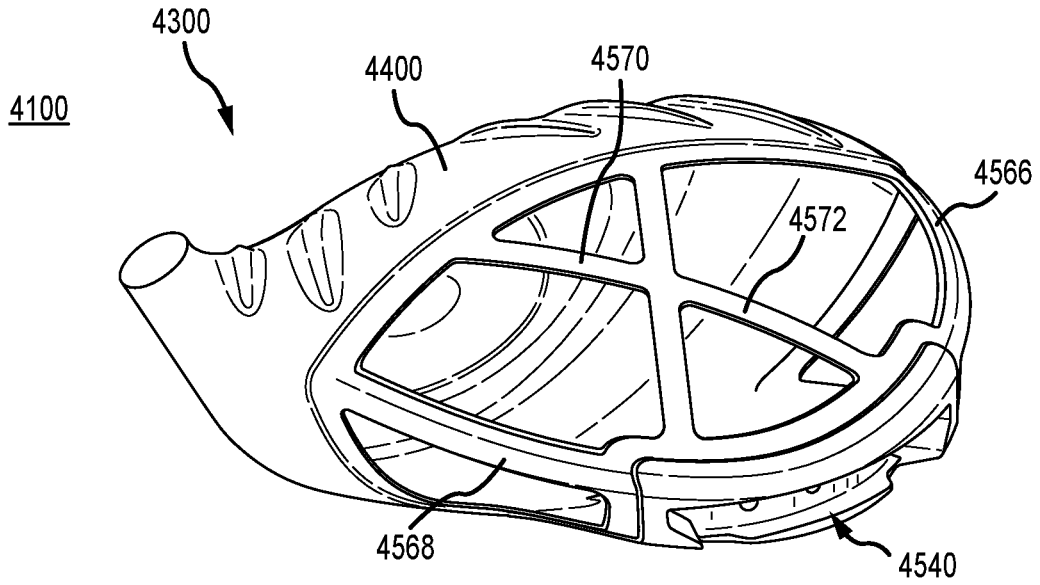
FIG. 55 illustrates a perspective view of a golf club head, according to a fourth embodiment variation with crisscrossing crown braces and toe and heel side skirt braces.
Figure 56:
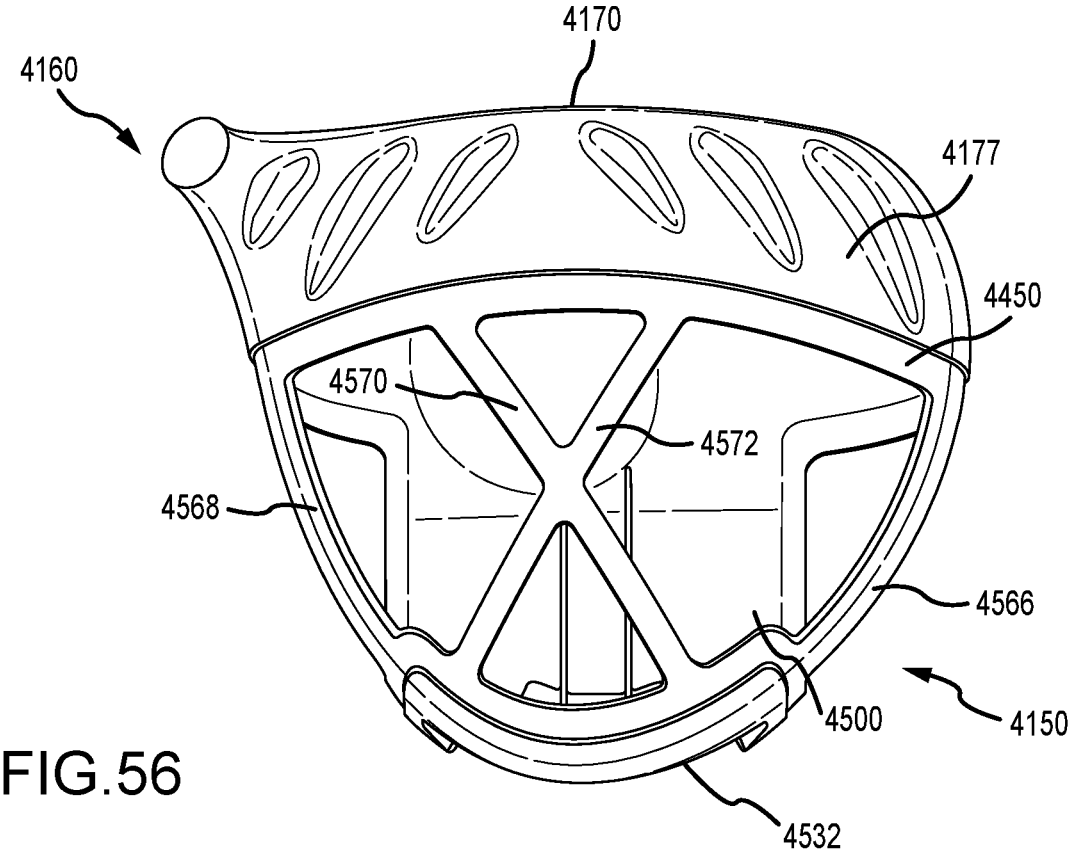
FIG. 56 illustrates a top view of the golf club head of FIG. 55.

The variation illustrated in FIGS. 55 and 56 comprises two crisscrossing braces: a first brace (4570) and a second brace (4572). The first brace (4570) extends from a heel-side half of the forward crown portion (4400) to a toe-side half of the rear extension (4500) at the trailing edge (4130) of the rear end (4180). The second brace (4572) extends from a toe-side half of the forward crown portion (4400) to a heel-side half of the rear extension (4500) at the trailing edge (4130) of the rear end (4180). The first and second brace (4570 and 4572) intersect and crisscross each other. In the illustrated embodiment of FIG. 56, the first and second brace (4570 and 4572) crisscross at approximately halfway between the forward crown portion (4400) and the rear extension (4500) adjacent the trailing edge (4130). The crisscrossing braces (4570 and 4572) can form an X-shape or an hourglass shape when viewed from a top view. In some embodiments, the crisscrossing braces (4570 and 4572) are shifted towards the toe end (4150) or the heel end (4160) to achieve the desired structural support.

Any of the aforementioned braces can comprise a thickness. The brace thickness, measured from an outer surface of the brace to an inner surface of the brace, can be between approximately 0.015 inch and 0.035 inch. In some embodiments, the brace thickness can be 0.015 inch, 0.016 inch, 0.017 inch, 0.018 inch, 0.019 inch, 0.020 inch, 0.021 inch, 0.022 inch, 0.023 inch, 0.024 inch, 0.025 inch, 0.026 inch, 0.027 inch, 0.028 inch, 0.029 inch, 0.030 inch, 0.031 inch, 0.032 inch, 0.033 inch, 0.034 inch, or 0.035 inch. The braces located on the crown (not the skirt braces) can comprise a width similar to the crown brace width (3561), described above for club head (3100).

Any of the aforementioned braces can comprise a brace width, similar to the crown brace width (3561), described above. The width of each brace can affect or determine the mass of the brace. To preserve discretionary mass, the braces within the club head (4100) can be designed to together have a total weight that is less than 0.6 g, less than 0.5 g, less than 0.4 g, less than 0.3 g, less than 0.2 g, or less than 0.1 g. In some embodiments, the total weight of the braces equals 0.6 g, 0.5 g, 0.4 g, 0.3 g, 0.2 g, or 0.1 g. Therefore, in some cases, in embodiments having more braces, the brace width can be less than the brace width within embodiments having less braces.

The two or more braces, described above, can increase the durability of the golf club head. More specifically, the braces can reduce the potential vertical oscillation of the weight channel (4540) of the sole rear extension (4500). The braces can also reduce sideways movement of the weight channel (4540). In club heads lacking the herein described braces, the impact forces experienced when the golf club head (4100) strikes a golf ball can induce vibration and oscillation of the rear extension because of the high concentration of weight within the weight channel and movable weight. A vertical displacement of the trailing edge (4130) of the rear extension (4500) can be measured in simulations to quantify the potential oscillations. A higher vertical displacement at impact corresponds to a lower durability, since oscillations of a greater amplitude can cause material fatigue. The braces described above reduce the vertical displacement of the trailing edge (4130) at impact and thus increase the durability of the club head (4100).

The two or more braces, described above, can define or form boundaries of openings in the first component (4300). The openings can also be called voids, areas devoid of material, or empty regions. The two or more braces can define three, four, five, six, or more openings in the first component (4300). In the variation of FIGS. 43 and 44, the toe and heel skirt braces (4566 and 4568) form part of a boundary of a crown opening, part of a boundary of a toe sole opening, and part of a boundary of a heel sole opening. The rear extension (4500) and the striking face return also form part of the boundary of the toe and heel sole openings. In the variation of FIGS. 45 and 46, the toe and heel skirt braces (4566 and 4568) and the forward crown portion (4400) surround and define two crown openings, separated by the central crown brace (4560). The variation of FIGS. 45 and 46 can have toe and heel sole openings, similar to the variation of FIGS. 43 and 44.

In the variations of FIGS. 47 and 48, the toe and heel-side braces (4557 and 4559) define a central crown opening and two side openings. The crown openings cross the skirt and each cover a portion of the crown and a portion of the sole. The variation of FIGS. 49 and 50 is similar, except that the central crown opening has an approximately triangular shape. In the variations of FIGS. 51-54, the braces define five openings. The skirt braces (4566 and 4568), crown braces (4557 and 4559), rear extension (4500), and forward crown portion (4400) define three crown openings. The skirt braces (4566 and 4568), the striking face return, and the sole extension (4500) define a toe sole opening and a heel sole opening.

In the variation of FIGS. 55 and 56, the braces define six openings. The crisscrossing braces (4570 and 4572) define a front triangular opening and a rear triangular opening. The forward crown portion (4400) and the crisscrossing braces form (4570 and 4572) form edges of the front triangular opening. The rear extension (4500) and the crisscrossing braces form (4570 and 4572) form edges of the rear triangular opening. A toe side crown opening and a heel side crown opening are formed between the central crisscrossing braces (4570 and 4572) and the toe and heel skirt braces (4566 and 4568). Additionally, the skirt braces (4566 and 4568), the striking face return, and the sole extension (4500) define a toe sole opening and a heel sole opening.

During and just after impact with a golf ball, the rear weight (4350) and weight channel (4540) of the first component (4300) can deflect vertically relative to the remainder of the golf club head (4100). For a first component without any braces, a 30 gram to 35 gram rear weight (4350) can deflect over 0.3 inch, without the additional support of the second component (4200). For a first component (4300) with two or more braces, a 30 gram to 35 gram rear weight (4350) can deflect by a maximum of between 0.03 inch and 0.20 inch, without the additional support of the second component (4200). In some embodiments, the rear weight (4350) can deflect by a maximum of between 0.03 inch and 0.06 inch, 0.04 inch and 0.07 inch, 0.05 inch and 0.08 inch, 0.05 inch and 0.10 inch, 0.10 inch and 0.15 inch, or 0.15 inch and 0.20 inch. In some embodiments, the rear weight (4350) can deflect by a maximum of about less than 0.3 inch, less than 0.2 inch, less than 0.18 inch, less than 0.16 inch, less than 0.14 inch, less than 0.12 inch, less than 0.10 inch, less than 0.08 inch, less than 0.06 inch, less than 0.04 inch, or less than 0.02 inch.

In some embodiments, having two crown braces and no skirt braces, a 30 gram to 35 gram rear weight (4350) can deflect (vertically relative to the remainder of the club head) by a maximum of between 0.09 inch and 0.18 inch or between 0.10 inch and 0.15 inch, even without the additional support of the second component (4200). In some embodiments, having two skirt braces and no crown braces, the rear weight (4350) can deflect by a maximum of between 0.10 inch and 0.20 inch. In some embodiments, having two skirt braces and at least one crown brace, the rear weight (4350) can deflect by a maximum of between 0.03 inch and 0.10 inch or by less than 0.10 inch, less than 0.08 inch, less than 0.07 inch, or less than 0.06 inch. In some embodiments, variations with parallel toe and heel side braces provide greater support (less deflection) than variations with criss-crossing or angled (non-parallel) braces.

V) Fifth Embodiment of Golf Club Head

A fifth embodiment of a golf club head (5100), illustrated in FIGS. 53-56 comprises a first component (5300) with a weight channel (5540) and a sole aperture (5555), a second component (5200) that joins onto the first component (5300), and a sole panel (5556) that covers the sole cavity (5555) in the first component (5300). The first component (5300) of the fifth embodiment golf club head (5100) can be similar to the first components (300 and 1300) of golf club heads (100 and 2100), with the exception of the sole aperture (5555). The second component (5200) of golf club head (5100) can be similar to the second component of golf club head (100), described above. The second component (5200) of golf club head (5100) can be similar to the second component of golf club head (100), described above. The golf club head (5100) forms a striking face (5170), a return portion (5177), a hosel (5140), a crown (5110), a sole (5120), a heel end (5160), a toe end (5150), a trailing edge (5130) at a rear-most portion of a rear end (5180), a hosel (5140), and a sole portion hosel adaptor attachment recess (5195).

Figure 57:
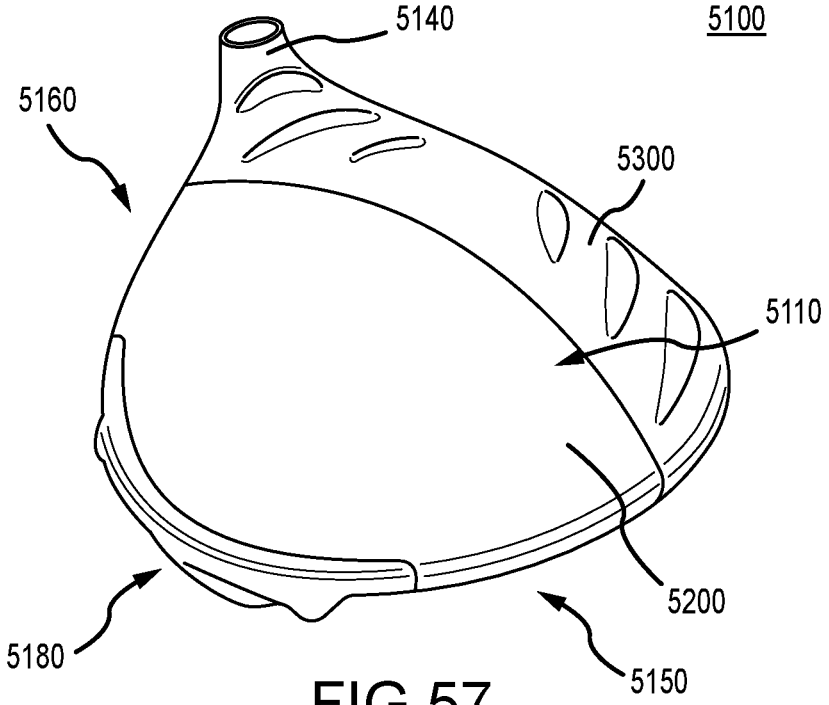
FIG. 57 illustrates a top perspective view of a golf club head, according to a fifth embodiment.
Figure 58:
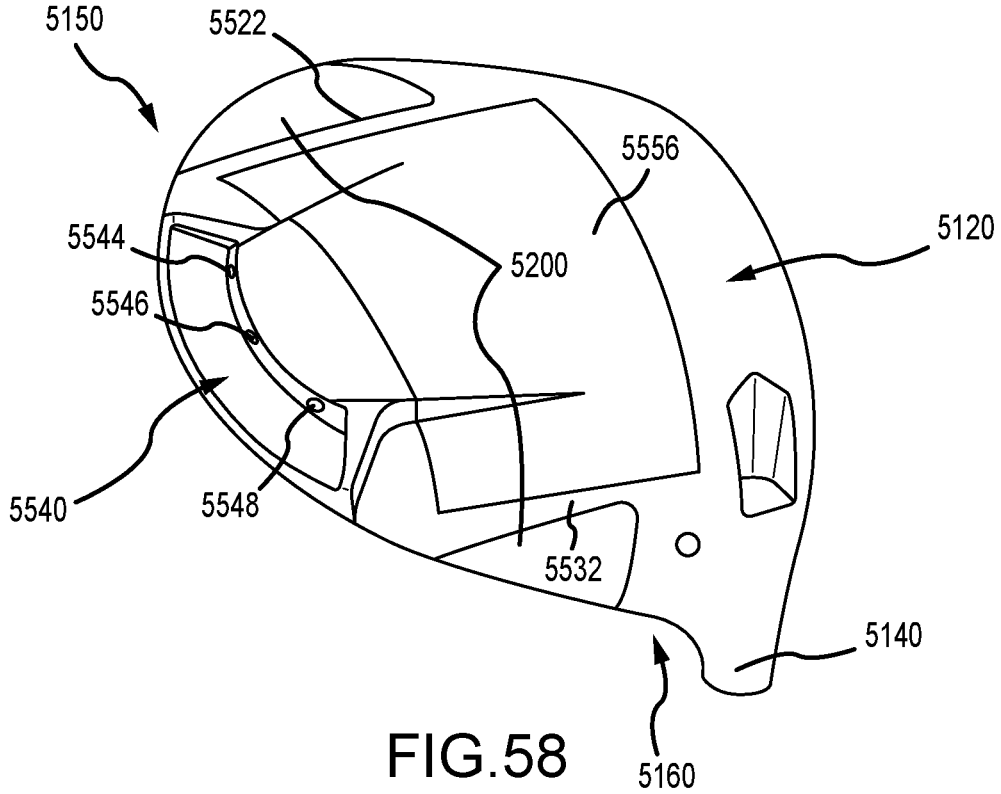
FIG. 58 illustrates a sole perspective view of the golf club head of FIG. 53.
Figure 59:
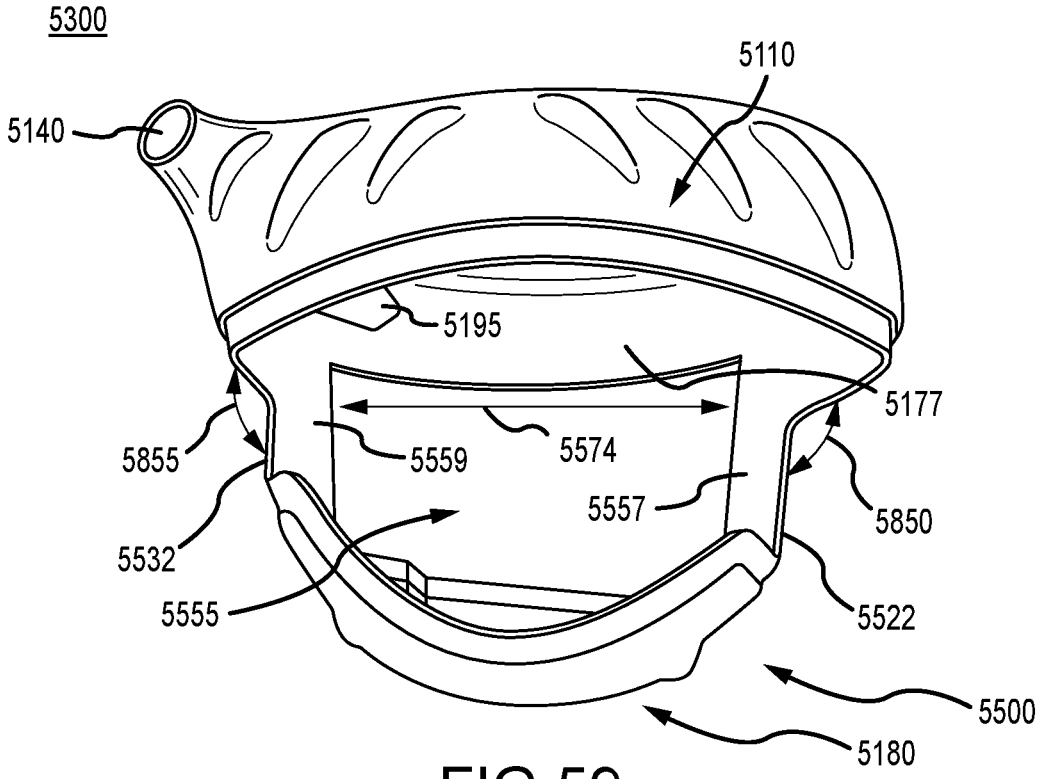
FIG. 59 illustrates a perspective view of a first component of the club head of FIG. 53.
Figure 60:
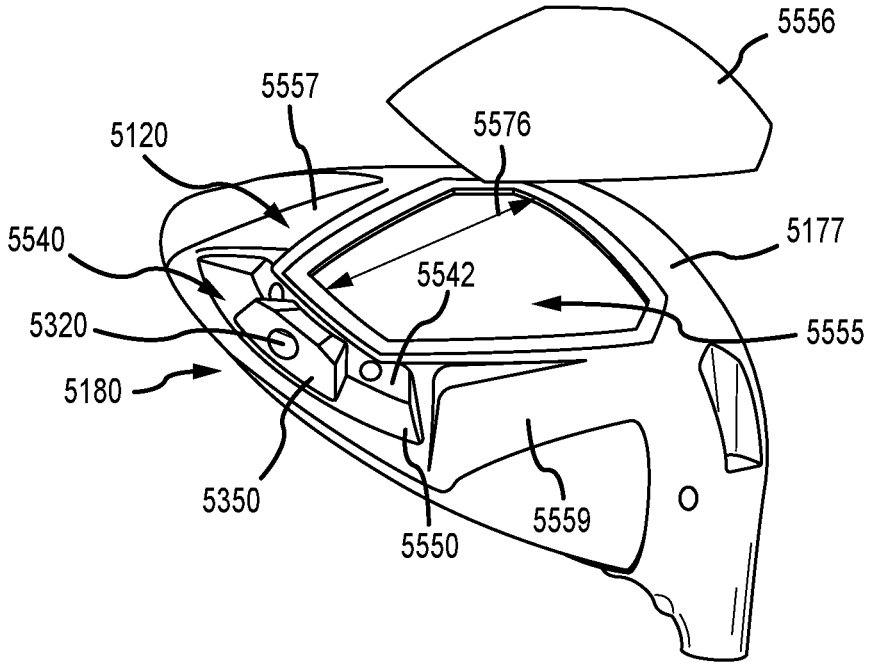
FIG. 60 illustrates an alternate exploded view of a golf club head of FIG. 53.

As illustrated in FIG. 57, the first component (5300) can comprise a rear extension (5500). The rear extension (5500) further comprises a toe side span (5557) and a heel side span (5559). The toe side span (5557) extends towards and connects to the rear end (5180). The heel side span (5559) extends towards and connects to the rear end (5180), opposite to the toe side span (5557). The toe side span (5557), heel side span (5559), rear end (5180) and return portion (5177) form the sole aperture (5555). The sole aperture (5555) functions to remove high density material of the first component (5300) towards the rear end (5180) of the first component (5300). The sole aperture (5555), further allows a different material sole panel (5556) to cover and seal the sole aperture (5555) to create a multi-material sole (5120), leading to increased MOI and improved sound characteristics.

The sole aperture (5555) can be any shape, however in most embodiments, the sole aperture (5555) is approximately rectangular. The sole aperture (5555) bends with general shape of the sole (5120). In some embodiments, the sole aperture (5555) can be square, rectangular, circular, ovular, ellipsular, triangular, polygonal, pentagonal, hexagonal, trapezoidal, or any other desired shape.

The sole aperture (5555) comprises a width (5574), wherein the width (5574) is measured from the toe side span (5557) to the heel side span (5559). In most embodiments, the sole aperture (5555) has a greater width, nearer the return portion (5177), than the aperture width nearer the rear end (5180). This characteristic helps remove as much high density mass from the center of the club head (5100) as possible, allowing the mass to be redistributed tho the rear end (5180) of the club head (5100). However, in some embodiments, the sole aperture (5555) width can be equal or uniform from the return portion (5177) to the rear (5180). Further still, in some embodiments, the sole aperture (5555) width can be greater near the rear end (5180) than the aperture width near the return portion (5177).

The sole aperture widths (5574) may be between 0.5 inch and 6.0 inches. The widths (5574) may be 0.5 inch, 0.6 inch, 0.7 inch, 0.8 inch, 0.9 inch, 1.0 inch, 1.1 inches, 1.2 inches, 1.3 inches, 1.4 inches, 1.5 inches, 1.6 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.0 inches, 3.4 inches, 3.5 inches, 3.6 inches, 3.7 inches, 3.8 inches, 3.9 inches, 4.0 inches, 4.1 inches, 4.2 inches, 4.3 inches, 4.4 inches, 4.5 inches, 4.6 inches, 4.7 inches, 4.8 inches, 4.9 inches, 5.0 inches, 5.1 inches, 5.2 inches, 5.3 inches, 5.4 inches, 5.5 inches, 5.6 inches, 5.7 inches, 5.8 inches, 5.9 inches, or 6.0 inches.

Further, the sole aperture (5555) comprises a length (5576), wherein the length (5576) is measured from the return portion (5177) to the rear end (5180). In most embodiments, the sole aperture (5555) has an equal length near the heel side span (5559) to the length near the toe side span (5557). This characteristic helps keep the club head balanced in a heel to toe direction. In some embodiments, the length near the heel side span (5559) can be less than the length near the toe side span (5557), removing mass from the toe and placing more in the heel, in order to influence a draw or hook shot. In contrast, in some embodiments, the length near the toe side span (5557) can be less than the length near the heel side span (5559), removing mass from the heel and placing more near the toe, in order to influence a slice or fade shot.

The sole aperture lengths (5576) may be between 0.5 inch and 6.0 inches. The lengths (5576) may be 0.5 inch, 0.6 inch, 0.7 inch, 0.8 inch, 0.9 inch, 1.0 inch, 1.1 inches, 1.2 inches, 1.3 inches, 1.4 inches, 1.5 inches, 1.6 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.0 inches, 3.4 inches, 3.5 inches, 3.6 inches, 3.7 inches, 3.8 inches, 3.9 inches, 4.0 inches, 4.1 inches, 4.2 inches, 4.3 inches, 4.4 inches, 4.5 inches, 4.6 inches, 4.7 inches, 4.8 inches, 4.9 inches, 5.0 inches, 5.1 inches, 5.2 inches, 5.3 inches, 5.4 inches, 5.5 inches, 5.6 inches, 5.7 inches, 5.8 inches, 5.9 inches, or 6.0 inches.

The toe side span (5557) and heel side span (5559) connect the return portion (5177) to the rear end (5180). The toe side span (5557) and heel side span (5559) of the rear extension (5500) can comprise a portion of the sole (5120). The rear extension (5500) comprises a weight channel (5540). The weight channel (5540) is exposed at the rear end (5180) and at least a portion sole (5120) of the club head (5300).

The weight channel (5540) is configured to receive a movable weight (5350) in one of three positions. The weight (5350) can be secured to the weight channel (5540) by a threaded fastener (5320). The weight (5350) can be placed in a toe-side position, a central position, or a heel-side position. The weight channel (5540) comprises a mounting wall (5542) and a sole wall (5550). The mounting wall (5542) can be oriented approximately perpendicular to the sole (5120). The sole wall (5550) can be oriented approximately parallel to the main sole (5120), but inset by a distance equal to a height of the mounting wall (5542). The movable weight (5350) can comprise an elongate, trapezoidal shape, or any other suitable weight. The movable weight (5350) can comprise a inward wall and a connecting wall. The inward wall lies flush against the sole wall (5550) of the weight channel (5540). The connecting wall lies flush with the mounting wall (5542) when the weight (5350) is attached in one of the three positions.

The mounting wall (5542) of the weight channel (5540) comprises three threaded apertures that correspond to the three weight positions. The mounting wall (5542) comprises a toe-side threaded aperture (5544), a center threaded aperture (5546), and a heel-side threaded aperture (5548). The movable weight (5350) is positioned in the toe-side position by placing the connecting wall of the weight (5350) flush against the mounting wall (5542) of the channel (5540) and securing the fastener (5320) into the toe-side threaded aperture (5544). The movable weight (5350) is positioned in the central position by placing the connecting wall of the weight (5350) flush against the mounting wall (5542) of the channel (5540) and securing the fastener (5320) into the center threaded aperture (5546). The movable weight (5350) is positioned in the heel-side position by placing the connecting wall of the weight (5350) flush against the mounting wall (5542) of the channel (5540) and securing the fastener (5320) into the heel-side threaded aperture (5548).

When the movable weight (5350) is positioned in the central position (similar to golf club (2100) as illustrated in the sole view of FIG. 19), the golf club (5100) is configured to offer no draw or fade bias. When the weight (2350) is positioned in the toe-side position (similar to golf club (2100) as illustrated in FIG. 20) the weight (2350) gives the club head a fade bias. When the weight (5350) is positioned in the heel-side position (similar to golf club head (2100) as illustrated in FIG. 21) the weight (5350) gives the club head a draw bias.

The first component (5300) comprises a sole portion rear extension (5500), a forward crown portion (5400), and a forward sole portion (5810). The forward sole portion (5810) comprises a heel extension (5830) and a toe extension (5820). The heel extension (5830) comprises a rear wall (5832). The toe extension (5820) comprises a rear wall (5822).

The first component rear extension (5500) comprises the toe-side wall (5522) and a heel-side wall (5532) that connect the weight channel (5540) to the striking face sole return (5810). The toe-side wall (5522) is formed by the toe side span (5557), opposite the sole aperture (5555). Similarly, the heel-side wall (5532) is formed by the heel side span (5559), opposite the sole aperture (5555). The rear extension toe-side wall (5522) and the toe extension rear wall (5822) can form a toe-side wall angle (5850). The toe-side wall angle (5850) can range between 45 degrees and 180 degrees. The rear extension heel-side wall (5532) and the heel extension rear wall (5832) can form a heel-side wall angle (5855). The heel-side wall angle (5855) can range between 45 degrees and 180 degrees. In some embodiments, the toe-side wall angle (5850) is roughly equal to the heel-side wall angle (5855). In other embodiments, the toe-side wall angle (5850) and the heel-side wall angle (5855) are different. In some embodiments, the toe-side wall angle (5850) and the heel-side wall angle (5855) are supplementary angles (their sum equals roughly 180 degrees). In these embodiments, the toe extension rear wall (5822) and the heel extension rear wall (5832) are located roughly within the same plane (the toe rear wall (5822) and the heel rear wall (5832) are roughly parallel when viewed from the sole). For example, the toe-side wall angle (5850) can be an acute angle, while the heel-side wall angle (5855) is a supplementary obtuse angle.

The second component (5200), and similar to second component (2200) as illustrated in FIGS. 29 and 30, can comprise a crown portion (5205), a trailing edge portion (5230), a sole toe portion (5212), and a sole heel portion (5214). The crown portion (5205) connects the sole toe portion (5212) and the sole heel portion (5214). The trailing edge portion (5230) connects the crown portion (5205) to the sole toe and heel portions (5212 and 5214). The crown portion (5205), sole toe portion (5212) and sole heel portion (5214) define a rear cutout in the sole side of the second component (5200). The rear cutout can be similar to the rear cutout (2240), described for the second embodiment, with reference to FIGS. 29 and 30. In some embodiments, such as the one illustrated in FIG. 29, the rear cutout (2240) cuts into the sole only. In other embodiments, such as the one illustrated in FIG. 30, the rear cutout (2240) cuts into both the sole portion and the crown portion (5205). The embodiment that cuts into both the sole and the crown portion (5205) allows more room in the rear end (5180) of the club head (5100) for the weight channel (5540) of the first component (5300).

In some embodiments, the second component (5200) can be secured to the first component (5300) in a way similar to that described above for the first golf club head (100) embodiment and second club head embodiment (2100). In some embodiments, the materials of the first (5300) and second (5200) components can also be similar to those described above for the first golf club head (100) embodiments.

The geometry of the rear sole extension (5500) can mechanically lock or hold the second component (5200) onto the first component. The fan-shaped rear extension (5500), comprising the weight channel (5540), prevents a rigid part from sliding onto the first component (5300). In order to overcome this manufacturing challenge, the second component (5200) can comprise a semi-rigid or flexible material, allowing the second component (5200) to bend around or onto the first component. In these embodiments, the second component (5200) can snap or lock into place. In some embodiments, the fan-shape geometry of the rear sole extension (5500) allows the second component (5200) to be secured to the first component (5300) without the use of adhesive, or with the use of less adhesive.

Further, the golf club head (5100) comprises the sole panel (5556), wherein the sole panel (5556) covers the sole aperture (5555) of the first component (5300). The sole panel (5556), when covering the sole aperture (5555), combines with the toe side span (5557), heel side span (5559) and the rear end (5180) to form the entire sole (5120). The sole panel (5556) is the same shape as the sole aperture (5555), such that the sole panel (5556) covers the entire sole aperture (5555) by joining to the rear (5180), the toe side span (5557), heel side span (5559), and the forward sole portion (5810). In most embodiments, the sole panel (5556) is adhered to the sole aperture (5555).

Similar to the sole aperture (5555), the sole panel (5556) can be any shape, however in most embodiments, the sole panel (5556) is approximately rectangular. The sole panel (5556) bends with general shape of the sole (5120). In some embodiments, the sole panel (5556) can be square, rectangular, circular, ovular, ellipsular, triangular, polygonal, pentagonal, hexagonal, trapezoidal, or any other desired shape.

The sole panel (5556) comprises a width, wherein the width is measured from the toe side span (5557) to the heel side span (5559). In most embodiments, the sole panel (5556) has a greater width, nearer the return portion (5177), than the panel width nearer the rear end (5180). This characteristic helps match the geometry of the sole aperture (5555) and provide a enclosed golf club head (5100). Similar to the width of the sole aperture (5555), in some embodiments, the sole panel (5556) width can be equal or uniform from the return portion (5177) to the rear (5180). Further still, in some embodiments, the sole panel (5556) width can be greater near the rear end (5180) than the panel width near the return portion (5177).

The sole panel width may be between 0.5 inch and 6.0 inches. The widths may be 0.5 inch, 0.6 inch, 0.7 inch, 0.8 inch, 0.9 inch, 1.0 inch, 1.1 inches, 1.2 inches, 1.3 inches, 1.4 inches, 1.5 inches, 1.6 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.0 inches, 3.4 inches, 3.5 inches, 3.6 inches, 3.7 inches, 3.8 inches, 3.9 inches, 4.0 inches, 4.1 inches, 4.2 inches, 4.3 inches, 4.4 inches, 4.5 inches, 4.6 inches, 4.7 inches, 4.8 inches, 4.9 inches, 5.0 inches, 5.1 inches, 5.2 inches, 5.3 inches, 5.4 inches, 5.5 inches, 5.6 inches, 5.7 inches, 5.8 inches, 5.9 inches, or 6.0 inches.

Further, the sole panel (5556) comprises a length, wherein the length is measured from the return portion (5177) to the rear end (5180). In most embodiments, the sole panel (5556) has an equal length near the heel side span (5559) to the length near the toe side span (5557). This characteristic helps the sole panel (5556) match the exact length of the sole aperture (5555). In some embodiments, the length near the heel side span (5559) can be less than the length near the toe side span (5557). In contrast, in some embodiments, the length near the toe side span (5557) can be less than the length near the heel side span (5559).

The sole panel lengths may be between 0.5 inch and 6.0 inches. The lengths may be 0.5 inch, 0.6 inch, 0.7 inch, 0.8 inch, 0.9 inch, 1.0 inch, 1.1 inches, 1.2 inches, 1.3 inches, 1.4 inches, 1.5 inches, 1.6 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.0 inches, 3.4 inches, 3.5 inches, 3.6 inches, 3.7 inches, 3.8 inches, 3.9 inches, 4.0 inches, 4.1 inches, 4.2 inches, 4.3 inches, 4.4 inches, 4.5 inches, 4.6 inches, 4.7 inches, 4.8 inches, 4.9 inches, 5.0 inches, 5.1 inches, 5.2 inches, 5.3 inches, 5.4 inches, 5.5 inches, 5.6 inches, 5.7 inches, 5.8 inches, 5.9 inches, or 6.0 inches.

VI) Method of Manufacture

First Method

Figure 61:
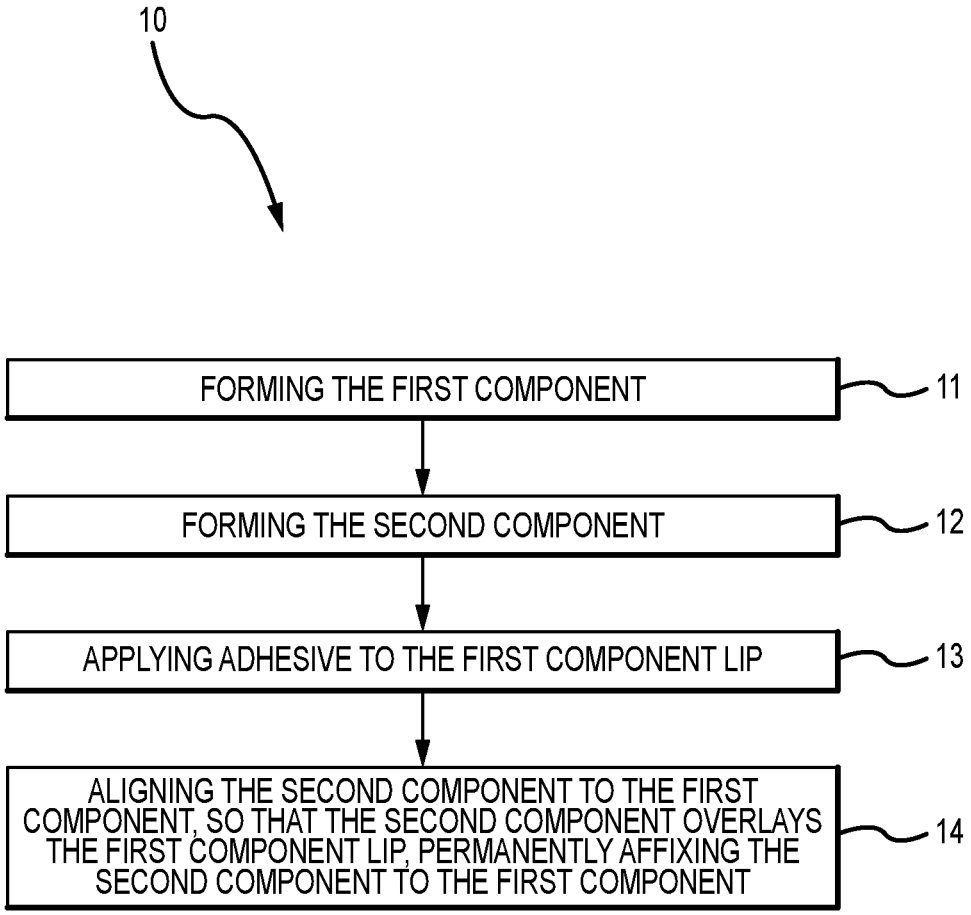
FIG. 61 illustrates a first method of manufacturing a golf club head.

Referring to FIG. 61, a first embodiment of a method (10) of manufacturing the golf club head (100) comprises forming the first component (300), forming the second component (200), applying an adhesive to a first component lip (450), aligning the second component (200) to the first component (300), fitting the second component (200) to the first component (300) so the second component (200) overlays the lip (450), and allowing the adhesive to set, permanently affixing the second component (200) to the first component (300) to form the hollow golf club head (100) (step 4040 in FIG. 50). The method (10) can be used to form a golf club head similar to the first, second, third, or fourth golf club heads (100, 2100, 3100, or 4100), described above. For the sake simplicity, the reference numbers in the following method description refer to the first club head (100), but this method (10) can be applicable to all of the aforementioned club heads (100, 2100, 3100, or 4100) or variations thereof.

Figure 15:
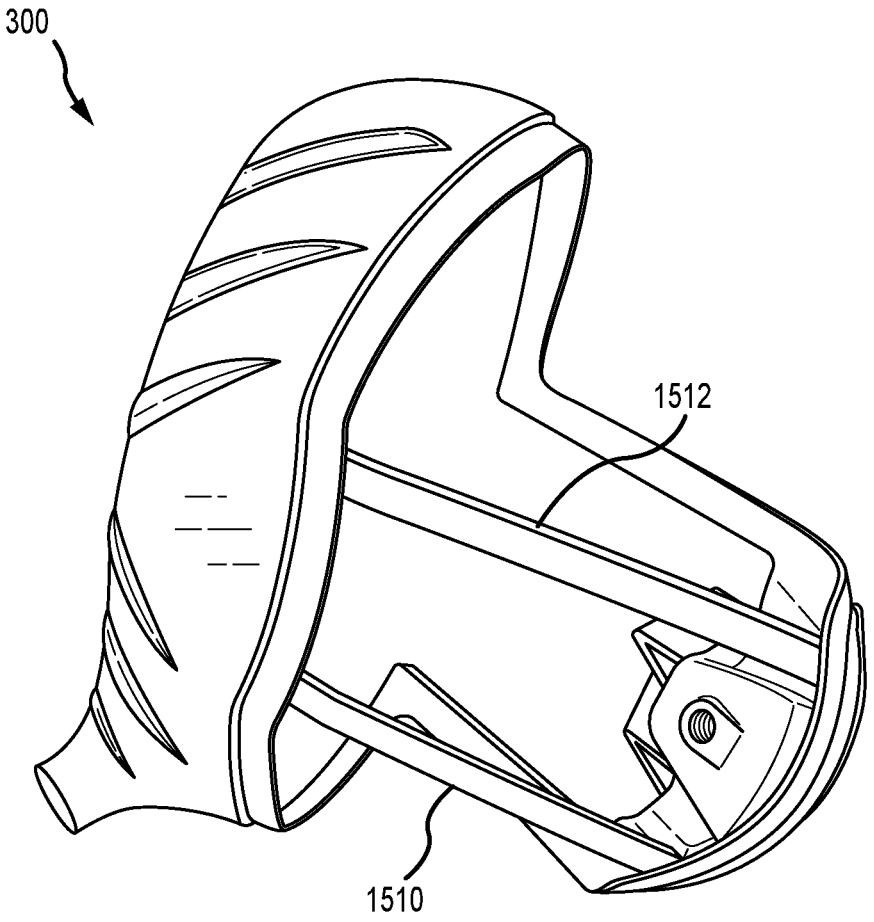
FIG. 15 illustrates a golf club head first component showing casting support bars.

Referring to FIG. 15, as discussed above, the first component (300) may further comprise a plurality of casting support bars, including one or more heel end casting support bars (1510), and one or more toe end casting support bars (1512). The casting support bars stabilize the cast part of the first component (300) while the metal cools after casting. The stabilization provided by the casting support bars prevents the front portion of the cast part from folding towards or away from the first component sole portion rear extension (500) while the part cools after casting. The casing support bars are removed from the as cast first component (300) and are not present in the finished golf club head (100).

An alternative method of manufacturing the golf club head (100) comprises casting the first component (300), molding a wax pattern of the first component (300), adding wax support bars to the wax pattern, investing the modified wax pattern, casting the investment, trimming the metal casting support bars (1510) and (1512), forming the first component (300), forming the second component (200), applying an adhesive to a first component lip (450), aligning the second component (200) to the first component (300), fitting the second component (200) to the first component (300) so the second component (200) overlays the lip (450), and allowing the adhesive to set, permanently affixing the second component (200) to the first component (300) to form the hollow golf club head (100). When adding the support bars to the wax pattern, the attachment points for the support bars are an interior surface of the first component (300) wax pattern, to avoid any marring or distortion of an outer surface of the first component (300) The advantage of adding the support bars is that the casting of the first component is supported against distortion while in a cooling phase after casting.

The first component (300) can be coupled to the second component (200) at the first component lip (450) to form the body of the golf club head (100). The first component lip (450), including the crown portion lip (455), the sole portion lip (460), and the mass portion vertical lip (750) are entirely covered by the second component (200) when the first component (300) is coupled to the second component (200) to form the body of the golf club head (100). The second component sole portion rear cutout (240) comprises a portion of perimeter edge (220) at the trailing edge portion (230). When the first component (300) is coupled to second component (200) at the first component lip (450) (to form the body of the golf club head (100)), the portion of perimeter edge (220) at the trailing edge portion (230) is joined along the mass portion trailing edge shelf (1042).

The first component (300) may be coupled to the second component (200) by means of an adhesive. In many embodiments, an adhesive such as glue, epoxy, epoxy gasket, tape (e.g., VHB tape), or any other adhesive materials can be disposed at the junction of the second component (200) and the first component lip (450). In some embodiments, the first component tabs (457) on the first component lip (450 and 455) can abut the second component (200), leaving a clearance gap between the first component lip (450 and 455) and the second component (200). This clearance gap can house the adhesive. The clearance gap can have a uniform height or thickness due to the first component tabs (457) having uniform heights. This uniform height of the clearance gap can create an even bond between the first and second components. In other embodiments, the second component (200) can be coupled to the first component (300) by fasteners, clips, press fit, or any other appropriate mechanical means of attachment (not shown). In other embodiments, the first component (300) may be coupled to the second component (200) by an adhesive in conjunction with an appropriate mechanical means of attachment. In other embodiments, the first component (300) may be coupled to the second component (200) using laser welding to heat the second component (200) material to cause it to adhere to the first component (300) material.

In some embodiments, when the first component is coupled to the second component to form the golf club head 100), the surface of the first component (300) is not offset from the surface of the second component (200). When the first component (300) is coupled to the second component (200) to form the golf club head (100), a nominal outer surface of the first component is not offset above or below a nominal outer surface of the second component at the juncture of the coupling (i.e. the outer surfaces of the first component (300) and the second component (200) are flush).

Second Method

Figure 62:
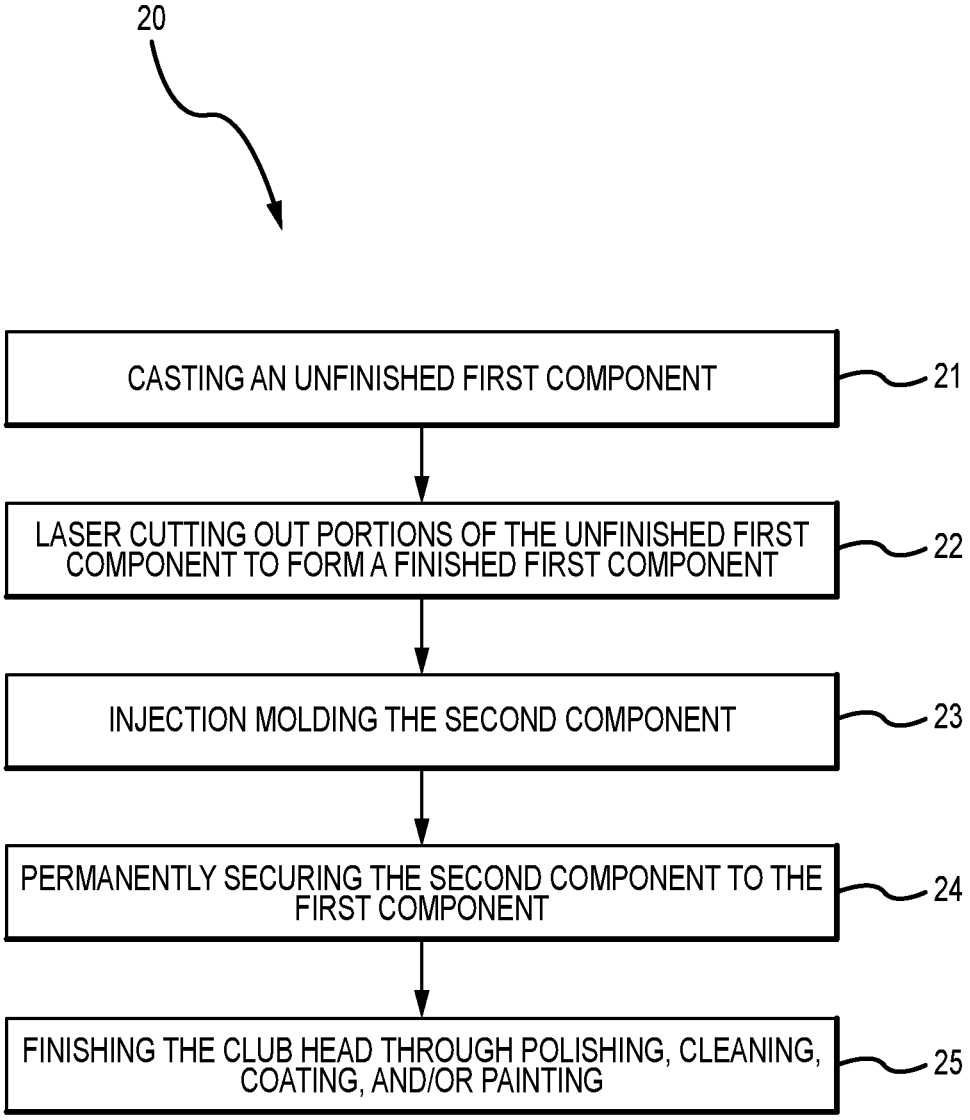
FIG. 62 illustrates a second method of manufacturing a golf club head.

Referring to FIG. 62, a second method of manufacturing (20) the golf club head (100) comprises the following steps: (Step 1: 21) casting an unfinished first component, (Step 2: 22) cutting out portions of the unfinished first component to form a finished first component, (Step 3: 23) injection molding the second component, (Step 4: 24) permanently securing the second component to the first component, and (Step 5: 25) finishing the club head. The second method (20) can be used to form a golf club head similar to the first, second, third, or fourth golf club heads (100, 2100, 3100, or 4100), described above. For the sake simplicity, the reference numbers in the following method description refer to the first club head (100), but this method (20) can be applicable to all of the aforementioned club heads (100, 2100, 3100, or 4100) or variations thereof.

Forming the first component in the first step (21) can start with casting an unfinished version of the first component (300). The first component (300) can be cast as a full club head, with a reduced thickness region. A majority of the reduced thickness region can be located approximately where the second component (200) will later be attached. A peripheral section around an edge of the reduced thickness region will eventually form the lip (450) of the first component (300). The unfinished first component is cast with the reduced thickness region because the reduced thickness region helps the first component hold its desired shape during the casting process. Casting the first component (100) without the reduced thickness region could result in warping of the part or other casting quality issues. Therefore, casting with the reduced thickness region, which is later removed, ensures that the first component maintains its desired shape so that the second component (200) will fit on it correctly during step three.

After the unfinished first component is removed from the mold in which it was cast, a laser is used to cut out the unwanted portion of the reduced thickness region (second step: 22), leaving only the peripheral section, which forms the lip of the second component (450). The lip can be ground down or polished, as necessary. In some embodiments, the strikeface (170) of the club head is integrally cast as part of the first component (300). In other embodiments, the first component (300) can be cast without a strikeface (170) (with an opening or void in the front of the first component). In these embodiments, a faceplate is provided separately by either casting or forging the faceplate from a metallic material. The faceplate can be conventionally welded, laser welded, or swedged (swagged) into the front opening of the first component (300).

The third step (23) can comprise injection molding the second component. The third step (23) can comprise providing a composite material (typically in pellet form), melting the composite material, injecting the melted composite material into a mold to form an unfinished second component, cutting off the sprue, and polishing the gate area to finish the second component (200). As describe above, the composite material can comprise a polymer resin and a reinforcing fiber. The composite material can be provided in pellets that comprise both resin and fiber. The composite pellets are melted and injected into a mold to form the unfinished second component. The injection molding process of the third step (23) can be similar to the injection molding process disclosed in Patent Cooporation Treaty (PCT) Application No. PCT/US2020/047702, filed on Aug. 24, 2020, which is incorporated herein by reference in its entirety.

The fourth step (24) can comprise applying an adhesive (such as a two-part liquid epoxy) to the first component lip (450), aligning and placing the second component (200) over the first component lip (450), and allowing the adhesive to dry. One or more first component tabs (457) on the lip (450) and (455) can provide a clearance gap between the first component lip (450) and the second component. This clearance gap can house the adhesive. The clearance gap can have a uniform height or thickness due to the first component tabs (457) having uniform heights. This uniform height of the clearance gap can create an even bond between the first component (300) and the second component (200).

In some embodiments of this second method (20), a functionalized bonding film or layer can be used instead of an adhesive. The functionalized bonding film can be provided in one or more strip sections that correspond to the shape and side of the first component lip (450) and (455). The functionalized bonding film comprises a first and second side. The film can be configured to bond with the material of the first component on the first side and with the material of the second component on the second side. The bonding film can bond the first and second components together when placed under the necessary temperature and pressure conditions for a set amount of time.

After the adhesive is applied to the first component lip (450) and (455), the second component can be placed or slid over the first component lip. The second component can be slid over the first component lip until an outer edge of the second component comes into contact with the remainder of the first component. As illustrated in FIG. 5, the first component lip comprises a recessed offset (459), which the second component fills when the club head is assembled. The fourth step can further comprise allowing the adhesive to dry and bond the first component to the second component.

The fifth step (25) can comprise polishing, cleaning, coating, and/or painting the club head. In some embodiments, the fifth step (25) can further comprise placing a detachable weight (1300) within the weight recess (540) and securing the detachable weight (1300) using a fastener. In other embodiments, the fifth step (25) can further comprise placing a movable weight (2350) within a weight channel (2540) and securing the movable weight (2350) using a fastener.

Third Method

Figure 63:
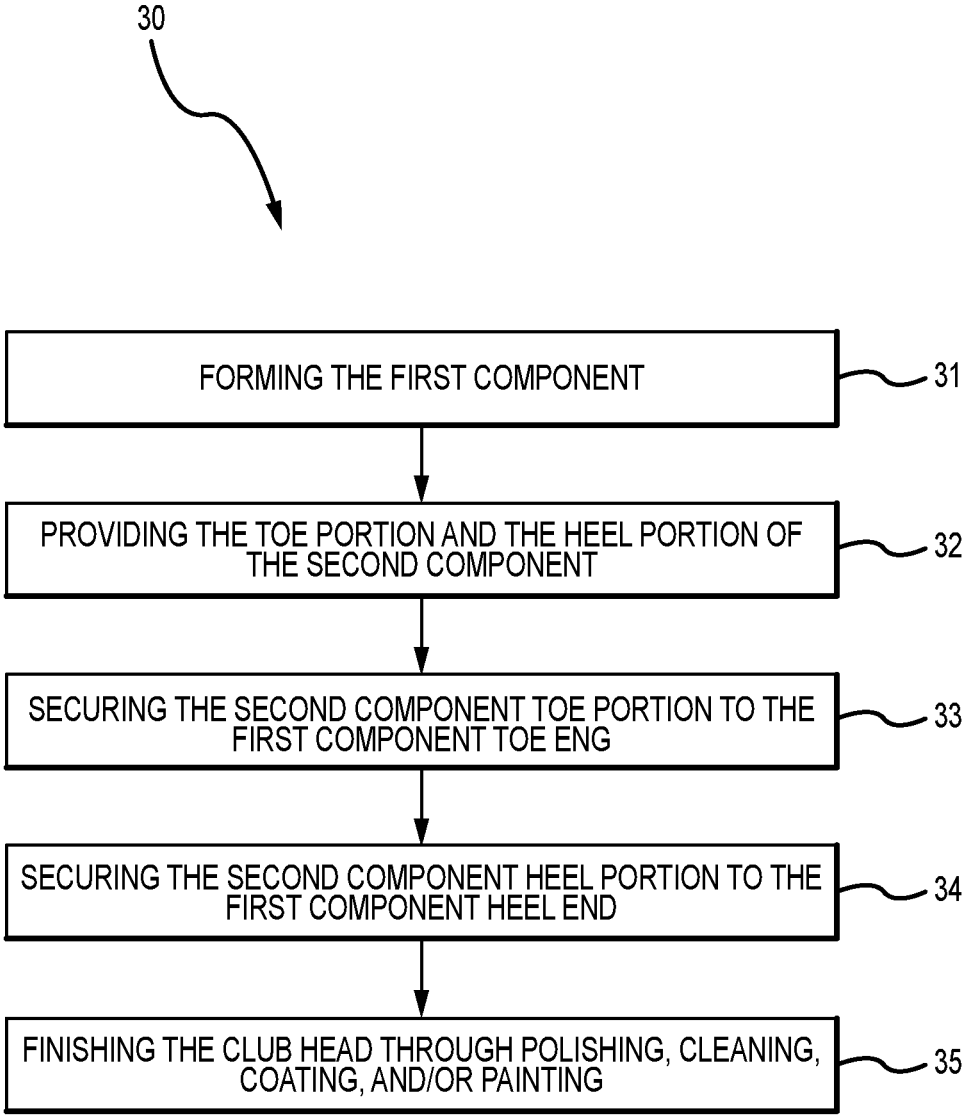
FIG. 63 illustrates a third. method of manufacturing a golf club head.

As illustrated in FIG. 63, a third method (30) comprises the following steps: (Step 1: 31) forming the first component, (Step 2: 32) providing the second component as a toe portion (3212) and a heel portion (3214), (Step 3: 33) securing the second component toe portion (3212) to the first component (3300), (Step 4: 34) securing the second component heel portion (3214) to the first component (3300), and (Step 5: 35) finishing the club head. The first step (31) can comprise casting an unfinished first component, laser cutting out unwanted portions of the unfinished first component, and optionally welding a faceplate to the first component to form the finished first component. The third method (30) can be used to form a golf club head similar to the third or fourth golf club heads (3100 or 4100), described above. For the sake simplicity, the reference numbers in the following method description refer to the third club head (3100), but this method (30) can be applicable to all of the aforementioned club heads (3100 or 4100) or variations thereof.

The first step (31) of forming the first component (3300) can be similar to steps one and two (21 and 22) of the second method (20), described above. However, in this manufacturing process, the crown brace (3560) remains after the laser cutting of the unfinished first component. The finished first component comprises an opening on the heel side (configured to receive the second component heel portion (3214)) and an opening on the toe side (configured to receive the second component toe portion (3212)).

The second step (32) of providing the second component (3200), can be similar to step three (23) of the second method (20), described above. However, in the third manufacturing process (30), the second component (3200) is provided as two separate pieces: a toe portion (3212) and a heel portion (3214). In some embodiments, the toe portion (3212) and heel portion (3214) can be injection molded simultaneously from the same sprue and gate, and then disconnected from each other. In other embodiments, the toe portion (3212) and heel portion (3214) are individually injection molded at different times. After injection molding, the toe and heel portions (3212 and 3214) are finished by cutting or grinding off any excess material left from the gate of the mold, where the material entered the mold.

Steps three and four (33 and 34) can be performed in any desired order. Step three (33) comprises applying adhesive onto a perimeter lip (not illustrated) of the first component (3300), sliding the toe portion (3212) onto the lip of the first component (3300), and allowing the adhesive to cure/set. The toe portion (3212) can be assembled by sliding it in a toe-to-heel direction onto the first component (3300). Step four (34) comprises applying adhesive onto a perimeter lip of the first component (3300), sliding the heel portion (3214) onto the lip of the first component (3300), and allowing the adhesive to cure/set. The heel portion (3214) can be assembled by sliding it in a heel-to-toe direction onto the first component (3300). In some embodiments of the method, steps three and four (33 and 34) are combined so that the adhesive is applied first, the toe portion (3212) and heel portion (3214) are individually slid onto the first component (3300), and the adhesive is then allowed to dry.

Because the toe portion (3212) and the heel portion (3214) are geometrically configured to slide onto the first component (3300) from the sides, the first component (3300) can comprise geometries at the rear end of the club head that would not otherwise be possible. For instance, in embodiments with a unitary second component, the second component generally must be slid in a rear-to-front direction onto the first component (3300). This directional assembly required for the unitary second component determines that the first component must comprise geometry with appropriate draft angles. For example, in some embodiments with a unitary second component, the sole rear extension cannot comprise a region with a smaller width than the rearmost edge of the extension. In light of this, forming the second component as two parts (toe and heel portions) allows the first component to have complex geometries that are not limited by rear-to-front direction draft angles.

VII) T-Shaped Design Functions

As discussed above, the embodiment of a hollow golf club head (100, 2100, 3100, 4100, or 5100) described herein can comprise at least two major components. The metallic, first component (300, 2300, 3300, 4300, or 5300) comprises the striking portion and a sole extension (500, 2500, 3500, 4500, or 5500) forming a "T" shape. The non-metallic, second component (200, 2200, 3200, 4200, 5200) comprises the rear portion of the crown (110, 2110, 3110, 4110, or 5110), and wraps around the first component to also comprise a portion of the sole (120, 2120, 3120, 4120, or 5120). The more dense "T" shaped sole of the first component (300, 2300, 3300, 4300, or 5300), coupled to the less dense crown wrapped around second component (200, 2200, 3200, 4200, or 5200) can optimize mass properties by reducing the crown mass, and shifting the golf club head center of gravity (CG) lower. The saved weight from the second component (200, 2200, 3200, 4200, or 5200) can be redistributed to other locations of the golf club head (100, 2100, 3100, 4100, or 5100) to further optimize the CG, increase the MOI, and manipulate the shape of the shot trajectory.

The CG of the golf club head (100, 2100, 3100, 4100, or 5100) can move lower and toward the rear of the golf club head comprising the first component (300, 2300, 3300, 4300, or 5300) and the second component (200, 2200, 3200, 4200, or 5200), wherein the second component (200, 2200, 3200, 4200, or 5200) comprises a second material with a second density that is lower than the first material density, compared to an alternate golf club head comprising only the first material with a constant density.

EXAMPLES

Example 1

A comparative club head and an exemplary club head of the instant application are compared in Table 1. The comparative club is entirely metallic, but has similar total mass and total volume as the exemplary club head. The exemplary club head was similar to the first embodiment of a golf club head, described above. The exemplary club head comprised a metallic first component and a polymeric second component that attached to the first component to enclose a hollow interior. The first component had a striking face, a striking face return, and a rear extension on the sole. The second component had a crown portion, a sole toe portion, and a sole heel portion.

TABLE 1

| | $CG_y$ | $CG_z$ | $I_{XX}$ | $I_{YY}$ | Mass | Volume |
|---|---|---|---|---|---|---|
| Comparative Golf Club Head | 0.895 | 1.913 | 584.45 | 834.3 | 205.7 g | $445_{CC}$ |
| Exemplary Golf Club Head | 0.887 | 1.986 | 652.71 | 875.94 | 205.8 g | $445_{CC}$ |
| Exemplary Golf Club Head with Embedded Weight | 0.89 | 2.013 | 678.31 | 901.78 | 205.2 g | $445_{CC}$ |

The comparative club head and an exemplary club head have equal volumes of approximately 445 $cm^3$. The comparison club, constructed entirely of a metallic material has a $CG_y$, which is the height of the CG above the ground plane (105), of 0.895 inch. The exemplary golf club head has a $CG_y$ of 0.887 inch. It is desirable to have a lower value for $CG_y$. The $CG_y$ of the exemplary golf club head is lower than that of the comparison club by 0.008 inch.

As described above, $CG_z$ is measured as a distance the CG is located toward the rear end of the golf club head from the strike face center (175) in a direction perpendicular to the loft plane of the (198). A greater $CG_z$, located further to the rear of the golf club, is beneficial for ball flight control. The comparison club, has a $CG_z$ of 1.913 inches. The exemplary golf club head has a $CG_z$ of 1.986 inches. The $CG_z$ of the exemplary golf club head is 0.073 inch further back than the $CG_z$ of the comparison club.

The position of the CG helps determine the launch characteristics of a ball (e.g., ball trajectory, ball spin, and ball speed), moment of inertia (MOI), and performance characteristics (e.g., swing speed, squaring the face during impact). A high MOI prevents rotation of the golf club head during a swing, and helps square the striking face during impact with the ball. Striking the ball with a squared striking face helps ensure a straight ball path and optimal height/trajectory, compared to slicing or hooking the ball when the striking face is not squared. Further, with a lower CG, the speed and spin of the ball are improved, which can add distance and prevent the ball rolling backwards upon landing.

The MOI of the exemplary golf club head is greater than the MOI of the comparison golf club. MOI values $I_{XX}$ and $I_{YY}$ are the MOI values about the X axis (190) and Y axis, (192) respectively. Larger MOI is desirable, as a high MOI helps prevent rotation of the golf club head during a swing, and helps square the striking face during impact with the ball. The comparative club has $I_{XX}$ and $I_{YY}$ values of 584.45 and 834.30, respectively. The exemplary golf club head has $I_{XX}$ and $I_{YY}$ values of 652.71 and 875.94, respectively. The exemplary golf club head has a quite large 11.7% improvement of $I_{xx}$, and a 5.0% improvement of $I_{YY}$ over the comparative club.

The ball flight of a golf ball struck by the exemplary golf club head has improved $CG_y$, and $CG_z$ values, directly leading to improved $I_{XX}$ and $I_{YY}$ values. The improved CG values leads to lower ball spin at impact, which leads to a longer carry for the ball flight. The improved MOI values lead directly to more forgiveness for off center hits.

In an alternate embodiment, an embedded high density weight was added to the exemplary golf club head. The exemplary golf club head with weight has a $CG_y$ of 0.890 inch and a $CG_z$ of 2.013 inches. The exemplary golf club head with weight $CG_y$ is less than the $CG_y$ of the comparative golf club head by 0.005 inch, but the $CG_z$ of the exemplary golf with weight is greater than the $CG_z$ of the comparative golf club head by 0.100 inch. The exemplary golf club head with weight has an $I_{XX}$ value of 678.31, and $I_{YY}$ value of 901.78. These MOI values are both greater than the $I_{XX}$ and $I_{YY}$ of the comparative golf club head by 16% and 8.1%, respectively.

Example 2

A series of club head components were compared to one another through a Finite Element Analysis (FEA) simulation test of the impact of a golf ball with each club head. The club head components were metallic components comprising at least a face, a striking face return, and a sole extension having a rear weight channel holding a movable weight in a center position. The tested components were not fully assembled club heads. They did not include a second component with a lower density. Rather, this test isolated metallic club head components, since simulation and comparison of single components can be more accurate than complex simulation of assembled club heads. The simulation test considered the relative vertical displacement of the rear weight after a center face impact by a golf ball traveling at 80 mph. The rear weight in the simulation had a mass of 32 grams.

The series of club head components included: a first, a second, a third, a fourth, a fifth, a sixth, a seventh, and an eighth test component. The first test component was similar to the first component (300) of the first golf club head (100), described above, except that the first test component comprised a rear weight channel holding a movable weight in a center position rather than a single rear weight. The first test component did not have any brace between the striking face return and a trailing edge of the rear extension.

The second test component was similar to the first component (4300) of the fourth golf club head (4100), described above, specifically the variation of FIGS. 43 and 44. The second test component had a toe skirt brace (similar to 4566) and a heel skirt brace (similar to 4568). The third test component was similar to the first component (4300) of the fourth golf club head (4100), described above, specifically the variation of FIGS. 45 and 46. The third test component had a toe skirt brace (similar to 4566), a heel skirt brace (similar to 4568), and a central crown brace (similar to 4560).

The fourth test component was similar to the first component (4300) of the fourth golf club head (4100), described above, specifically the variation of FIGS. 47 and 48. The fourth test component had a toe-side brace (similar to 4557) and a heel-side brace (similar to 4559). The toe-side brace and the heel-side brace of the fourth test component were separated by a greater width towards the rear end of the fourth test component. The fifth test component was similar to the first component (4300) of the fourth golf club head (4100), described above, specifically the variation of FIGS. 49 and 50. The fifth test component had a toe-side brace (similar to 4557) and a heel-side brace (similar to 4559). The toe-side brace and the heel-side brace of the fifth test component were separated by a lesser width towards the rear end of the fifth test component, so that they formed a V-shape from a top view.

The sixth test component was similar to the first component (4300) of the fourth golf club head (4100), described above, specifically the variation of FIGS. 51 and 52. The sixth test component had a toe skirt brace (similar to 4566), a heel skirt brace (similar to 4568), a toe-side brace (similar to 4557), and a heel-side brace (similar to 4559). The toe-side and heel-side braces of the sixth test component were separated by a greater width towards the rear end of the sixth test component. The seventh test component was similar to the first component (4300) of the fourth golf club head (4100), described above, specifically the variation of FIGS. 53 and 54. The seventh test component had a toe skirt brace (similar to 4566), a heel skirt brace (similar to 4568), a toe-side brace (similar to 4557), and a heel-side brace (similar to 4559). The toe-side and heel-side braces of the seventh test component were parallel to one another.

The eighth test component was similar to the first component (4300) of the fourth golf club head (4100), described above, specifically the variation of FIGS. 55 and 56. The eighth test component had a toe skirt brace (similar to 4566), a heel skirt brace (similar to 4568), and a pair of crisscrossing braces (similar to the above-described first brace 4570 and second brace 4572).

When a golf ball impacts a club head off center relative to the center of gravity force line, a golf club head will torque about the center of gravity. The center of gravity force line is a theoretical line extending roughly perpendicular to the face and coincident with the center of gravity. The induced torque effect about the center of gravity caused by an off line impact is known in the golf industry as gearing. Relative movement of portions of a test component cannot be accurately measured based on a fixed coordinate system, because gearing could contribute to the measurements. For example, gearing could cause a rear movable weight to appear to move downwards if the golf ball strikes the face above the center of gravity force line. Therefore, when measuring the relative vertical displacement of the rear weight channel and weight, measurements must be take with respect to a coordinate system that follows the overall movement of the golf club head.

To conduct an accurate simulation test, a coordinate system was set up within each test component. The coordinate system was linked to a theoretical plane. The theoretical plane was parallel to the loft plane and offset 1.25 inches behind the loft plane, because this region of a golf club head is adequately distanced from the critical stress zones in the crown and sole. Separating the theoretical plane from the critical stress zones isolates the anchored coordinate system, allowing the coordinate system to accurately follow the overall movement of the club head component. Tieing the coordinate system to the overall movement of the club head component allows for accurate measurement of the relative vertical deflection of the movable weight. For the purposes of this example, "relative vertical deflection" should be understood to mean deflection in a sole-to-crown direction parallel to the loft plane (and the theoretical plane). In other words, relative vertical deflection is a measurement of the amplitude of the impact-induced oscillation of the rear weight, relative to the rest of the test golf club head component.

Figure 64:
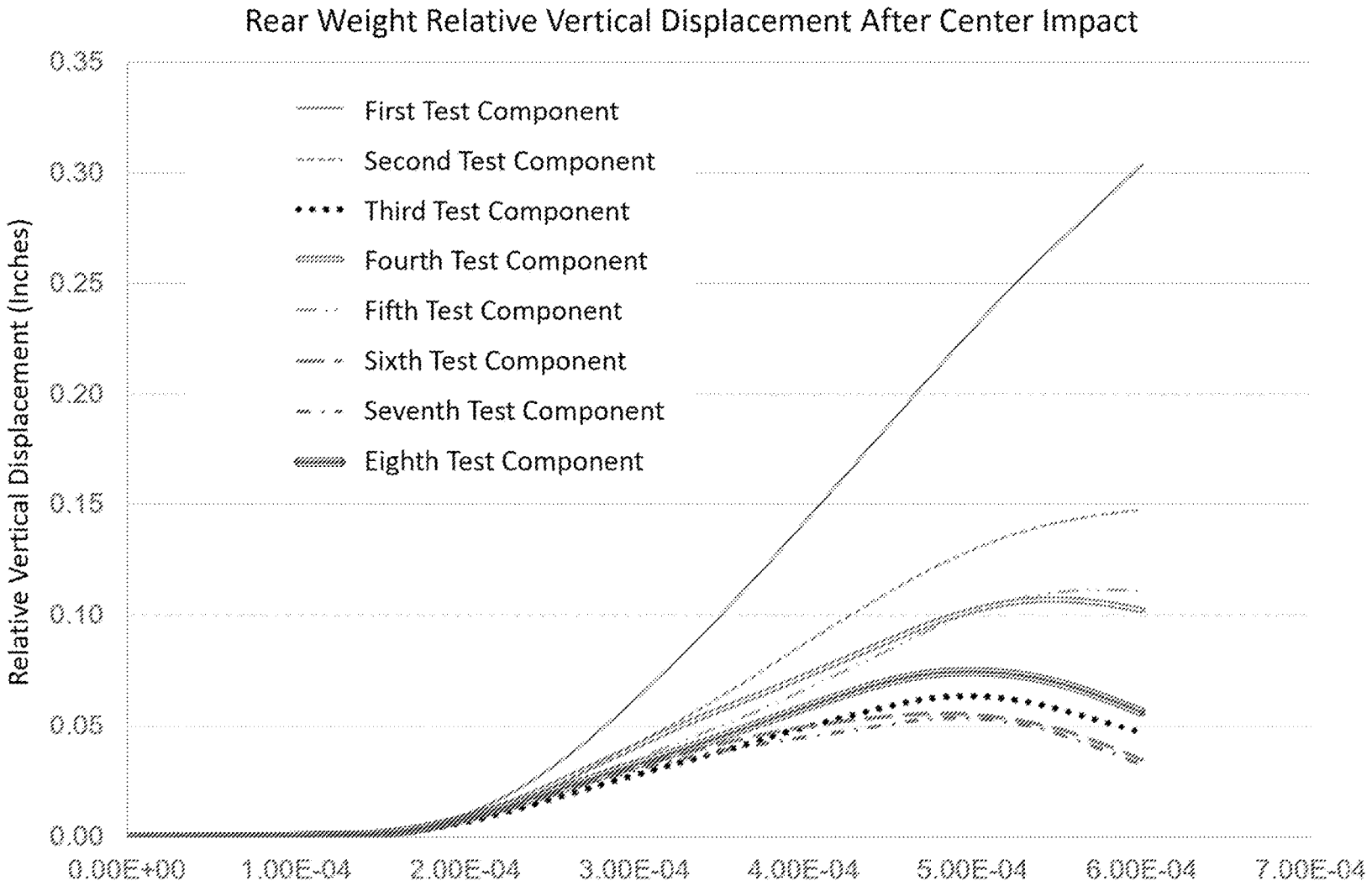
FIG. 64 is a graph of rear weight relative vertical displacement over time, after a center impact, for a series of test club head components, according to a simulation.

As graphed in FIG. 64, the back weight of the first test component (with no braces) deflected over 0.3 inch. The second test component (with toe and heel skirt braces) showed an improvement, with the rear weight deflecting up to approximately 0.15 inch. The fifth test component (with toe and heel-side braces, V-shaped) showed a maximum relative vertical weight displacement of approximately 0.12 inch. The fourth test component (with rearwardly widening toe and heel side braces) performed similarly to the fifth test component. The fourth test component showed a maximum relative vertical displacement of approximately 0.11 inch. The eighth test component (with skirt braces and crisscrossing crown braces) showed a maximum relative vertical displacement of approximately 0.075 inch. The third, sixth, and seventh test components performed better than any of the other components.

Figure 65:
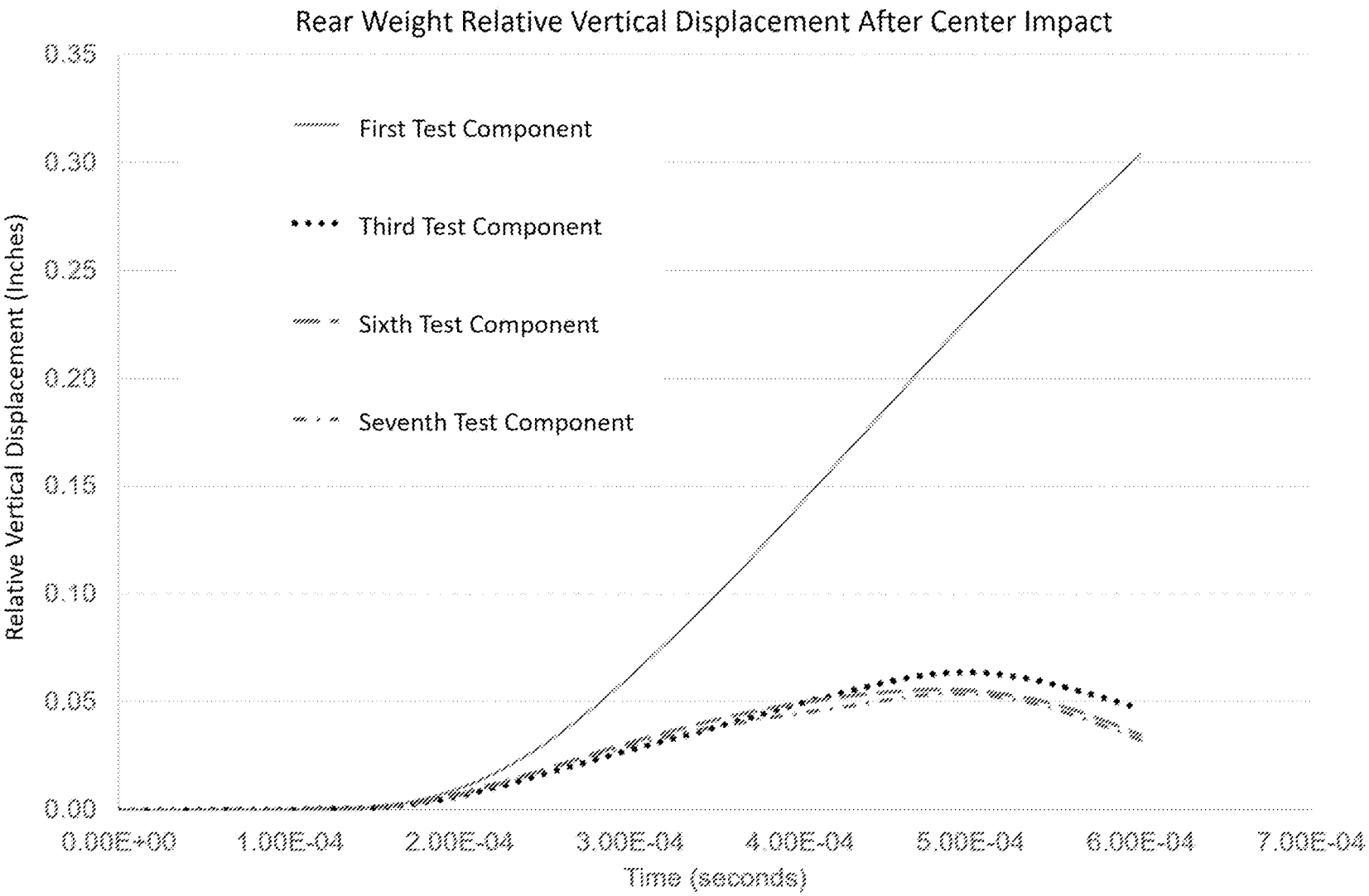
FIG. 65 is a graph of rear weight relative vertical displacement over time, after a center impact, for selected test club head components from the simulation of FIG. 64.
Figure 66:
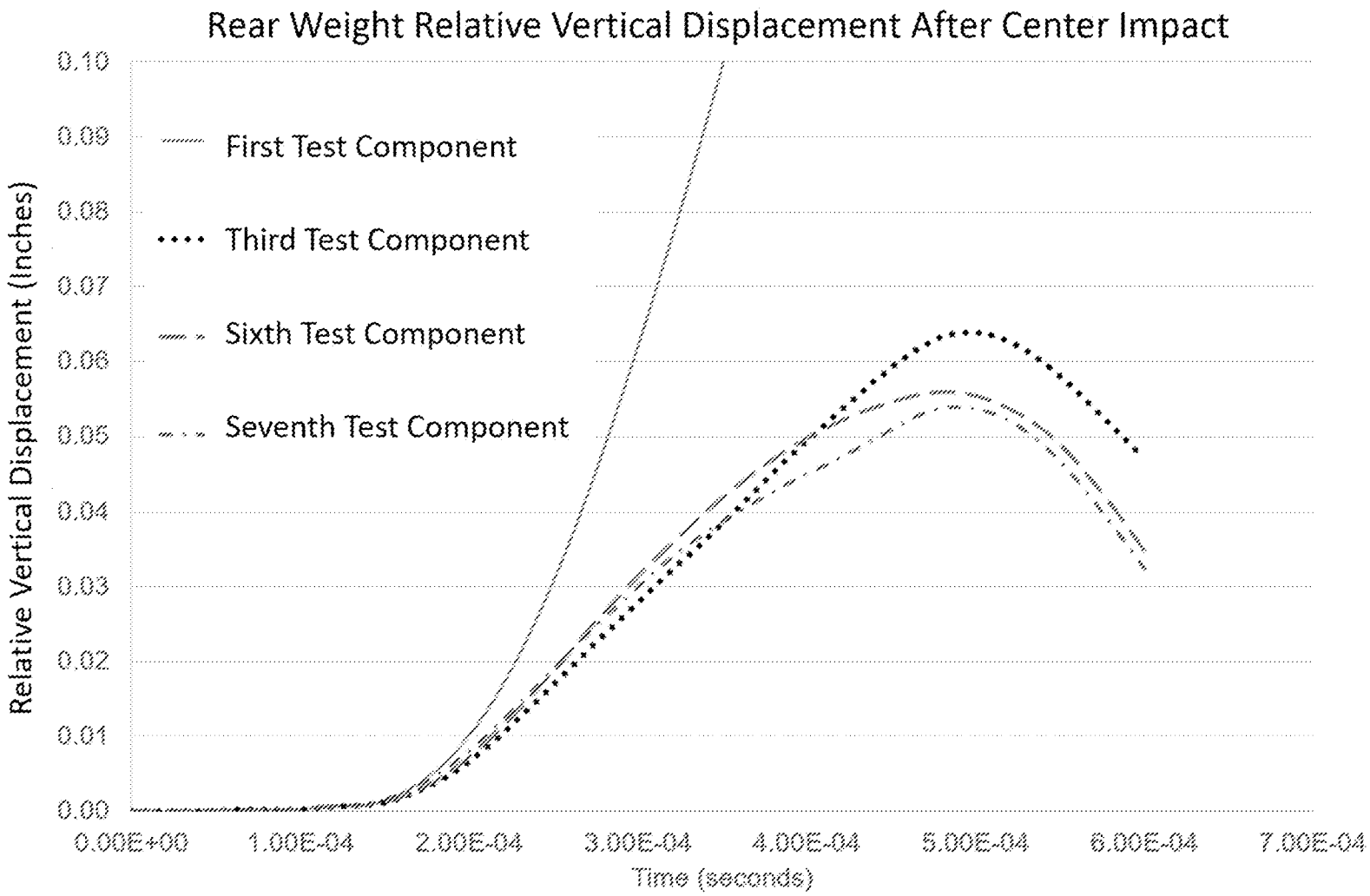
FIG. 66 is a zoomed in region of the graph of FIG. 65.

The graph of FIG. 65 shows the third, sixth, and seventh test components compared to the baseline first test component. The graph of FIG. 66 is a zoomed in view of the graph of FIG. 65. As shown in the FIG. 66 graph, the third test component (with skirt braces and central crown brace) showed a maximum relative vertical displacement of approximately 0.065 inch. The sixth test component (with skirt braces and rearwardly widening toe and heel side braces) showed a slightly lower maximum relative vertical displacement of approximately 0.057, and the seventh test component (with skirt braces and parallel toe and heel side braces) showed a maximum relative vertical displacement of approximately 0.054 inch.

A rear weight which deflects upwards more will rebound downwards more, inducing more material fatigue and stress in the sole rear extension. For a fully assembled golf club head having the herein described two-component design, the lip or overlapping joint structure connecting the first and second components is at risk for delaminating if the rear weight oscillates or vibrates at high amplitudes (high values of relative vertical displacement). Therefore, the test components exhibiting lower relative vertical displacement of the rear weight will form more durable golf club heads. This simulation test showed that adding braces to the first component improves the durability of the golf club head. In particular, including a combination of two skirt braces, a toe-side brace, and a heel-side brace into a first component (such as in FIGS. 51-54) provided the best stability to the rear weight and thus the greatest durability.

The performance of a full golf club head will be better than the performance of the tested series of club head components (i.e. metallic, first components). For the herein described golf club head embodiments, the second component, typically comprising a polymeric material, provides some support to the first component. The attached second component reduces the relative vertical displacement of the rear weight. Therefore, any component of the series of tested club head components can form a sufficiently durable club head if coupled with properly designed second component. However, a first component (metallic) that has less relative vertical displacement of the rear weight can be coupled to a thinner, lighter weight, or less durable second component to arrive at an equally durable overall club head.

Example 3

A second comparison was done between the first test component, the third test component, and the seventh test component, described in Example 2 above. This comparison test was conducted through a Finite Element Analysis (FEA) simulation test of the impact of a golf ball with each club head. The simulation test considered the relative vertical displacement of the rear weight after a toe-side (off-center)

face impact by a golf ball traveling at 80 mph. The face was impacted at 1 inch towards the toe end from the geometric center of the face.

Figure 67:
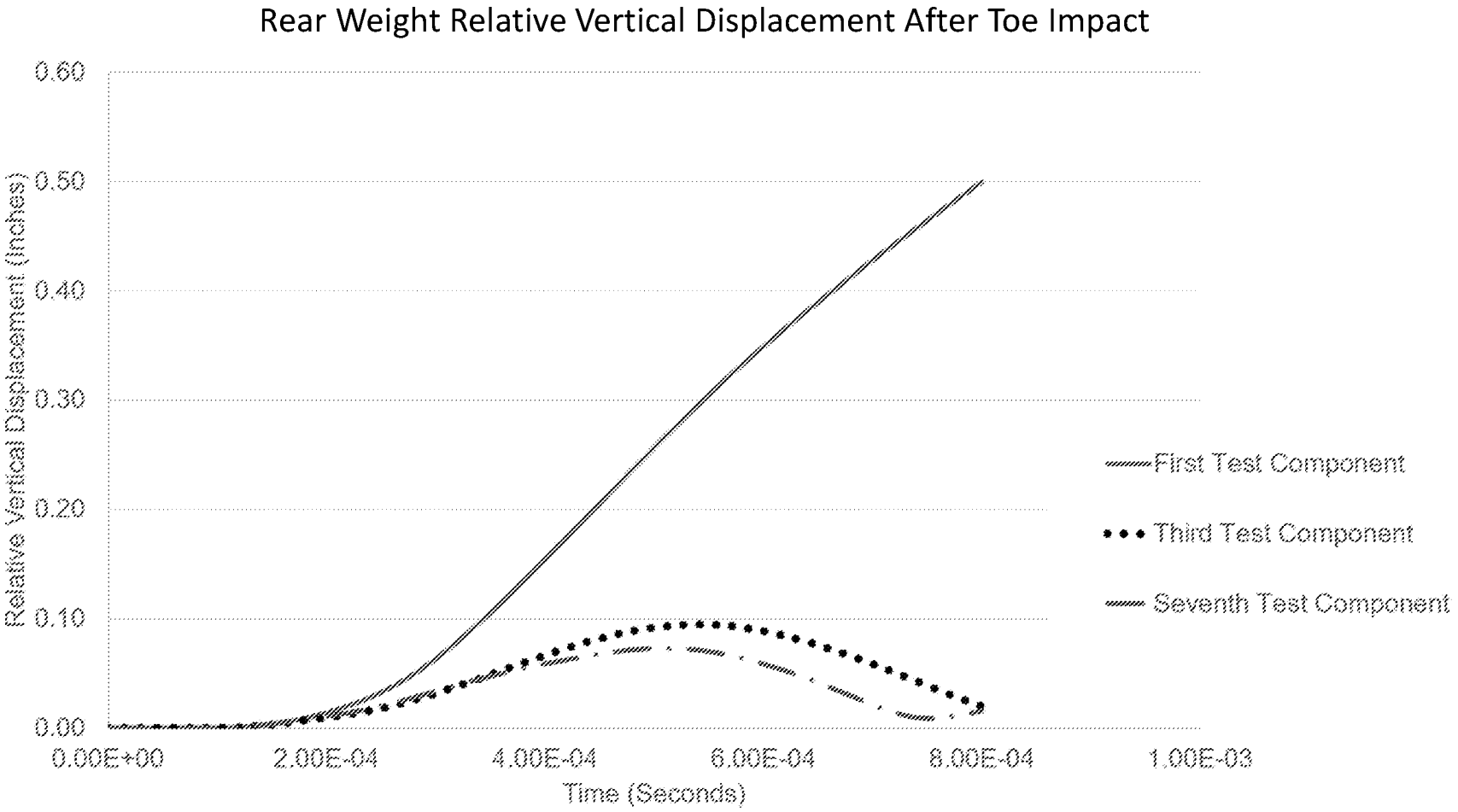
FIG. 67 is a graph of a rear weight relative vertical displacement over time, after a toe-side impact, for selected test club head components, according to a simulation.

As shown in the graph of FIG. 67, the first test component (with no braces) showed a rear weight relative vertical displacement of over 0.5 inch. The third test component (with skirt braces and central crown brace) showed a rear weight maximum relative vertical displacement of approximately 0.1 inch. The seventh test component (with skirt braces and parallel toe and heel side braces) showed a rear weight maximum relative vertical displacement of approximately 0.08 inch. This comparison illustrates that braces increase club head durability not only for center hit shots, but also for off-center hit shots.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Custom within the industry, rules set by golf organizations such as the United States Golf Association (USGA) or The R&A, and naming convention may augment this description of terminology without departing from the scope of the present application.

While the above examples may be described in connection with a hollow body golf club, the apparatus, methods, and articles of manufacture described herein may be applicable to other types of golf club such as an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosures are set forth in the following clauses.

Clause 1: A golf club head comprising: a body comprising: a striking face, a rear end, a toe end, a heel end, a crown, a sole, a skirt, and a trailing edge, the body further comprising: a first component comprising the striking face, a striking face return, a rear extension comprising a weight channel, and a crown brace attached to the striking face return and to the rear extension; and a second component comprising a crown portion, a sole toe portion, and a sole heel portion; wherein: the second component is configured to be coupled to the first component to form an enclosed hollow interior of the golf club head; the first component comprises a first material having a first density; the second component comprises a second material having a second density; the first density is greater than the second density; the striking face comprises a striking face center; the weight channel is centrally located in the rear end of the golf club head; the striking face return of the first component extends rearwardly from the striking face, and comprises a forward crown portion and a forward sole portion; the rear extension extends from the forward sole portion of the striking face return toward the rear end; the rear extension further comprises a rear extension axis extending through a center of the rear extension; and a first component mass is 85% to 96% of a mass of the golf club head.

Clause 2: The golf club head of clause 1, wherein the crown brace attaches to the forward crown portion of the striking face return and to the sole rear extension adjacent to the weight channel at the rear end of the golf club head.

Clause 3: The golf club head of clause 2, wherein the crown brace and the weight channel comprise a hammerhead shape.

Clause 4: The golf club head of clause 2, wherein: the crown brace further comprises a crown brace longitudinal axis; the crown brace comprises a maximum length; and the crown brace longitudinal axis bisects the crown brace along the maximum length.

Clause 5: The golf club head of clause 4, wherein the crown brace longitudinal axis is offset toward the heel end parallel to the rear extension axis.

Clause 6: The golf club head of clause 4, wherein the crown brace longitudinal axis is offset toward the toe end parallel to the rear extension axis.

Clause 7: The golf club head of clause 4, wherein the crown brace longitudinal axis is non-parallel to the rear extension axis such that the crown brace longitudinal axis forms an acute angle relative to the rear extension axis.

Clause 8: The golf club head of claim 4, wherein: an X-axis that extends through the striking face center in a direction from the heel end to the toe end of the golf club head, also extending parallel to a ground plane when the club head is at an address position; a Y-axis extends through the striking face center in a direction from the crown to the sole of the golf club head, and perpendicular to the X-axis; a Z-axis extends through the striking face center in a direction from the striking face to the golf club head rear end and perpendicular to the X-axis and the Y-axis; a loft plane is approximately parallel to the striking face and tangent to the striking face center forming a loft angle with the ground plane; an XY plane extends through the X-axis and the Y-axis; a YZ plane extends through the Y-axis and the Z-axis; and the crown brace longitudinal axis is parallel to the YZ plane.

Clause 9: The golf club head of clause 1, wherein the weight channel is exposed at the rear end and sole of the body.

Clause 10: The golf club head of clause 1, wherein the weight channel is configured to receive a moveable weight in one of three positions.

Clause 11: The golf club head of clause 1, wherein the rear extension comprises a toe-side wall and a heel-side wall extending between the weight channel and the forward sole portion of the striking face return.

Clause 12: The golf club head of clause 10, wherein: the weight channel further comprises a mounting wall comprising three threaded apertures; the three threaded apertures comprise a toe-side threaded aperture, a center threaded aperture, and a heel-side threaded aperture; and the center threaded aperture is located at center point of a length of the mounting wall.

Clause 13: The golf club head of clause 1, wherein: the rear extension comprises a rear extension width measured in a heel to toe direction rearward of a rear perimeter of the forward sole portion of the striking face return; and the rear extension width is in a range of 25% to 85% of an entire width of the sole.

Clause 14: The golf club head of clause 13, wherein the rear extension width adjacent the weight channel can range between 1 inch and 2.5 inches.

Clause 15: The golf club head of clause 12, wherein a moveable weight is secured by a threaded fastener, which engages one of the three threaded apertures.

Clause 16: The golf club head of claim 12, wherein: the weight channel further comprises a sole wall, the sole wall being inset from the sole; the mounting wall is oriented approximately perpendicular to the sole; and the sole wall is inset from the sole by a distance approximately equal to the height of the mounting wall.

Clause 17: A golf club head comprising: a body comprising: a striking face, a rear end, a toe end, a heel end, a crown, a sole, a skirt, and a trailing edge, the body further comprising: a first component comprising the striking face, a striking face return, a rear extension comprising a weight channel, and a plurality of crown braces; and a second component comprising a crown portion, a sole toe portion, and a sole heel portion; wherein: the second component is configured to be coupled to the first component to form an enclosed hollow interior of the golf club head; the first component comprises a first material having a first density; the second component comprises a second material having a second density; the first density is greater than the second density; the striking face comprises a striking face center; the weight channel is centrally located in the rear end of the golf club head; the striking face return of the first component extends rearwardly from the striking face; and comprises a first component crown portion and a first component sole portion; the rear extension extends from the first component sole portion of the striking face return toward the rear end; the rear extension further comprises a rear extension axis extending through a center of the rear extension; and a first component mass is 85% to 96% of a mass of the golf club head.

Clause 18: The golf club head of clause 17, wherein: the plurality of crown braces defines a number of openings in the first component; and the number of openings is selected from the group consisting of: three, four, five, or six openings.

Clause 19: The golf club head of clause 17, wherein: the plurality of crown braces comprises two crown braces; each of the two crown braces attaches to the forward crown portion and to the rear extension adjacent to the weight channel at the rear end of the golf club head.

Clause 20: The golf club head of clause 19, wherein the two crown braces attach to rear extension at different points.

The invention claimed is:

1. A golf club head comprising:

a body comprising:

a striking face, a rear end, a toe end, a heel end, a crown, a sole, a skirt, and a trailing edge, the body further comprising:

a first component comprising the striking face, a striking face return, a rear extension comprising a weight channel, and a crown brace attached to the striking face return and to the rear extension; and a second component comprising a crown portion, a sole toe portion, and a sole heel portion;

wherein:

the second component is configured to be coupled to the first component to form an enclosed hollow interior of the golf club head;

the first component comprises a first material having a first density;

the second component comprises a second material having a second density;

the first density is greater than the second density;

the striking face comprises a striking face center;

the weight channel is centrally located in the rear end of the golf club head;

the weight channel is configured to receive a moveable weight the weight channel further comprises a mounting wall comprising three threaded apertures;

the three threaded apertures comprises a toe-side threaded aperture, a center threaded aperture, and a heel-side threaded aperture:

the center threaded aperture is located at a center point of a length of the mounting wall;

the striking face return of the first component extends rearwardly from the striking face, and comprises a forward crown portion and a forward sole portion;

the rear extension extends from the forward sole portion of the striking face return toward the rear end;

the rear extension further comprises a rear extension axis extending through a center of the rear extension; and a first component mass is 85% to 96% of a mass of the golf club head.

2. The golf club head of claim 1, wherein the crown brace attaches to the forward crown portion of the striking face return and to the rear extension adjacent to the weight channel at the rear end of the golf club head.

3. The golf club head of claim 2, wherein the crown brace and the weight channel connection is rounded.

4. The golf club head of claim 2, wherein:

the crown brace further comprises a crown brace longitudinal axis;

the crown brace comprises a maximum length; and the crown brace longitudinal axis bisects the crown brace along the maximum length.

5. The golf club head of claim 4, wherein the crown brace longitudinal axis is offset toward the heel end parallel to the rear extension axis.

6. The golf club head of claim 4, wherein the crown brace longitudinal axis is offset toward the toe end parallel to the rear extension axis.

7. The golf club head of claim 4, wherein the crown brace longitudinal axis is non-parallel to the rear extension axis such that the crown brace longitudinal axis forms an acute angle relative to the rear extension axis.

8. The golf club head of claim 4, wherein:

an X-axis that extends through the striking face center in a direction from the heel end to the toe end of the golf club head, also extending parallel to a ground plane when the club head is at an address position;

a Y-axis extends through the striking face center in a direction from the crown to the sole of the golf club head, and perpendicular to the X-axis;

a Z-axis extends through the striking face center in a direction from the striking face to the golf club head rear end and perpendicular to the X-axis and the Y-axis;

a loft plane is approximately parallel to the striking face and tangent to the striking face center forming a loft angle with the ground plane;

an XY plane extends through the X-axis and the Y-axis;

a YZ plane extends through the Y-axis and the Z-axis; and the crown brace longitudinal axis is parallel to the YZ plane.

9. The golf club head of claim 1, wherein the weight channel is exposed at the rear end and the sole of the body.

10. The golf club head of claim 1, wherein the rear extension comprises a toe-side wall and a heel-side wall extending between the weight channel and the forward sole portion of the striking face return.

11. The golf club head of claim 1, wherein:

the rear extension comprises a rear extension width measured in a heel to toe direction rearward of a rear perimeter of the forward sole portion of the striking face return; and the rear extension width is in a range of 25% to 85% of an entire width of the sole.

12. The golf club head of claim 11, wherein the rear extension width adjacent the weight channel can range between 1 inch and 2.5 inches.

13. The golf club head of claim 1, wherein a moveable weight is secured by a threaded fastener, which engages one of the three threaded apertures.

14. The golf club head of claim 1, wherein:

the weight channel further comprises a sole wall, the sole wall being inset from the sole;

the mounting wall is oriented approximately perpendicular to the sole; and the sole wall is inset from the sole by a distance approximately equal to a height of the mounting wall.

15. A golf club head comprising:

a body comprising:

a striking face, a rear end, a toe end, a heel end, a crown, a sole, a skirt, and a trailing edge, the body further comprising:

a first component comprising the striking face, a striking face return, a rear extension comprising a weight channel, and a plurality of crown braces; and a second component comprising a crown portion, a sole toe portion, and a sole heel portion;

wherein:

the second component is configured to be coupled to the first component to form an enclosed hollow interior of the golf club head;

the first component comprises a first material having a first density;

the second component comprises a second material having a second density;

the first density is greater than the second density;

the striking face comprises a striking face center;

the weight channel is centrally located in the rear end of the golf club head;

the weight channel is configured to receive a moveable weight;

the weight channel further comprises a mounting wall comprising three threaded apertures;

the three threaded apertures comprises a toe-side threaded aperture, a center threaded aperture, and a heel-side threaded aperture;

the center threaded aperture is located at a center point of a length of the mounting wall:

the striking face return of the first component extends rearwardly from the striking face; and comprises a first component crown portion and a first component sole portion;

the rear extension extends from the first component sole portion of the striking face return toward the rear end;

the rear extension further comprises a rear extension axis extending through a center of the rear extension; and a first component mass is 85% to 96% of a mass of the golf club head.

16. The golf club head of claim 15, wherein:

the plurality of crown braces defines a number of openings in the first component; and the number of openings is selected from the group consisting of: three, four, five, or six openings.

17. The golf club head of claim 15, wherein:

the plurality of crown braces comprises two crown braces;

each of the two crown braces attaches to the first component crown portion and to the rear extension adjacent to the weight channel at the rear end of the golf club head.

18. The golf club head of claim 17, wherein the two crown braces attach to the rear extension at different points.

* * * * *